US010926940B2

(12) United States Patent
Allegretti et al.

(10) Patent No.: US 10,926,940 B2
(45) Date of Patent: Feb. 23, 2021

(54) BULK MATERIAL SHIPPING CONTAINER

(71) Applicant: SANDBOX LOGISTICS, LLC, Houston, TX (US)

(72) Inventors: C. John Allegretti, Barrington Hills, IL (US); Kevin Sylvester Corrigan, Forest Park, IL (US)

(73) Assignee: SANDBOX ENTERPRISES, LLC, Katy, TX (US)

( * ) Notice: Subject to any disclaimer, the term of this patent is extended or adjusted under 35 U.S.C. 154(b) by 128 days.

(21) Appl. No.: 16/196,901

(22) Filed: Nov. 20, 2018

(65) Prior Publication Data

US 2020/0156855 A1 May 21, 2020

(51) Int. Cl.

| | |
|---|---|
| ***B65D 19/06*** | (2006.01) |
| ***B65D 83/06*** | (2006.01) |
| ***B65D 88/28*** | (2006.01) |
| ***B65D 88/54*** | (2006.01) |
| ***B65D 90/62*** | (2006.01) |
| ***B65D 88/12*** | (2006.01) |
| ***B65D 19/08*** | (2006.01) |

(52) U.S. Cl.

CPC ..... *B65D 83/06* (2013.01); *B65D 19/08* (2013.01); *B65D 88/126* (2013.01); *B65D 88/28* (2013.01); *B65D 88/54* (2013.01); *B65D 90/623* (2013.01); *B65D 2519/00024* (2013.01); *B65D 2519/00059* (2013.01); *B65D 2519/00164* (2013.01); *B65D 2519/00199* (2013.01); *B65D 2519/00233* (2013.01); *B65D 2519/00273* (2013.01); *B65D 2519/00293* (2013.01); *B65D 2519/00323* (2013.01); *B65D 2519/00348* (2013.01); *B65D 2519/00497* (2013.01); *B65D 2519/00716* (2013.01)

(58) Field of Classification Search

CPC ..... B65D 19/08; B65D 83/06; B65D 88/126; B65D 88/54; B65D 88/28; B65D 90/623; B65D 2519/00024; B65D 2519/00059; B65D 2519/00273

USPC ..... 206/386, 599, 600; 220/1.5

See application file for complete search history.

(56) References Cited

U.S. PATENT DOCUMENTS

| | | | |
|---|---|---|---|
| 572,468 | A | 12/1896 | Brown |
| 710,611 | A | 10/1902 | Ray |
| 917,646 | A | 4/1909 | Otto |
| 917,649 | A | 4/1909 | Otto |
| 2,385,245 | A | 9/1945 | Willoughby |

(Continued)

FOREIGN PATENT DOCUMENTS

| | | |
|---|---|---|
| DE | 4008147 | 9/1990 |
| EP | 0016977 | 10/1980 |

(Continued)

*Primary Examiner* — Luan K Bui

(74) *Attorney, Agent, or Firm* — Lorenz & Kopf LLP

(57) ABSTRACT

A bulk material shipping container including a pallet, a compartment configured to receive, hold, and release loose materials and connected to and supported by the pallet, a material unloading assembly positioned under a bottom portion of the compartment, configured to facilitate the release or unloading of loose materials from the compartment, and connected to and supported by the pallet, and a material loading assembly configured to facilitate the loading of loose materials into the compartment and connected to and partially supported by a top wall assembly of the compartment.

11 Claims, 48 Drawing Sheets

(56) References Cited

U.S. PATENT DOCUMENTS 2,462,693 A 2/1949 Wabshaw
2,563,470 A 8/1951 Kane
2,622,771 A 12/1952 Tulou
2,652,174 A 9/1953 Shea et al.
2,670,866 A 3/1954 Glesby
2,678,737 A 5/1954 Mangrum
2,802,603 A 8/1957 McCray
2,865,521 A 12/1958 Fisher et al.
2,894,666 A 7/1959 Campbell, Jr.
3,009,674 A * 11/1961 Ingvartsen ..... B65D 19/08 108/14
3,049,248 A 8/1962 Heltzel et al.
3,083,879 A 4/1963 Coleman
3,151,779 A 10/1964 Rensch et al.
3,270,921 A 9/1966 Nadolske
3,294,306 A 12/1966 Areddy
3,318,473 A 5/1967 Jones et al.
3,343,688 A 9/1967 Ross
3,406,995 A 10/1968 McCarthy
3,407,971 A 10/1968 Oehler
3,476,270 A 11/1969 Cox et al.
3,602,400 A 8/1971 Cooke
3,752,511 A 8/1973 Racy
3,785,534 A 1/1974 Smith
3,797,727 A 3/1974 Downing et al.
3,802,584 A 4/1974 Sackett, Sr. et al.
3,904,105 A 9/1975 Booth
3,955,703 A 5/1976 Zebarth
3,986,708 A 10/1976 Heltzel et al.
3,999,290 A 12/1976 Wood
4,019,634 A 4/1977 Bonnot
4,019,635 A 4/1977 Boots
4,023,719 A 5/1977 Noyon
4,056,295 A 11/1977 Downing
4,058,239 A 11/1977 Van Mill
4,138,163 A 2/1979 Calvert et al.
4,178,117 A 12/1979 Brugler
4,204,773 A 5/1980 Bates
4,247,228 A 1/1981 Gray et al.
4,258,953 A 3/1981 Johnson
4,280,640 A 7/1981 Daloisio
4,282,988 A 8/1981 Hulbert, Jr.
4,313,708 A 2/1982 Tiliakos
4,331,252 A 5/1982 Carren
4,366,905 A * 1/1983 Forshee ..... B65D 21/0215 206/511
4,397,406 A 8/1983 Croley
4,398,653 A 8/1983 Daloisio
4,448,296 A 5/1984 Tabler
4,466,541 A 8/1984 Tabler et al.
4,470,518 A 9/1984 Stein
4,485,910 A 12/1984 Tabler
4,572,368 A 2/1986 Miller et al.
4,573,577 A 3/1986 Miller
4,574,962 A 3/1986 Tabler et al.
4,600,103 A 7/1986 Tabler
D285,219 S 8/1986 Stein
4,620,644 A 11/1986 Miller
4,626,166 A 12/1986 Jolly
4,643,310 A 2/1987 Deaton et al.
4,648,199 A 3/1987 Deaton et al.
4,648,200 A 3/1987 Miller et al.
D289,788 S 5/1987 Deaton et al.
D290,778 S 7/1987 Tabler
4,688,675 A 8/1987 Miller et al.
4,701,095 A 10/1987 Berryman et al.
D292,718 S 11/1987 Stein
4,724,976 A 2/1988 Lee
4,756,420 A 7/1988 Deaton
4,760,922 A 8/1988 Northgrave
4,779,751 A 10/1988 Munroe
4,804,082 A 2/1989 Stein
4,809,851 A 3/1989 Oestreich, Jr. et al.
4,832,200 A 5/1989 Deaton et al.
RE32,966 E 6/1989 Miller et al.
4,848,605 A 7/1989 Wise
4,856,681 A 8/1989 Murray
D304,120 S 10/1989 Buchanan et al.
4,890,740 A 1/1990 Tabler
4,917,255 A 4/1990 Foy et al.
4,919,583 A 4/1990 Speakman, Jr.
D307,718 S 5/1990 Tabler
4,936,458 A 6/1990 Tabler et al.
4,946,068 A 8/1990 Erickson et al.
4,948,186 A 8/1990 Pruitt
4,956,821 A 9/1990 Fenelon
RE33,384 E 10/1990 Miller et al.
4,960,207 A 10/1990 Tabler et al.
4,966,310 A 10/1990 Hawkins
4,974,737 A 12/1990 Miller
4,993,883 A 2/1991 Jones
4,995,522 A 2/1991 Barr
5,036,979 A 8/1991 Selz
5,094,356 A 3/1992 Miller
5,096,096 A 3/1992 Calaunan
5,224,635 A 7/1993 Wise
5,232,120 A 8/1993 Dunken et al.
5,269,455 A 12/1993 Grigsby et al.
5,277,014 A 1/1994 White
5,290,139 A 3/1994 Hedrick
5,330,069 A 7/1994 Jamison et al.
5,339,996 A 8/1994 Dubbert et al.
5,373,961 A 12/1994 Harris et al.
5,375,730 A 12/1994 Bahr et al.
5,392,946 A 2/1995 Holbrook et al.
5,402,915 A 4/1995 Hogan
5,413,154 A 5/1995 Hurst, Jr. et al.
5,439,113 A 8/1995 Elvin-Jensen
5,441,321 A 8/1995 Karpisek
5,445,289 A 8/1995 Owen
5,524,750 A 6/1996 Miller
5,564,599 A 10/1996 Barber et al.
5,667,090 A 9/1997 Langham, Jr. et al.
5,673,791 A 10/1997 Jamison
5,715,962 A 2/1998 McDonnell
5,722,550 A 3/1998 Ficker
5,722,552 A 3/1998 Olson
5,788,121 A 8/1998 Sasaki et al.
5,803,296 A 9/1998 Olson
5,829,616 A 11/1998 Daniel et al.
5,836,480 A 11/1998 Epp et al.
5,845,799 A 12/1998 Deaton
5,878,903 A 3/1999 Ung
5,927,356 A 7/1999 Henderson
5,927,558 A 7/1999 Bruce
5,960,974 A 10/1999 Kee et al.
5,971,219 A 10/1999 Karpiesek
5,997,099 A 12/1999 Collins
6,010,022 A 1/2000 Deaton
6,059,372 A 5/2000 McDonald et al.
6,112,929 A 9/2000 Ota
6,205,938 B1 3/2001 Foley et al.
6,247,594 B1 6/2001 Garton
6,253,948 B1 7/2001 Ficker
6,305,764 B1 * 10/2001 Kortman ..... A47B 43/00 108/162
6,328,183 B1 12/2001 Coleman
6,491,343 B2 12/2002 Yamazaki
6,537,015 B2 3/2003 Lim et al.
6,547,127 B2 4/2003 Bradford et al.
6,568,567 B2 5/2003 McKenzie et al.
6,622,849 B1 9/2003 Sperling
6,776,300 B2 8/2004 Walsh et al.
6,783,032 B2 8/2004 Fons
6,902,061 B1 6/2005 Elstone
6,968,946 B2 11/2005 Shert
7,008,163 B2 3/2006 Russell
7,032,765 B2 4/2006 Miller et al.
7,100,791 B2 9/2006 Berger
7,100,896 B1 9/2006 Cox
7,240,681 B2 7/2007 Saik
7,252,309 B2 8/2007 Eng Soon et al.
7,284,579 B2 10/2007 Elgan et al.
7,353,962 B2 4/2008 Parnall et al.

(56) References Cited

U.S. PATENT DOCUMENTS

D575,062 S 8/2008 Wolf
7,431,173 B2 10/2008 Thorpe
7,475,796 B2 1/2009 Garton
7,500,817 B2 3/2009 Furner et al.
7,543,539 B2 6/2009 Miller
7,556,166 B2 7/2009 Parnall et al.
7,762,281 B2 7/2010 Schuld
8,201,520 B2 6/2012 Meritt
8,387,824 B2 3/2013 Wietgrefe
8,434,990 B2 5/2013 Claussen
D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 * 11/2013 Oren ..... B65D 7/00 414/411
8,607,289 B2 12/2013 Brown et al.
8,616,370 B2 12/2013 Allegretti et al.
8,622,251 B2 1/2014 Oren
8,668,430 B2 3/2014 Oren et al.
D703,582 S 4/2014 Oren
8,827,118 B2 9/2014 Oren
8,887,914 B2 11/2014 Allegretti et al.
8,915,691 B2 12/2014 Mintz
RE45,713 E 10/2015 Oren et al.
9,162,603 B2 10/2015 Oren
RE45,788 E 11/2015 Oren et al.
9,248,772 B2 2/2016 Oren
RE45,914 E 3/2016 Oren et al.
9,296,518 B2 3/2016 Oren
9,309,064 B2 4/2016 Sheesley
9,340,353 B2 5/2016 Oren et al.
9,358,916 B2 6/2016 Oren
9,394,102 B2 7/2016 Oren et al.
9,403,626 B2 8/2016 Oren
9,421,899 B2 8/2016 Oren
9,440,785 B2 9/2016 Oren et al.
9,446,801 B1 9/2016 Oren
9,475,661 B2 10/2016 Oren
9,511,929 B2 12/2016 Oren
9,522,816 B2 12/2016 Taylor
9,527,664 B2 12/2016 Oren
9,580,238 B2 2/2017 Friesen et al.
RE46,334 E 3/2017 Oren et al.
D780,883 S 3/2017 Schaffner et al.
D783,771 S 4/2017 Stegemoeller et al.
D783,772 S 4/2017 Stegemoeller, III et al.
9,617,065 B2 4/2017 Allegretti et al.
9,617,066 B2 4/2017 Oren
9,624,030 B2 4/2017 Oren et al.
9,624,036 B2 4/2017 Luharuka et al.
9,643,774 B2 5/2017 Oren
9,650,216 B2 5/2017 Allegretti
9,656,799 B2 5/2017 Oren et al.
9,669,993 B2 6/2017 Oren et al.
9,670,752 B2 6/2017 Glynn et al.
9,676,554 B2 6/2017 Glynn et al.
9,682,815 B2 6/2017 Oren
9,694,970 B2 7/2017 Oren et al.
9,701,463 B2 7/2017 Oren et al.
9,718,609 B2 8/2017 Oren et al.
9,718,610 B2 8/2017 Oren
9,725,233 B2 8/2017 Oren et al.
9,725,234 B2 8/2017 Oren et al.
9,738,439 B2 8/2017 Oren et al.
RE46,531 E 9/2017 Oren et al.
9,758,081 B2 9/2017 Oren
9,758,993 B1 9/2017 Allegretti et al.
9,771,224 B2 9/2017 Oren et al.
9,783,338 B1 10/2017 Allegretti et al.
9,796,504 B1 10/2017 Allegretti et al.
9,828,135 B2 11/2017 Allegretti et al.
2001/0022308 A1 9/2001 Epp et al.
2002/0023994 A1 2/2002 De Shann
2002/0070215 A1 6/2002 Walsh et al.
2003/0019875 A1 1/2003 Woram
2003/0024971 A1 2/2003 Jones et al.
2004/0074922 A1 4/2004 Bothor et al.
2004/0118725 A1 6/2004 Shuert
2004/0222222 A1 11/2004 Parnall et al.
2004/0232146 A1 11/2004 Kessler et al.
2006/0266747 A1 11/2006 Stolzman
2007/0210080 A1 9/2007 Hooper
2007/0241104 A1 10/2007 Huizingh et al.
2007/0278223 A1 12/2007 Ficker
2007/0290471 A1 12/2007 Sexton
2008/0029546 A1 2/2008 Schuld
2008/0029553 A1 2/2008 Culleton
2008/0169285 A1 7/2008 Marazita et al.
2008/0179054 A1 7/2008 McGough et al.
2008/0179322 A1 7/2008 Parnall et al.
2008/0179324 A1 7/2008 McGough et al.
2008/0226434 A1 9/2008 Smith et al.
2009/0000527 A1 1/2009 Ficker
2009/0078410 A1 3/2009 Krenek et al.
2009/0129903 A1 5/2009 Lyons, III
2009/0294486 A1 * 12/2009 McKnight ..... B65D 88/12 222/482
2009/0314791 A1 12/2009 Hartley et al.
2011/0011893 A1 1/2011 Cerny
2011/0168593 A1 7/2011 Neufeld et al.
2012/0017812 A1 1/2012 Renyer et al.
2012/0102848 A1 5/2012 Atiyeh et al.
2012/0152798 A1 * 6/2012 Allegretti ..... B65D 77/061 206/599
2013/0206415 A1 8/2013 Sheesley
2013/0209204 A1 8/2013 Sheesley
2014/0023463 A1 1/2014 Oren
2014/0083554 A1 3/2014 Harris
2014/0305769 A1 10/2014 Eiden, III et al.
2015/0003955 A1 1/2015 Oren et al.
2015/0284194 A1 10/2015 Oren et al.
2015/0375930 A1 12/2015 Oren et al.
2016/0031658 A1 2/2016 Oren et al.
2016/0039433 A1 2/2016 Oren et al.
2016/0046438 A1 2/2016 Oren et al.
2016/0046454 A1 2/2016 Oren et al.
2016/0068342 A1 3/2016 Oren et al.
2016/0130095 A1 5/2016 Oren et al.
2016/0244279 A1 8/2016 Oren et al.
2016/0264292 A1 * 9/2016 Schoening ..... B65D 19/18
2016/0264352 A1 9/2016 Oren
2016/0332809 A1 11/2016 Harris
2016/0332811 A1 11/2016 Harris
2017/0129696 A1 5/2017 Oren
2017/0144834 A1 5/2017 Oren et al.
2017/0190523 A1 7/2017 Oren et al.
2017/0203915 A1 7/2017 Oren
2017/0225883 A1 8/2017 Oren
2017/0240350 A1 8/2017 Oren et al.
2017/0240361 A1 8/2017 Glynn et al.
2017/0240363 A1 8/2017 Oren
2017/0267151 A1 9/2017 Oren
2017/0283165 A1 10/2017 Oren et al.
2018/0002066 A1 * 1/2018 Allegretti ..... B65D 88/022
2018/0002120 A1 1/2018 Allegretti et al.
2020/0115100 A1 * 4/2020 Allegretti ..... B65D 90/62

FOREIGN PATENT DOCUMENTS

EP 1598288 11/2005
EP 2937826 10/2015
FR 2640598 6/1990
GB 2066220 7/1981
GB 2204847 11/1988
JP 2007084151 4/2007
JP 2008239019 10/2008
NL 8105283 6/1983
WO WO01076960 10/2001
WO WO03024815 3/2003
WO WO2007/010262 1/2007

(56) References Cited

FOREIGN PATENT DOCUMENTS

| | | |
|---|---|---|
| WO | WO2007081556 | 7/2007 |
| WO | WO2008012513 | 1/2008 |
| WO | WO2009087338 | 7/2009 |
| WO | WO2013095871 | 6/2013 |
| WO | WO2013142421 | 9/2013 |
| WO | WO2014018129 | 1/2014 |
| WO | WO2014018236 | 1/2014 |
| WO | WO2015119799 | 8/2015 |
| WO | WO2015191150 | 12/2015 |
| WO | WO2015192061 | 12/2015 |
| WO | WO2016044012 | 3/2016 |
| WO | WO2016160067 | 10/2016 |
| WO | WO2016178691 | 11/2016 |
| WO | WO2016178692 | 11/2016 |
| WO | WO2016178694 | 11/2016 |
| WO | WO2016178695 | 11/2016 |
| WO | WO2017014768 | 1/2017 |
| WO | WO2017014771 | 1/2017 |
| WO | WO2017014774 | 1/2017 |
| WO | WO2017027034 | 2/2017 |
| WO | WO2017095423 | 6/2017 |

* cited by examiner

BULK MATERIAL SHIPPING CONTAINER

BACKGROUND

Various bulk material shipping containers are known. Various known material bulk shipping containers are used to transport a wide range of products, parts, components, items, and other materials such as, but not limited to, seeds, shavings, fasteners, dry bulk, plastic resins, and granular materials (such as but not limited to cement or sand). These are sometimes called loose materials.

There is a continuing need for better bulk material shipping containers for loose materials that are stronger than various known bulk material shipping containers, more durable than various known bulk material shipping containers, lighter than various known bulk material shipping containers (having similar weight capacities), easier to repair than various known bulk material shipping containers, easier to construct and reconstruct than various known bulk material shipping containers, configured to better prevent contamination of the loose materials, configured to hold greater volumes of loose materials than various known bulk material shipping containers, configured to hold greater weights of loose materials than various known bulk material shipping containers, and configured to have a better weight to holding cargo capacity than various known bulk material shipping containers.

SUMMARY

Various embodiments of the present disclosure provide a bulk material shipping container that provides various advantages over previously known commercially available bulk shipping material containers.

Various embodiments of the bulk material shipping container of the present disclosure each include: (1) a pallet; (2) a compartment connected to and supported by the pallet; (3) a material unloading assembly positioned at and/or under a central bottom portion of the compartment and connected to and supported by the pallet; and (4) a material loading assembly connected to and supported by the top wall assembly of the compartment.

Various embodiments of the bulk material shipping container of the present disclosure include an improved material unloading assembly positioned at a bottom portion of the compartment and configured to facilitate the release or unloading of loose materials from the compartment. The improved material unloading assembly includes a gate assembly and a gate locking assembly that improve the functionality of the material unloading assembly, the compartment, and the container.

Various embodiments of the bulk material shipping container of the present disclosure include an improved compartment configured to hold the loose materials, and specifically include a top wall assembly, a top wall support assembly, and top corner assemblies that improve the functionality of the compartment and the container.

For purposes of brevity, the bulk material shipping container of the present disclosure may sometimes be referred to herein as a material shipping container, a shipping container, or simply as a container. For purposes of brevity, a person who uses the container may sometimes be referred to herein as a "user" or an "operator", a person who loads loose materials into a container may sometimes be referred to herein as a "loader," and a person who removes the loose materials from a container may sometimes be referred to herein as an "unloader."

Additional features and advantages of the present invention are described in, and will be apparent from, the following Detailed Description of Exemplary Embodiments and the figures.

DETAILED DESCRIPTION OF EXEMPLARY EMBODIMENTS

Figure 1:
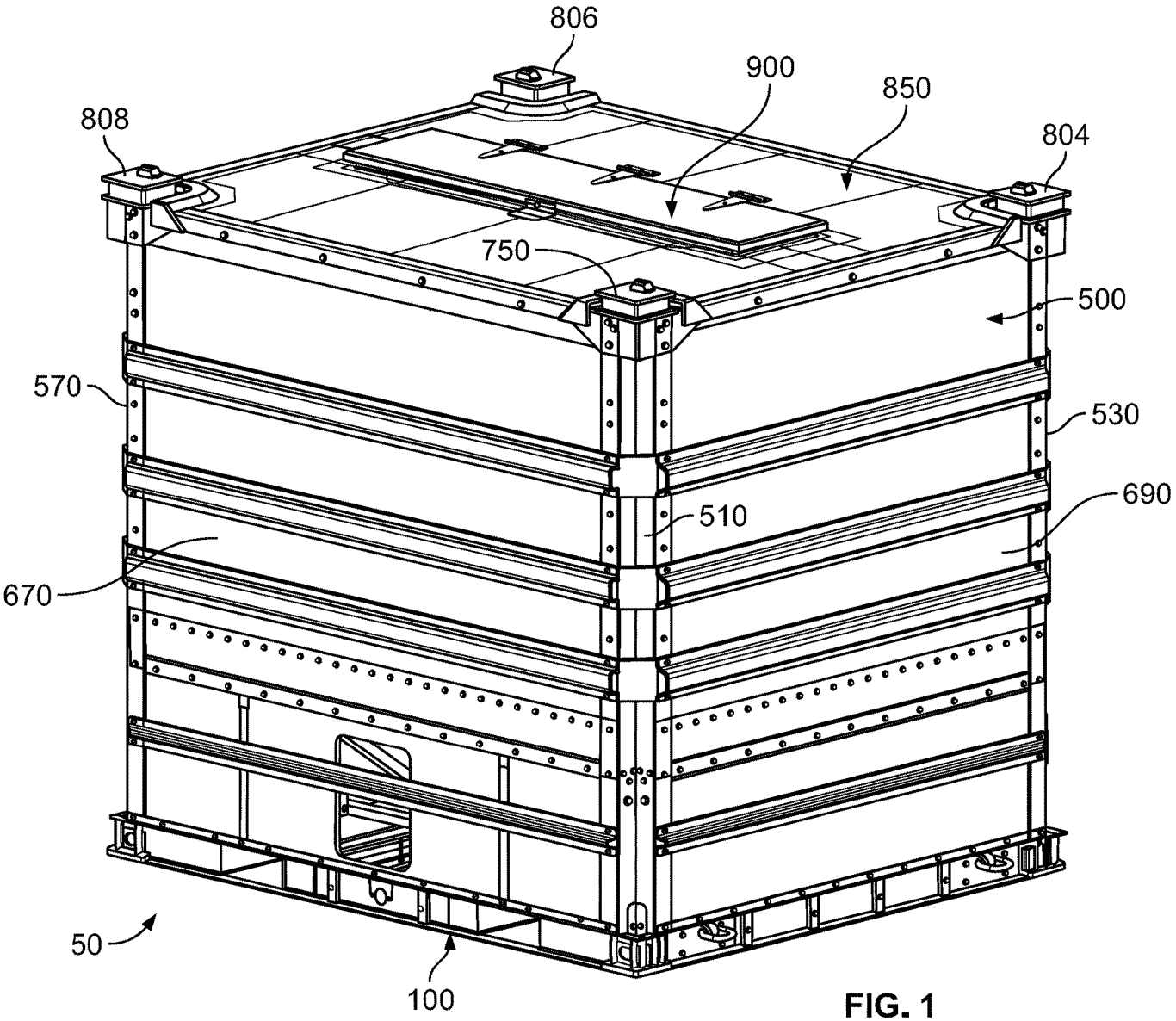
FIG. 1 is a top front perspective view of the bulk material shipping container of one example embodiment of the present disclosure.
Figure 2:
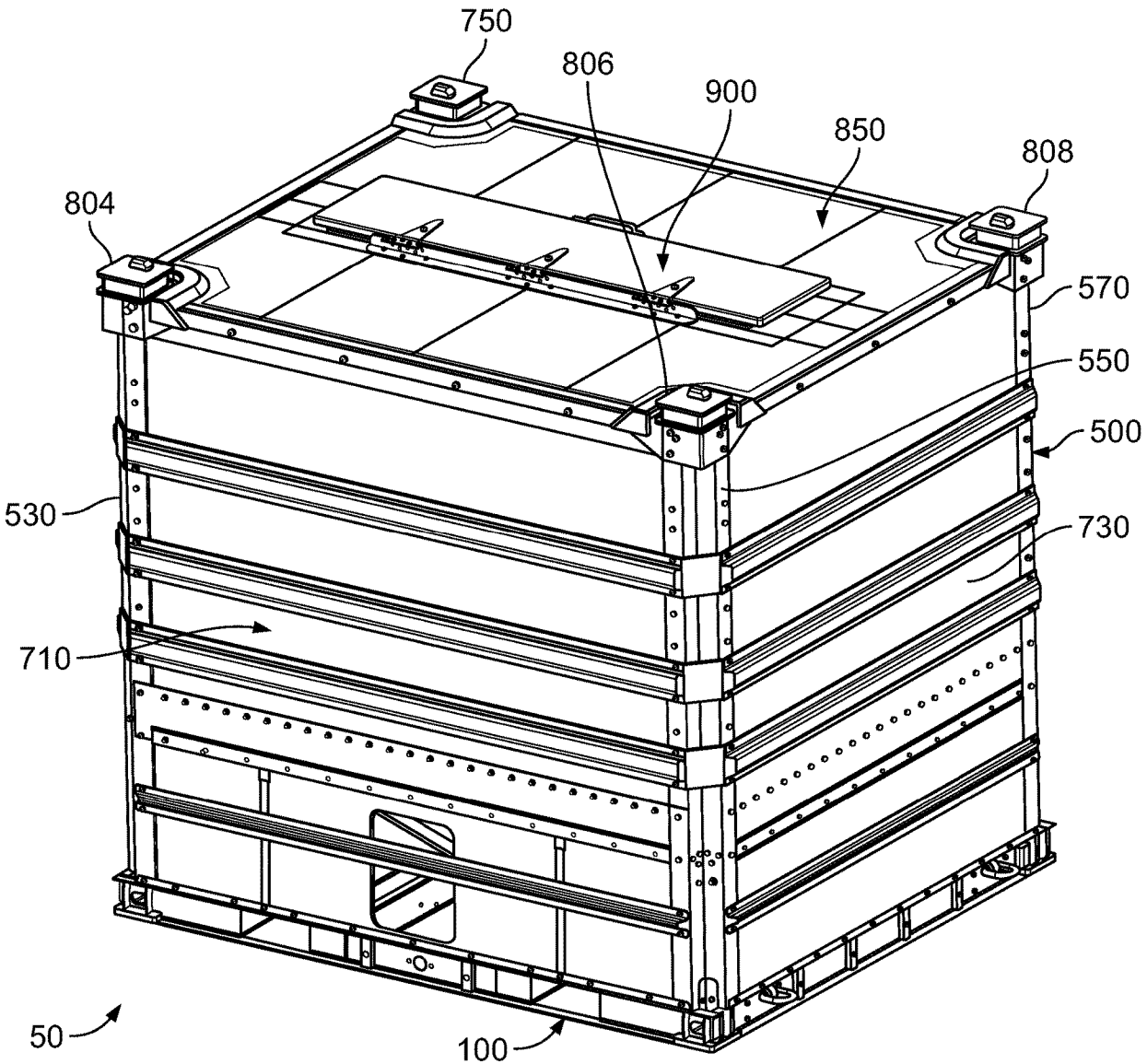
FIG. 2 is a top rear perspective view of the bulk material shipping container of FIG. 1.
Figure 3:
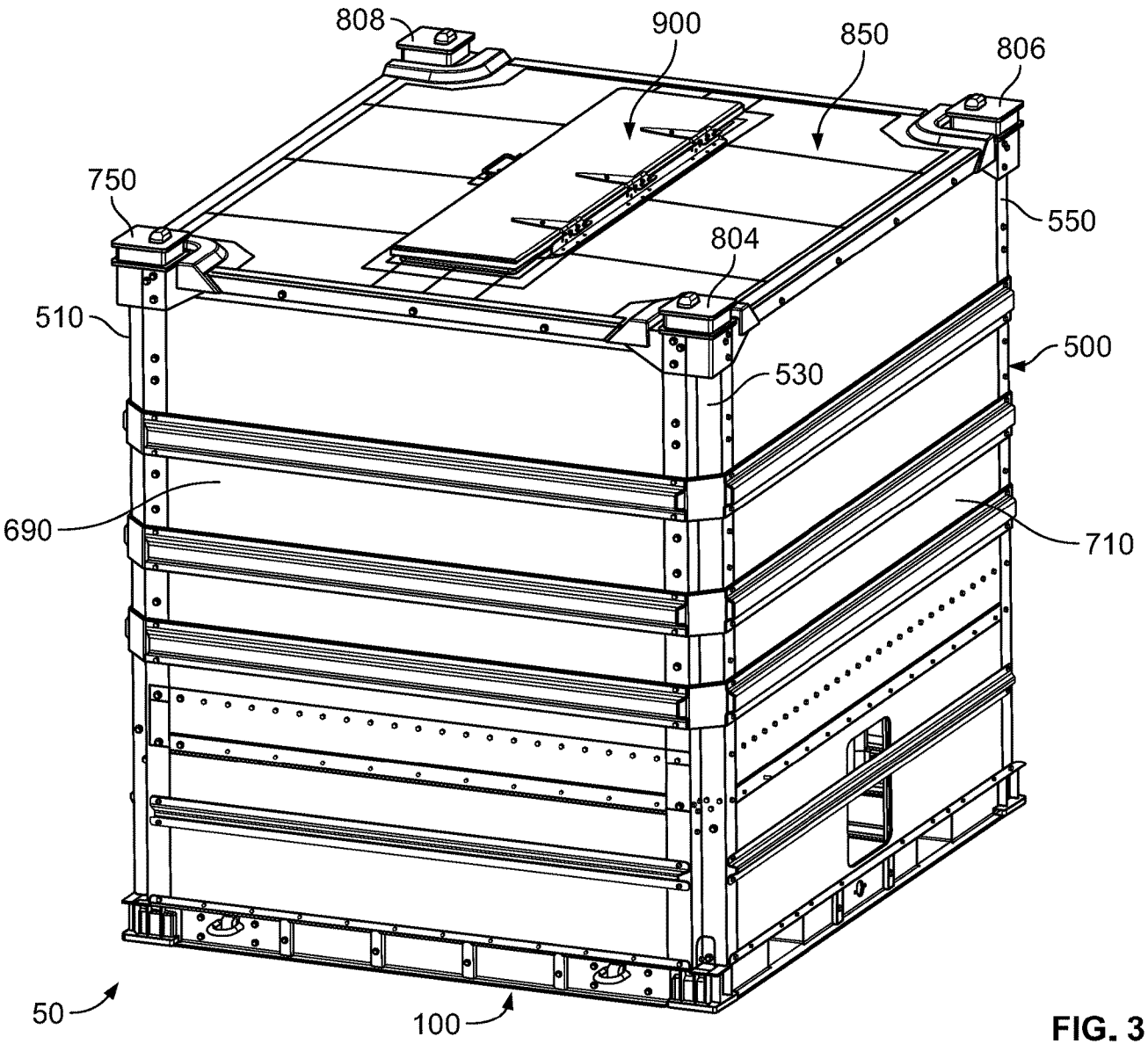
FIG. 3 is a top left side perspective view of the bulk material shipping container of FIG. 1.
Figure 4:
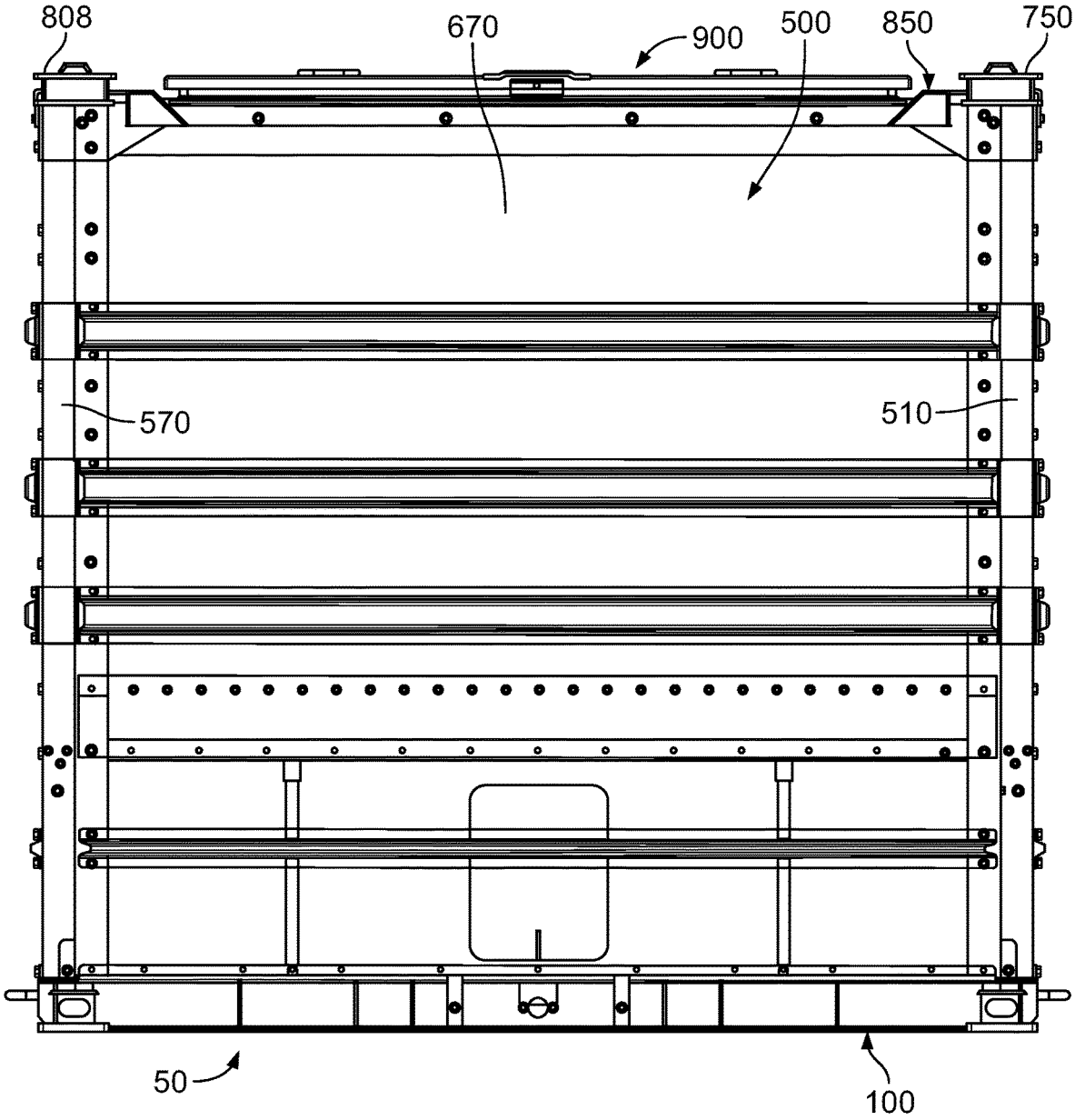
FIG. 4 is a front view of the bulk material shipping container of FIG. 1.
Figure 5:
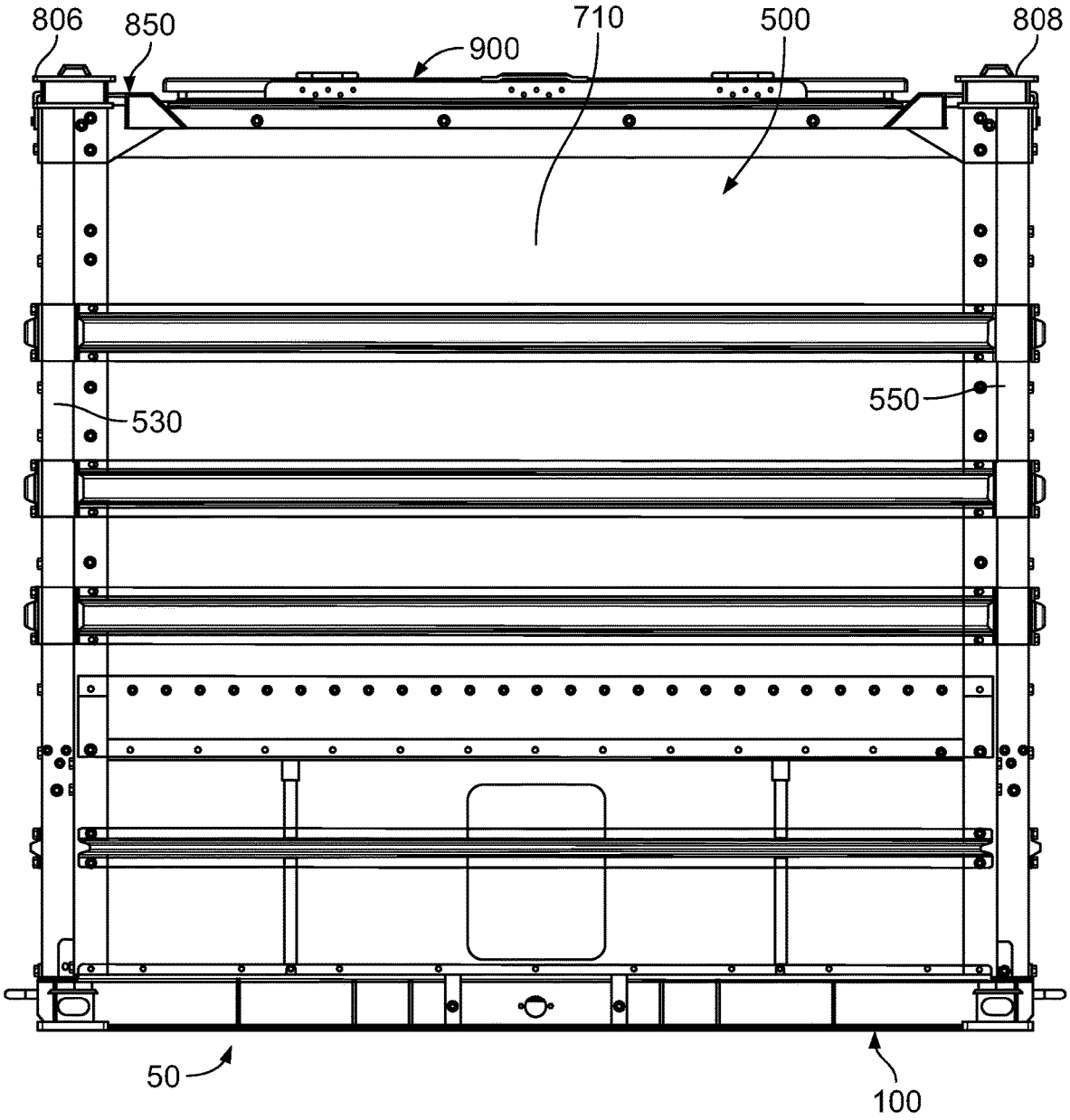
FIG. 5 is a rear view of the bulk material shipping container of FIG. 1.
Figure 6:
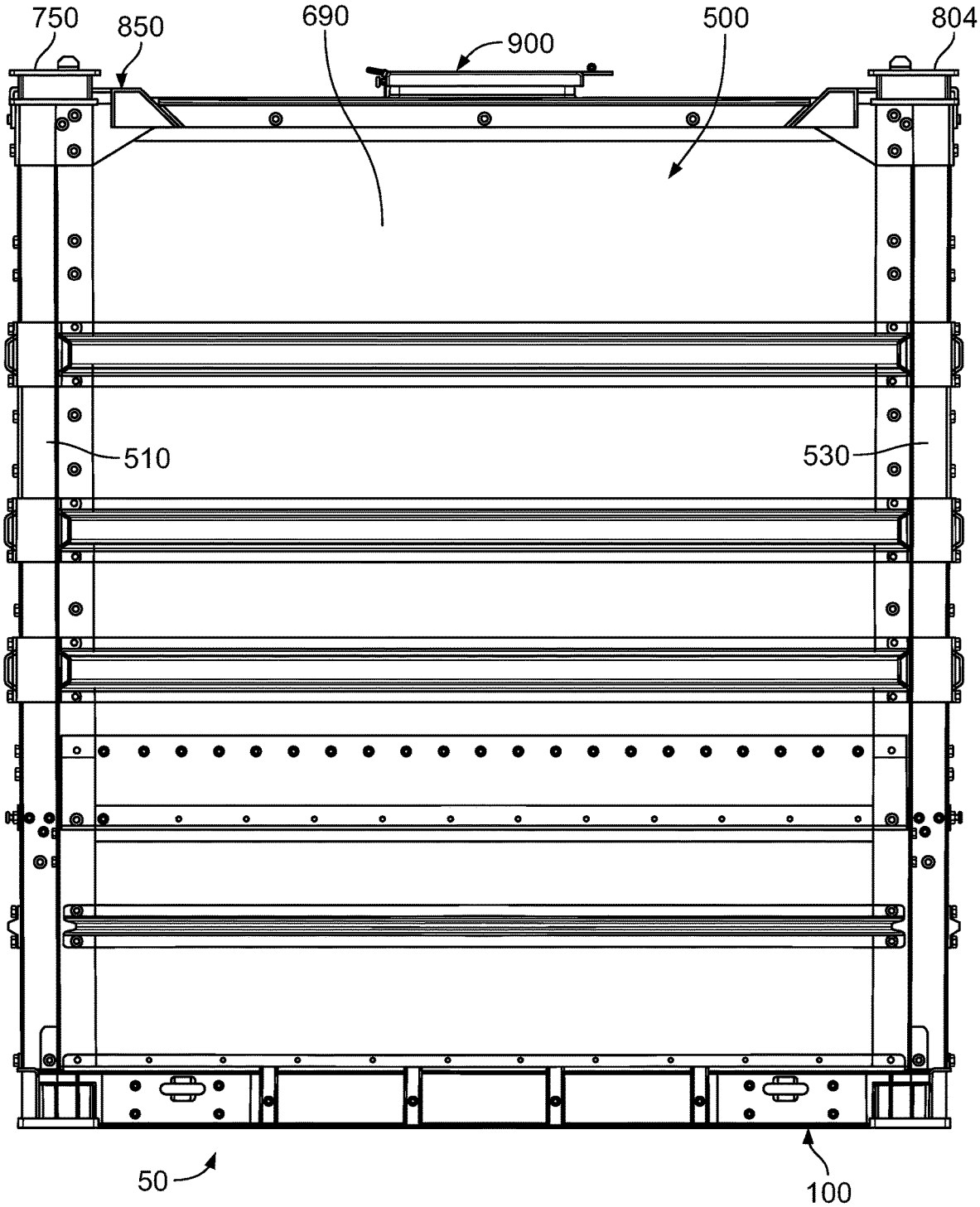
FIG. 6 is a right side view of the bulk material shipping container of FIG. 1.
Figure 7:
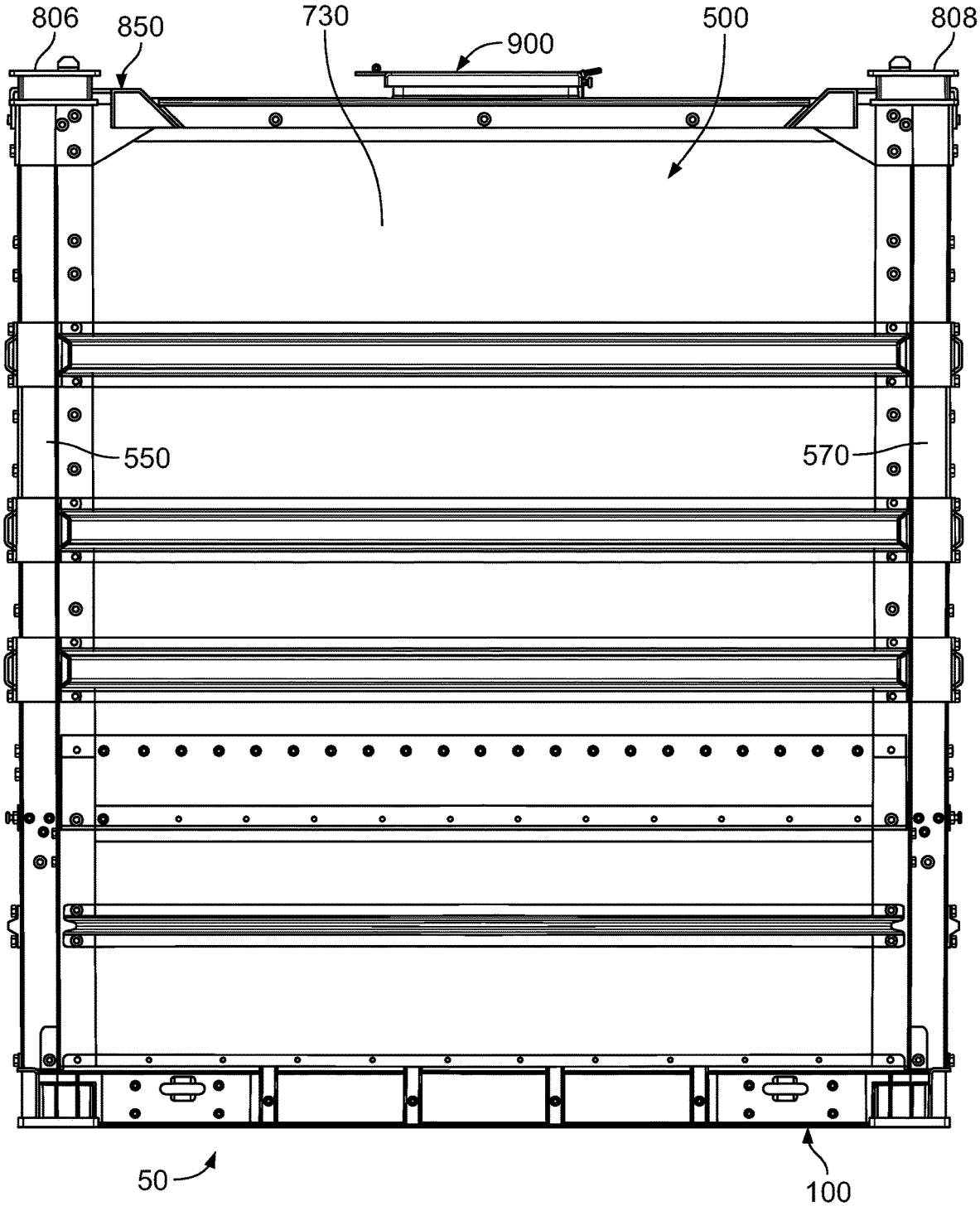
FIG. 7 is a left side view of the bulk material shipping container of FIG. 1.
Figure 8:
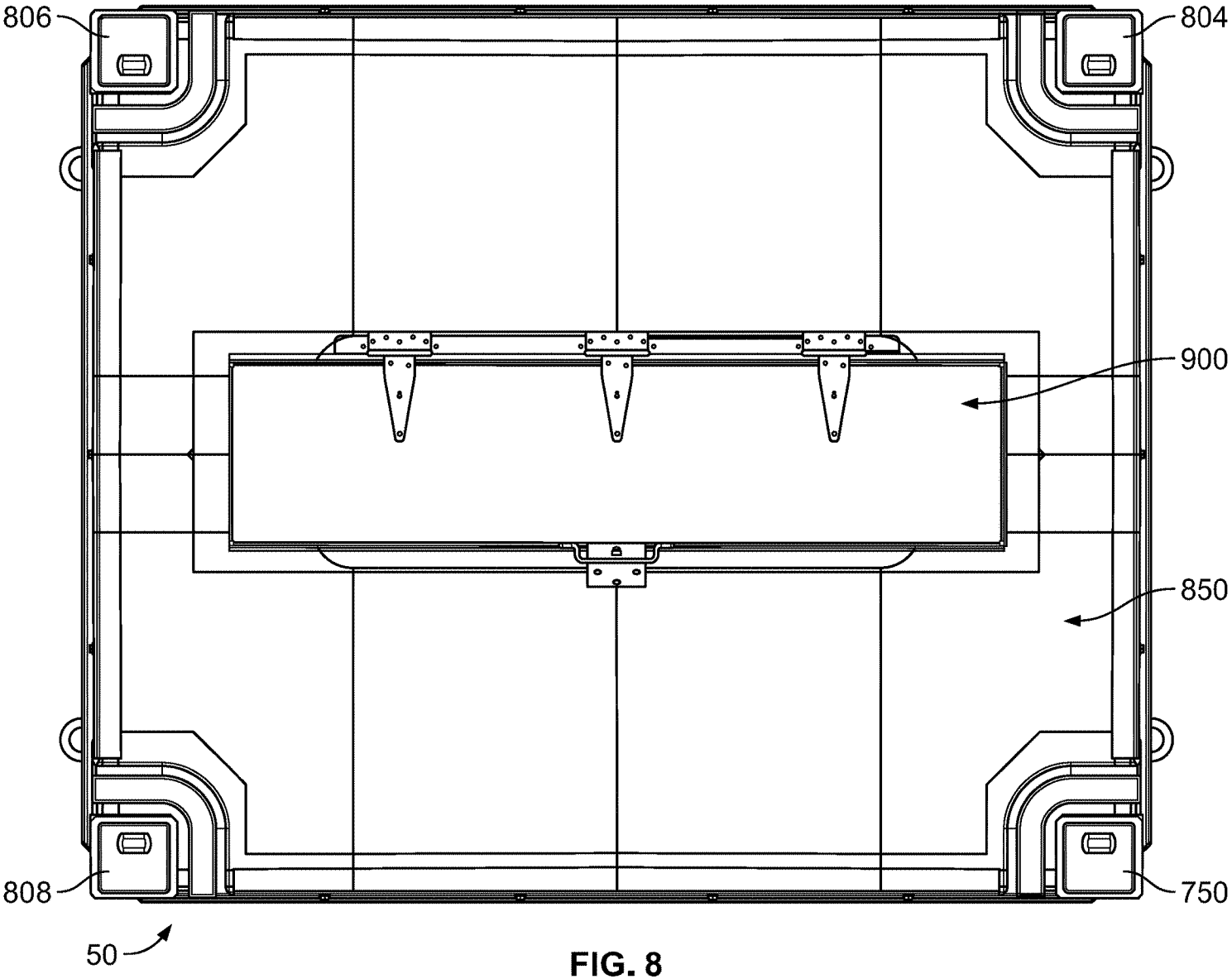
FIG. 8 is a top view of the bulk material shipping container of FIG. 1.
Figure 9:
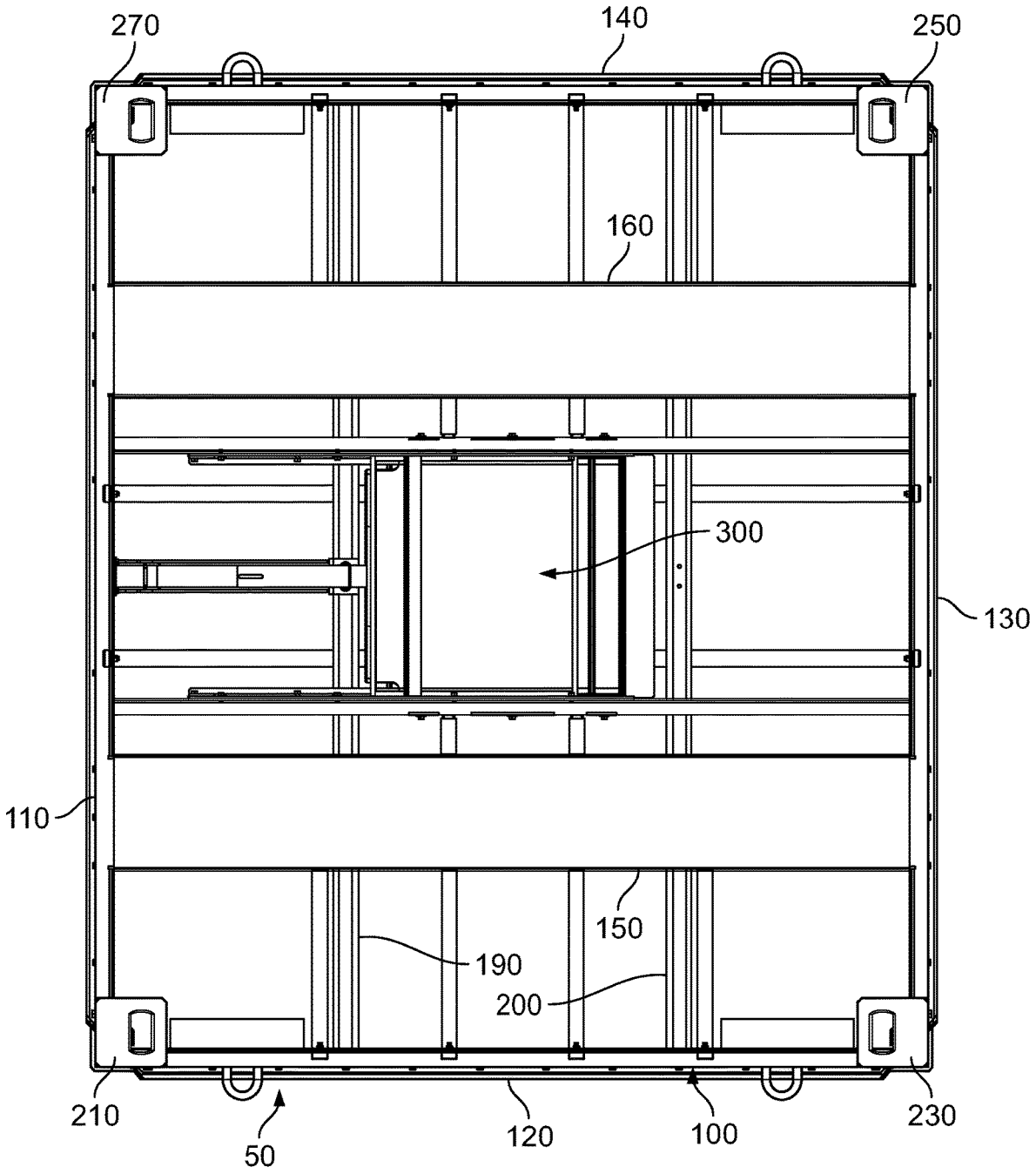
FIG. 9 is a bottom view of the bulk material shipping container of FIG. 1.
Figure 10:
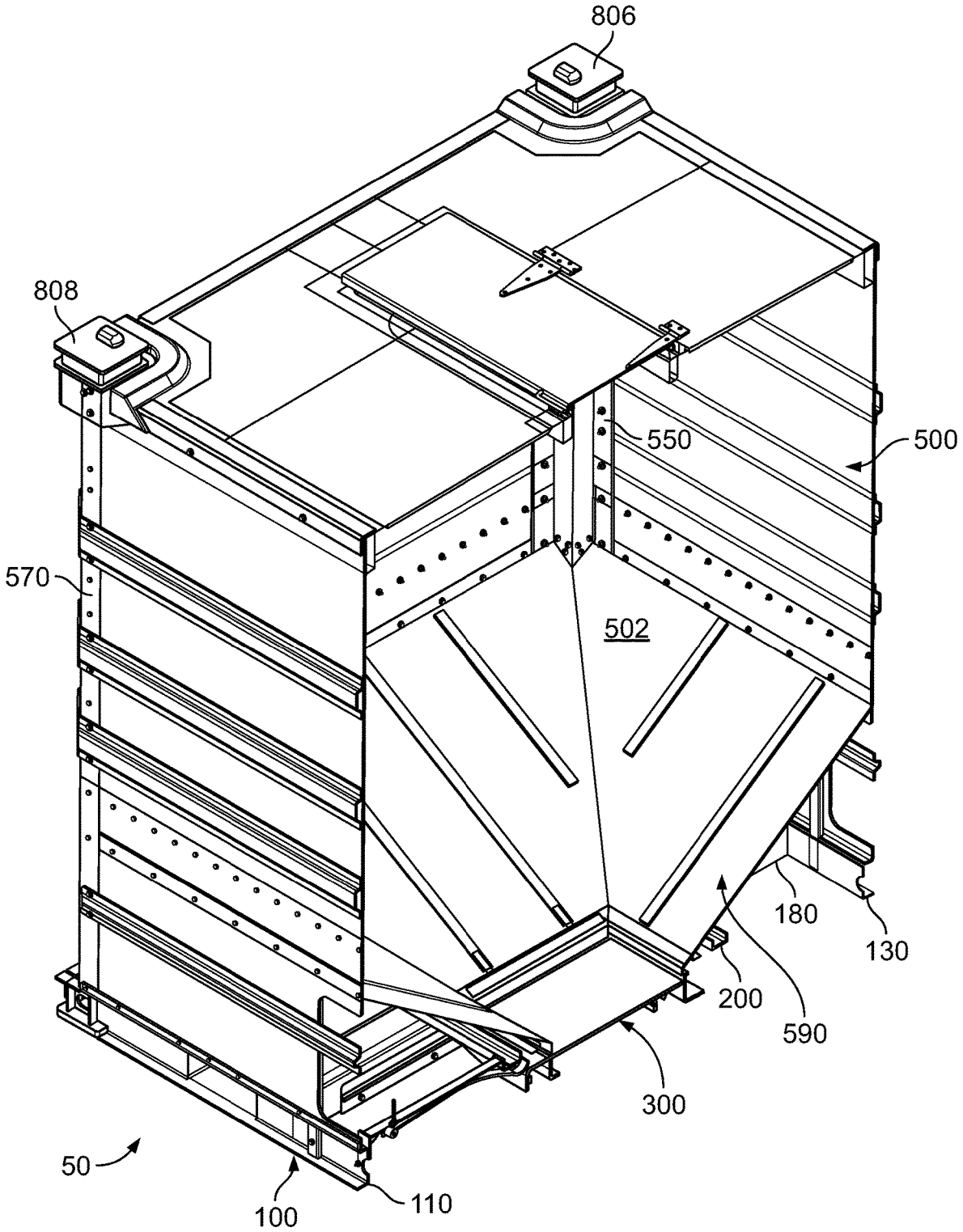
FIG. 10 is a first vertical cross-sectional top front perspective view of the bulk material shipping container of FIG. 1, showing the hatch assembly of the material loading assembly in the closed position, and showing the gate assembly of the material unloading assembly in the closed position.
Figure 11:
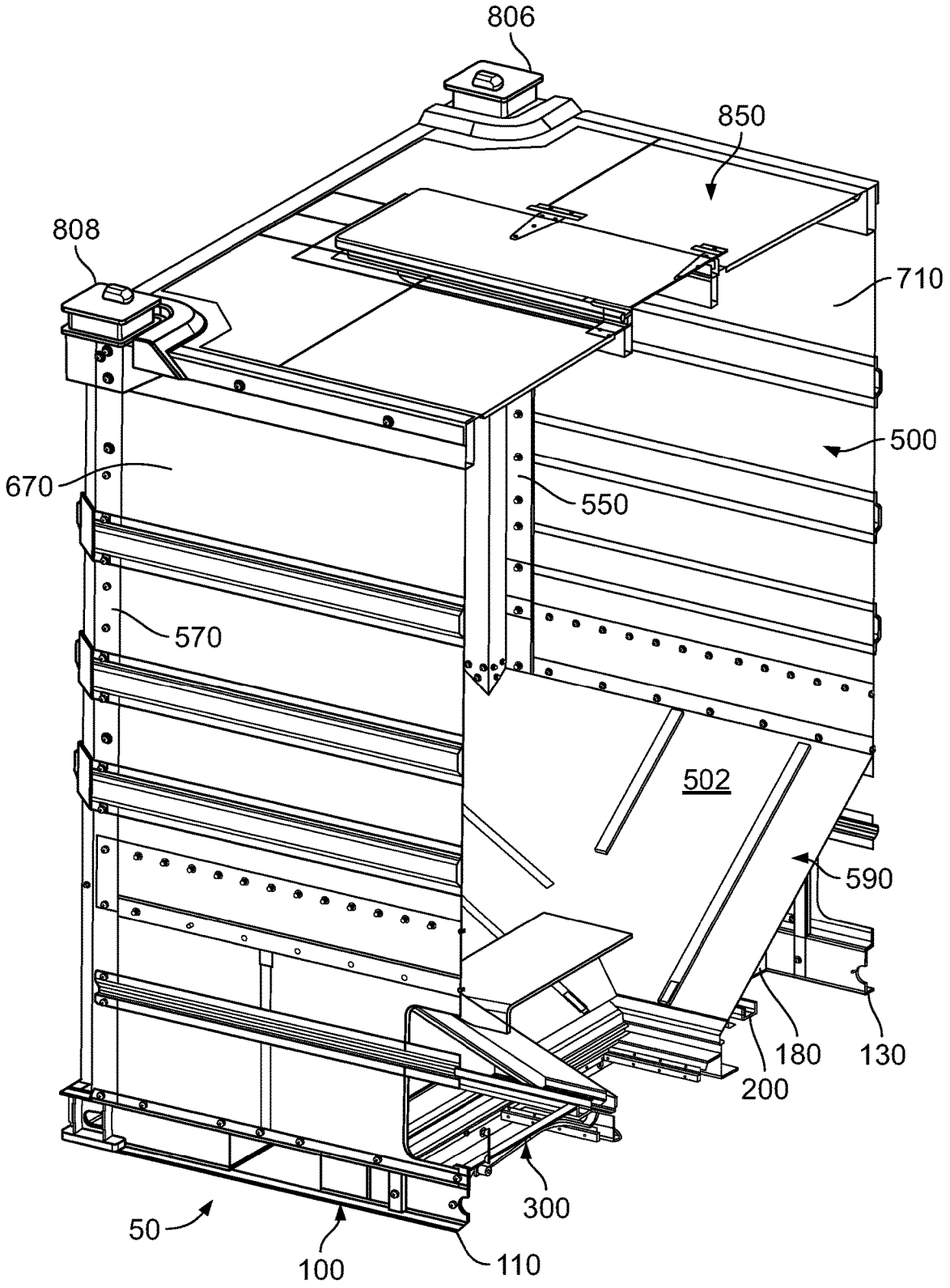
FIG. 11 is a vertical cross-sectional top front perspective view of the bulk material shipping container of FIG. 1, showing the hatch assembly of the material loading assembly in the closed position, and with the gate assembly of the material unloading assembly partially removed.
Figure 12:
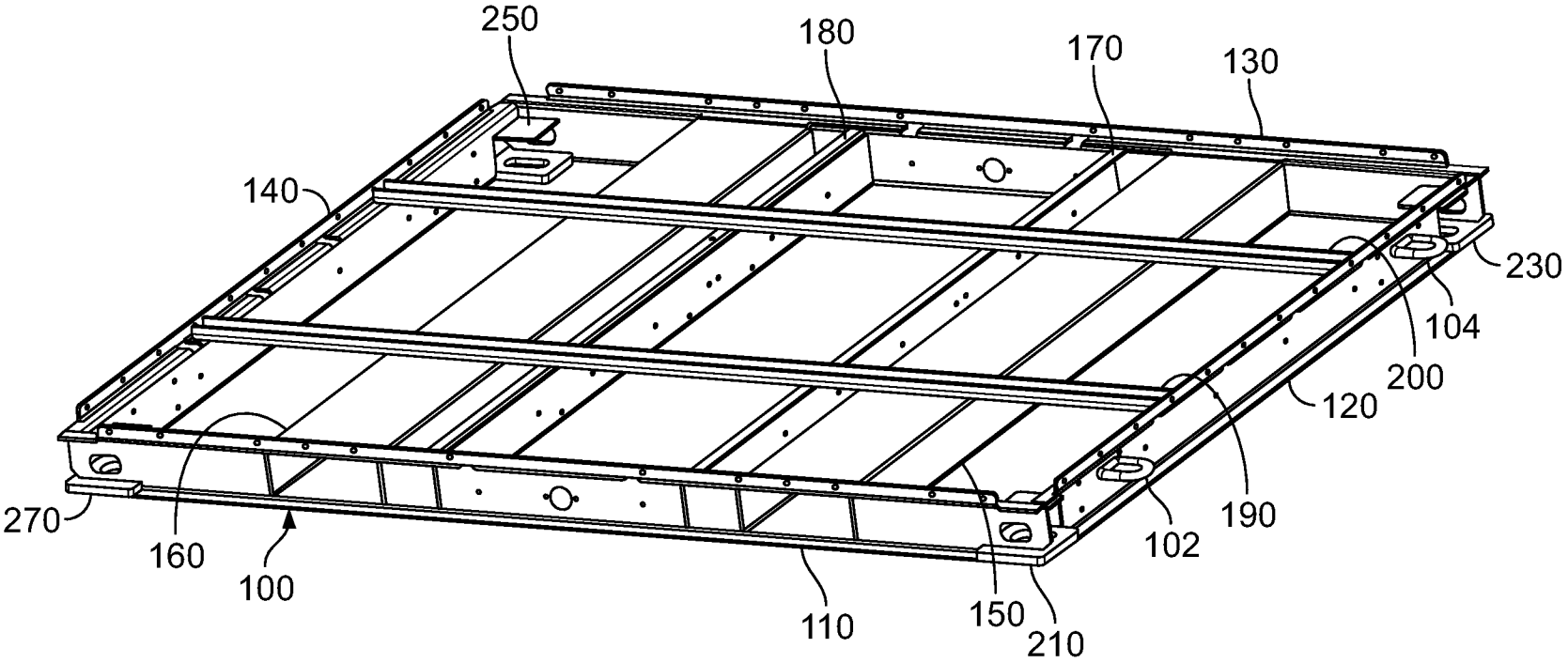
FIG. 12 is an enlarged top perspective view of the pallet of the bulk material shipping container of FIG. 1, shown removed from the container and shown without the material unloading assembly.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Referring now to the drawings, FIGS. 1 to 48 illustrate one example embodiment of the bulk material shipping container of the present disclosure. This example bulk material shipping container, which is generally indicated by numeral 50, is configured to receive, hold, and release loose materials of substantial weight and volume.

Generally, in this illustrated example embodiment, the shipping container 50 includes: (a) a pallet 100 (shown in FIGS. 1 to 7 and 9 to 20); (b) a compartment 500 (shown in FIGS. 1 to 11) connected to and supported by the pallet 100; (c) a material unloading assembly 300 (shown in FIGS. 9, 10, 11, and 12 to 33) positioned at and under a central bottom portion of the compartment 500 and connected to and supported by the pallet 100; and (d) a material loading assembly 900 (shown in FIGS. 1 to 8, 10, 11, and 34) connected to and supported by the top wall assembly 850 of the compartment 500. The pallet 100 is configured to facilitate movement of the container 50 and to facilitate stacking of multiple containers 50. The material unloading assembly 300 is connected to the pallet 100 and configured to facilitate the release or unloading of loose materials from the compartment 500 of the container 50. The compartment 500 is connected to and supported by the pallet 100 and configured to receive, hold, and release loose materials. The material loading assembly 900 is connected to and supported by the top wall assembly 850 of the compartment 500 and configured to facilitate the loading of loose materials into the compartment 500 and to prevent contaminants from entering the compartment 500. It should be appreciated that the container 50 generally includes a front side (not labeled), a rear or back side (not labeled) opposite the front side, a right side (not labeled), a left side (not labeled) opposite the right side, a bottom side (not labeled), and a top side (not labeled).

As further explained below, the bulk material shipping container of the present disclosure provides an improved bulk material shipping container for loose materials that is stronger than various known bulk material shipping containers, more durable than various known bulk material shipping containers, lighter than various known bulk material shipping containers having similar weight capacities, easier to repair than various known bulk material shipping containers, easier to construct and reconstruct than various known bulk material shipping containers, configured to better prevent contamination of the loose materials in the compartment, configured to hold greater volumes of loose materials than various known bulk material shipping containers, configured to hold greater weights of loose materials than various known bulk material shipping containers, and configured to have a better weight to holding cargo capacity than various known bulk material shipping containers.

The bulk material shipping container of the present disclosure includes various improvements to the bulk material shipping containers described in U.S. Pat. No. 8,887,914 and U.S. Published Patent Application No. 2018/0002066 which are incorporated herein by reference.

More particularly, the bulk material shipping container of the present disclosure includes a new material unloading assembly, a new top wall assembly, a new top wall support assembly, and new top corner assemblies which are each described in detail herein. The pallet 100 and various parts of the compartment 500 are only very generally described herein for brevity; and it should be appreciated that the descriptions of the pallet 100 and the compartment 500 set forth in U.S. Published Patent Application No. 2018/0002066 are incorporated herein.

The Illustrated Example Pallet

The pallet 100 of this illustrated example embodiment of the shipping container 50 of the present disclosure is illustrated in FIGS. 1 to 10. The pallet 100 is specifically configured to be lifted by a lifting vehicle such as a forklift truck to lift, move, and position or place the container 50 when the container 50 is: (a) manufactured; (b) transported to a material loading facility; (c) at a material loading facility; (d) moved and positioned in or on a transport vehicle at the material loading facility after loading loose materials in the container 50; (e) removed from a transport vehicle at a material unloading facility or storage facility; (f) at a container unloading facility or site or at a storage facility; (g) moved and positioned in or on a material unloading device for storage or emptying or another container at the material unloading facility for storage or emptying; (h) moved into another position or another location for customer storage, use, or emptying; and/or (i) moved and positioned in or on a transport vehicle at the material unloading facility after unloading the loose materials from the container 50. The container 50 and specifically the pallet 100 of the container 50 is configured to account for the use of forklift trucks that can engage the pallet 100 to: (a) lift the container 50; (b) move the container 50; (c) stack the container 50 on top of another container 50 (or other device) for storage or transfer of the bulk materials in the top container to the bottom container (or other device); (d) un-stack a stacked container 50 from another container 50 or other device; and (e) place the container 50 on a material unloading device (such as one of the material unloading devices described in U.S. Pat. No. 9,650,216 or U.S. Published Patent Application No. 2018/0002120).

As best shown in FIGS. 12 to 20, the pallet 100 of this illustrated example embodiment of the container 50 is made of a strong metal (such as steel) and includes: (1) a front support 110; (2) a first or right side support 120; (3) a rear support 130; (4) a second or left side support 140; (5) a first fork lift tine receiving tube 150; (6) a second fork lift tine receiving tube 160; (7) a first material unloading assembly support 170; (8) a second material unloading assembly support 180; (9) a first stabilizer or anti-racking brace 190; (10) a second stabilizer or anti-racking brace 200; (11) a first bottom corner assembly 210; (12) a second bottom corner assembly 230; (13) a third bottom corner assembly 250; (14) a fourth bottom corner assembly 270; and (15) four D-rings 102, 104, 106, and 108. It should be appreciated that the pallet of the present disclosure can be alternatively configured and made of alternative materials.

The Illustrated Example Material Unloading Assembly

The material unloading assembly 300 of this illustrated example embodiment of the shipping container 50 of the present disclosure is generally illustrated in FIGS. 9 to 11 and 13 to 33. The material unloading assembly 300 generally includes: (1) a gate support assembly 310; (2) a gate assembly 350; and (3) a gate locking assembly 400. In various embodiments, the material unloading assembly and/or the compartment may include one or more material directors.

The gate assembly 350 is specifically configured to be in a closed and locked position (as shown in FIGS. 9, 10, 13, 15, 17, 19, 21, 22, 24, and 25) to prevent the release of loose materials held in the compartment 500, and to move to a plurality of different partially open positions and to a fully opened position (shown in FIGS. 11, 14, 16, 18, and 20) to enable the release of loose materials held in the compartment 500.

In this illustrated embodiment, the configuration, arrangement, and attachment of the gate support assembly 310, the gate assembly 350, the gate locking assembly 400, and the material directors (not labeled) of the material unloading assembly 300 provide suitable material leakage prevention.

In this illustrated embodiment, the gate support assembly 310, the gate assembly 350, the gate locking assembly 400, and the material directors of the material unloading assembly 300 (except as set forth below) are all (or mostly) formed from a strong metal (such as steel) to provide suitable structural strength and rigidity. However, it should be appreciated that in alternative embodiments, the material unloading assembly 300 or one or more parts thereof can be made from other suitably strong materials (such as wood, plastic, or composite or fiber glass materials).

In this illustrated embodiment, the gate assembly 350 includes a gate 351 having a substantially flat generally rectangular closure member 352 and a downwardly extending front end member 355 integrally connected to a front end of the closure member 352. The gate 351 is movable and specifically slidable from a closed and locked position (as shown in FIGS. 9, 10, 13, 14, 15, 17, 19, 21, 22, 24, and 25), to a plurality of different partially opened positions (not shown), and then to a fully opened position (as shown in FIGS. 11, 14, 16, 18, and 20). It should be appreciated that placing the gate assembly 350 and particularly the gate 351 in a partially open position (and thus a partially closed position) enables the user to control the rate of emptying the loose materials from the container 50.

In this illustrated embodiment, the gate 351 is made from steel to: (a) provide structural strength and rigidity; (b) facilitate ease of cleaning; (c) facilitate ease of repair; and (d) prevent contamination. However, it should be appreciated that in alternative embodiments, the gate can be made from other suitable materials.

Figure 23:
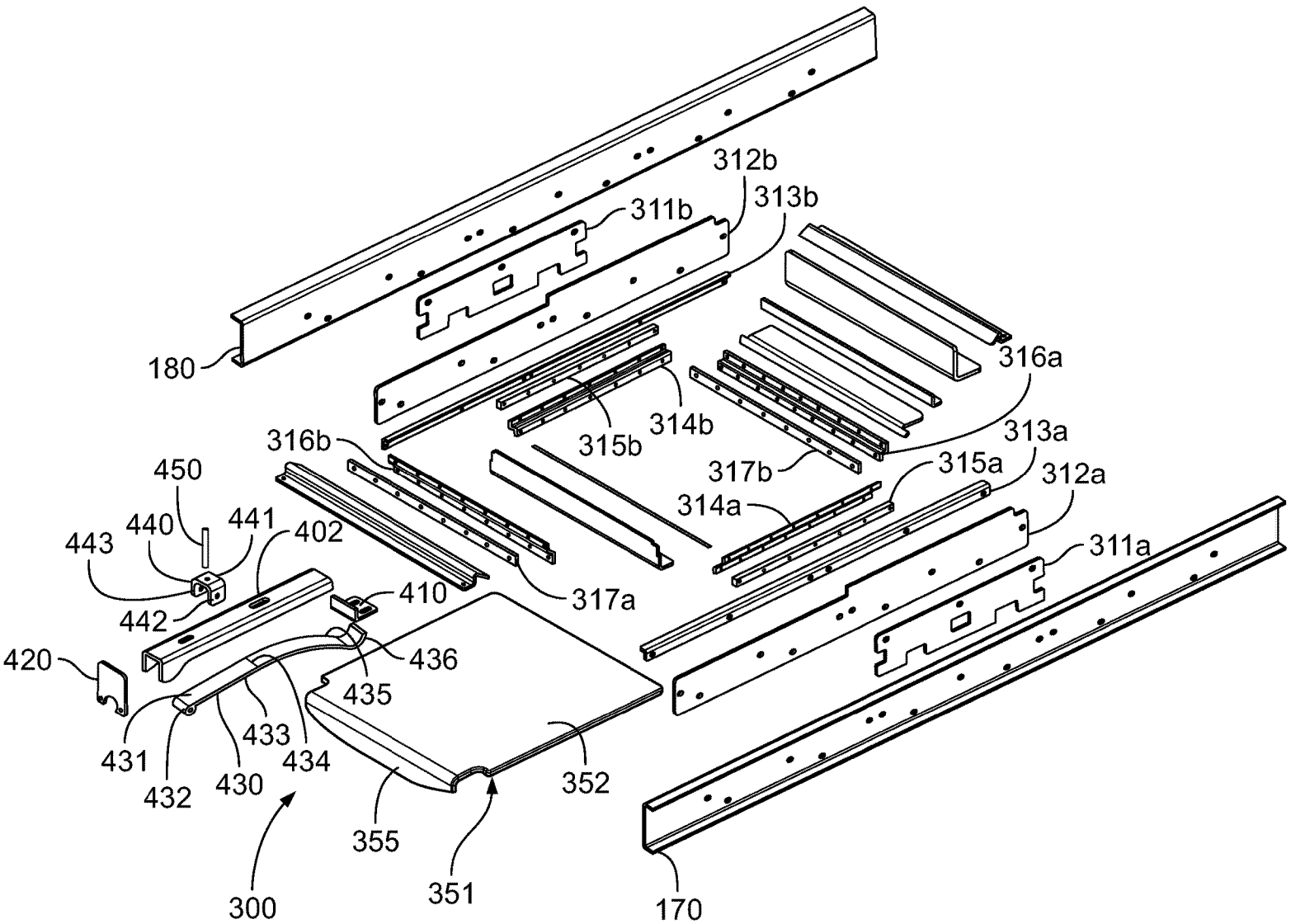
FIG. 23 is an enlarged exploded top perspective view of the material unloading assembly of the bulk material shipping container of FIG. 1 and part of the pallet of the bulk material shipping container of FIG. 1.
Figure 24:
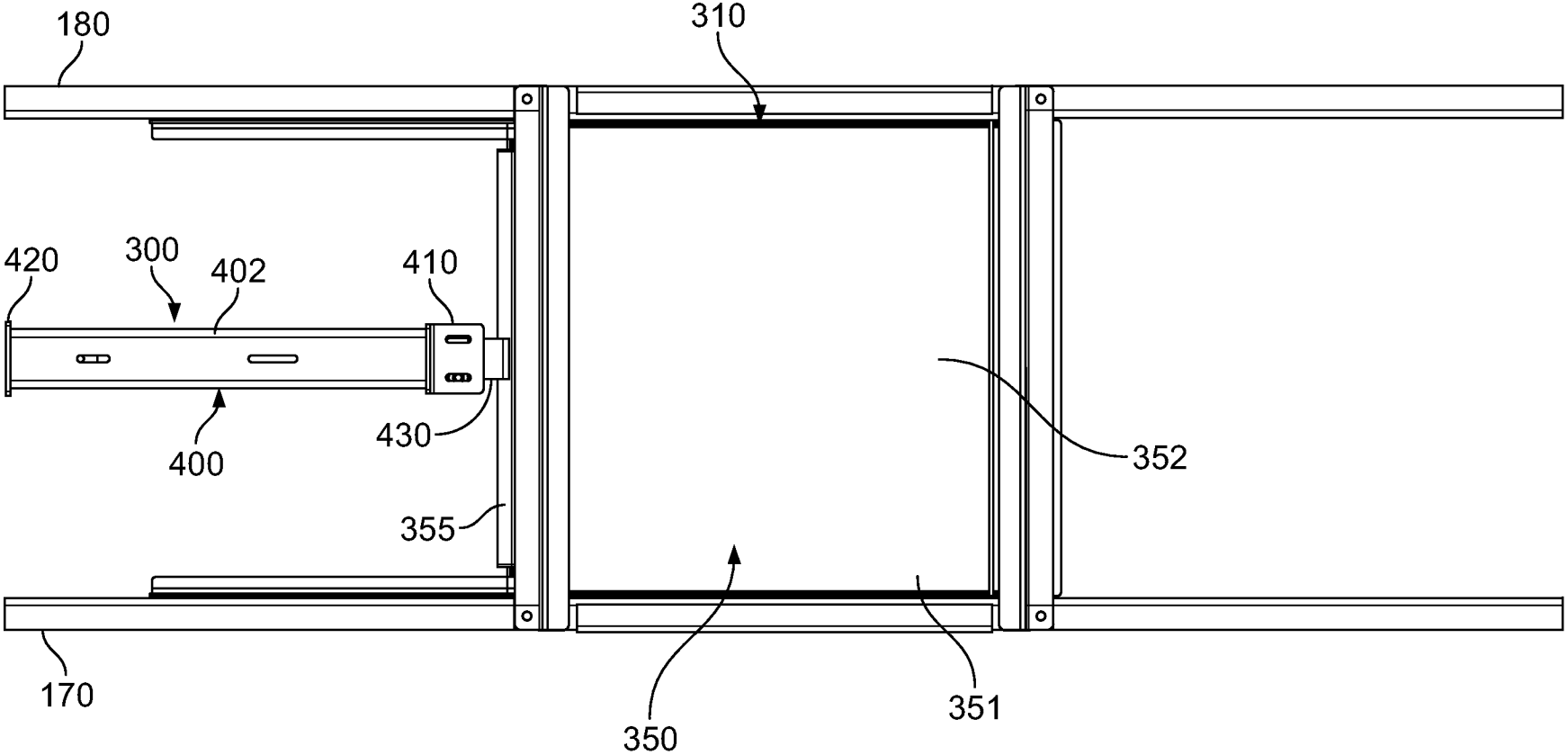
FIG. 24 is an enlarged top view of the material unloading assembly of the bulk material shipping container of FIG. 1 attached to part of the pallet of the bulk material shipping container of FIG. 1 and with the gate assembly in a closed and locked position.
Figure 25:
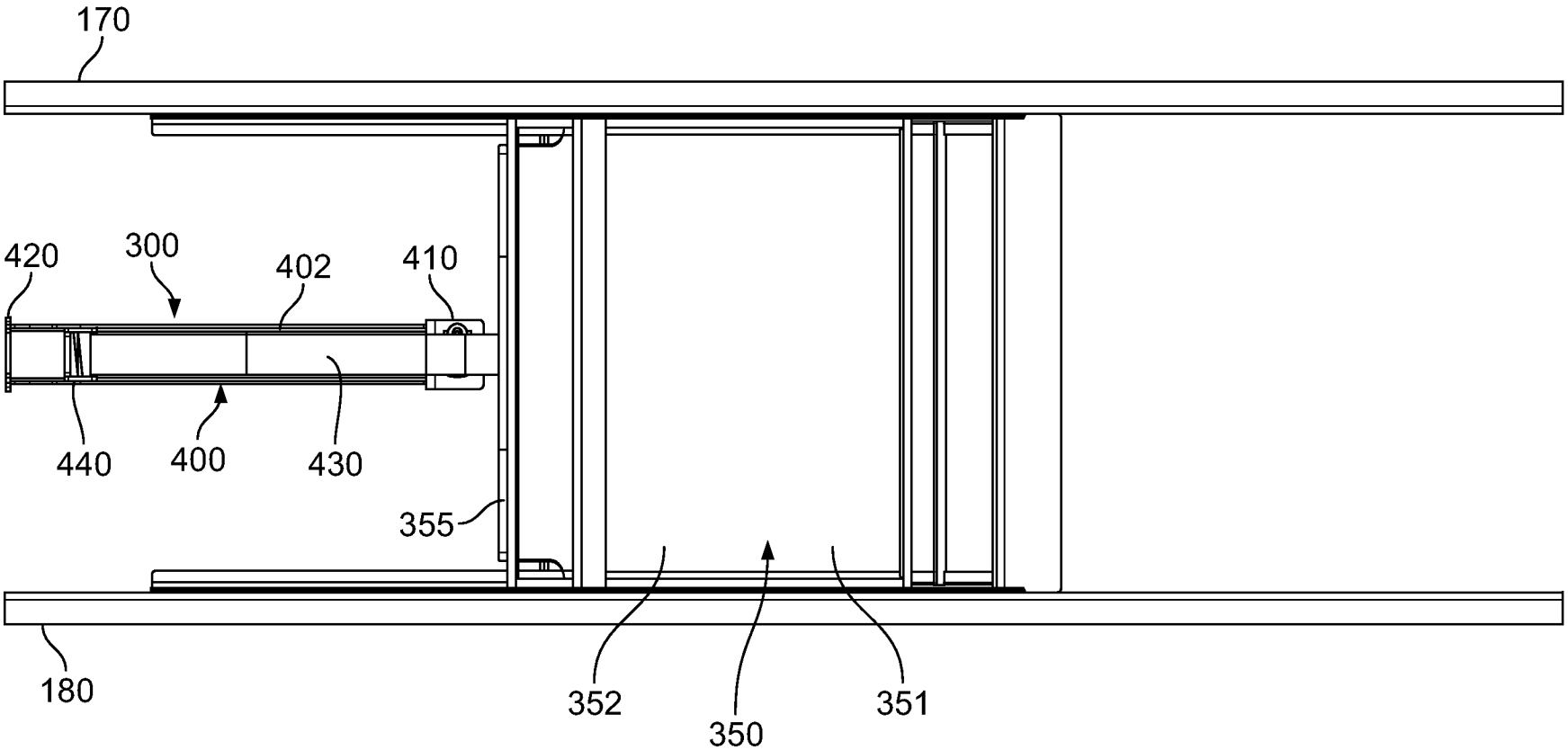
FIG. 25 is an enlarged bottom view of the material unloading assembly of the bulk material shipping container of FIG. 1 attached to part of the pallet of the bulk material shipping container of FIG. 1 and with the gate assembly in a closed and locked position.
Figure 26:
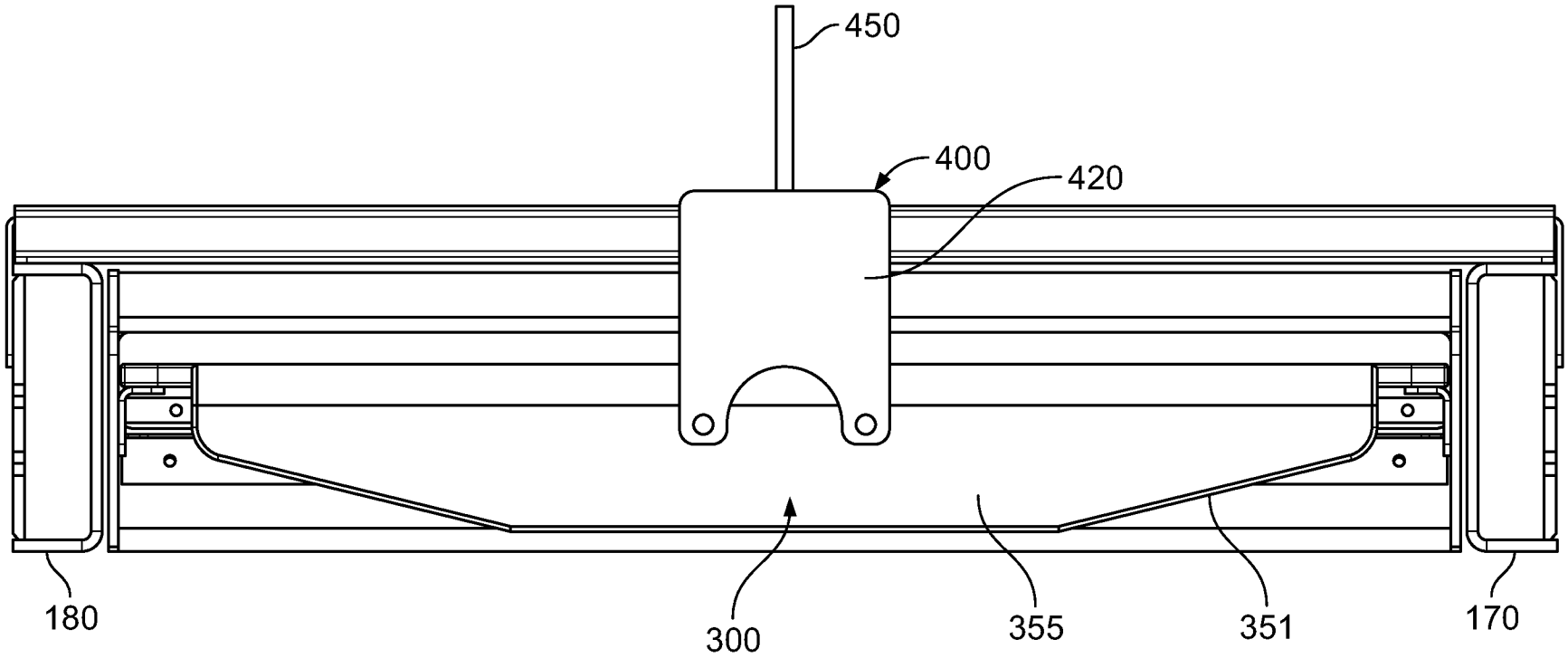
FIG. 26 is an enlarged front end of the material unloading assembly of the bulk material shipping container of FIG. 1 and part of the pallet of the bulk material shipping container of FIG. 1.
Figure 27:
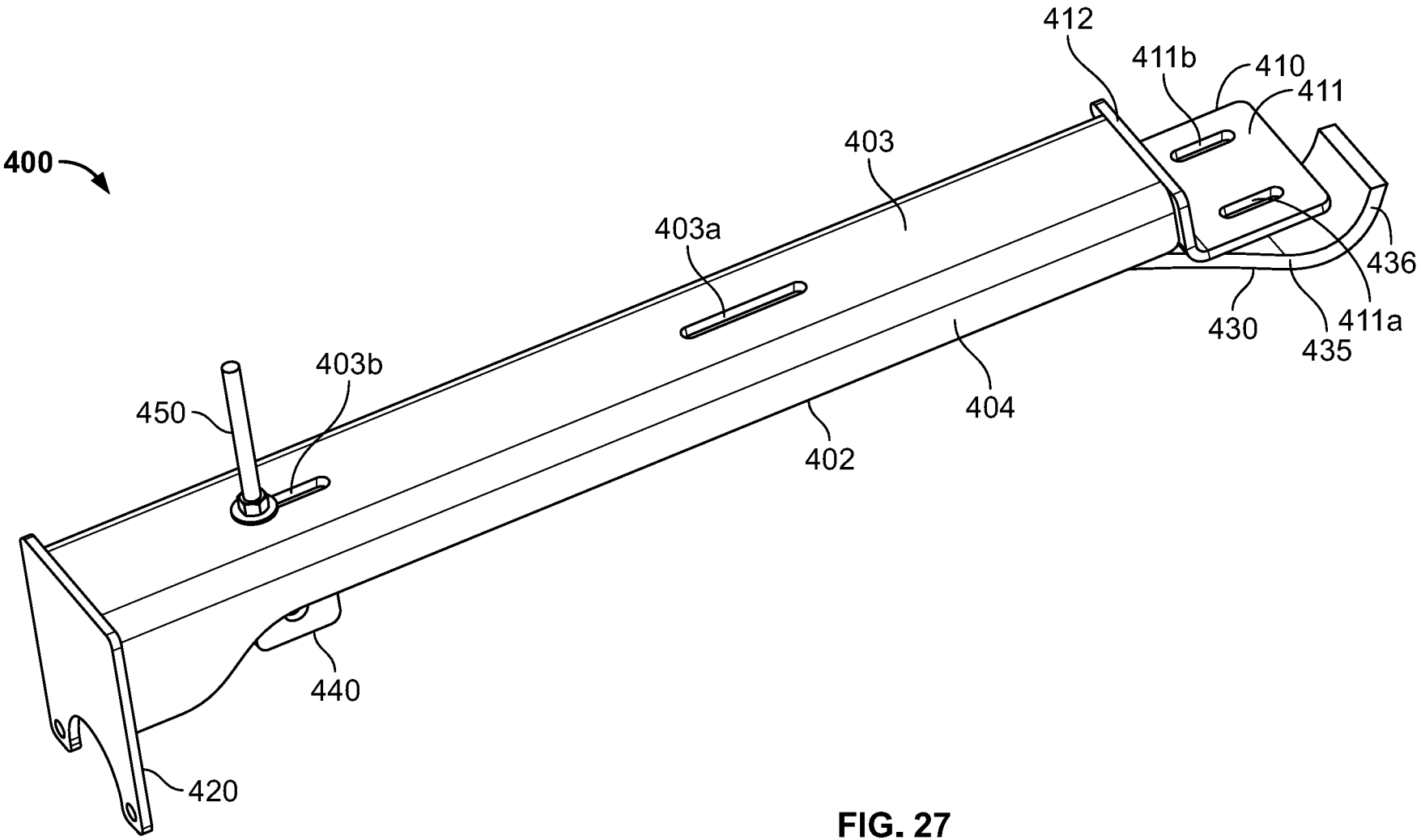
FIG. 27 is an enlarged top perspective view of the gate locking assembly of the material unloading assembly of the bulk material shipping container of FIG. 1.
Figure 28:
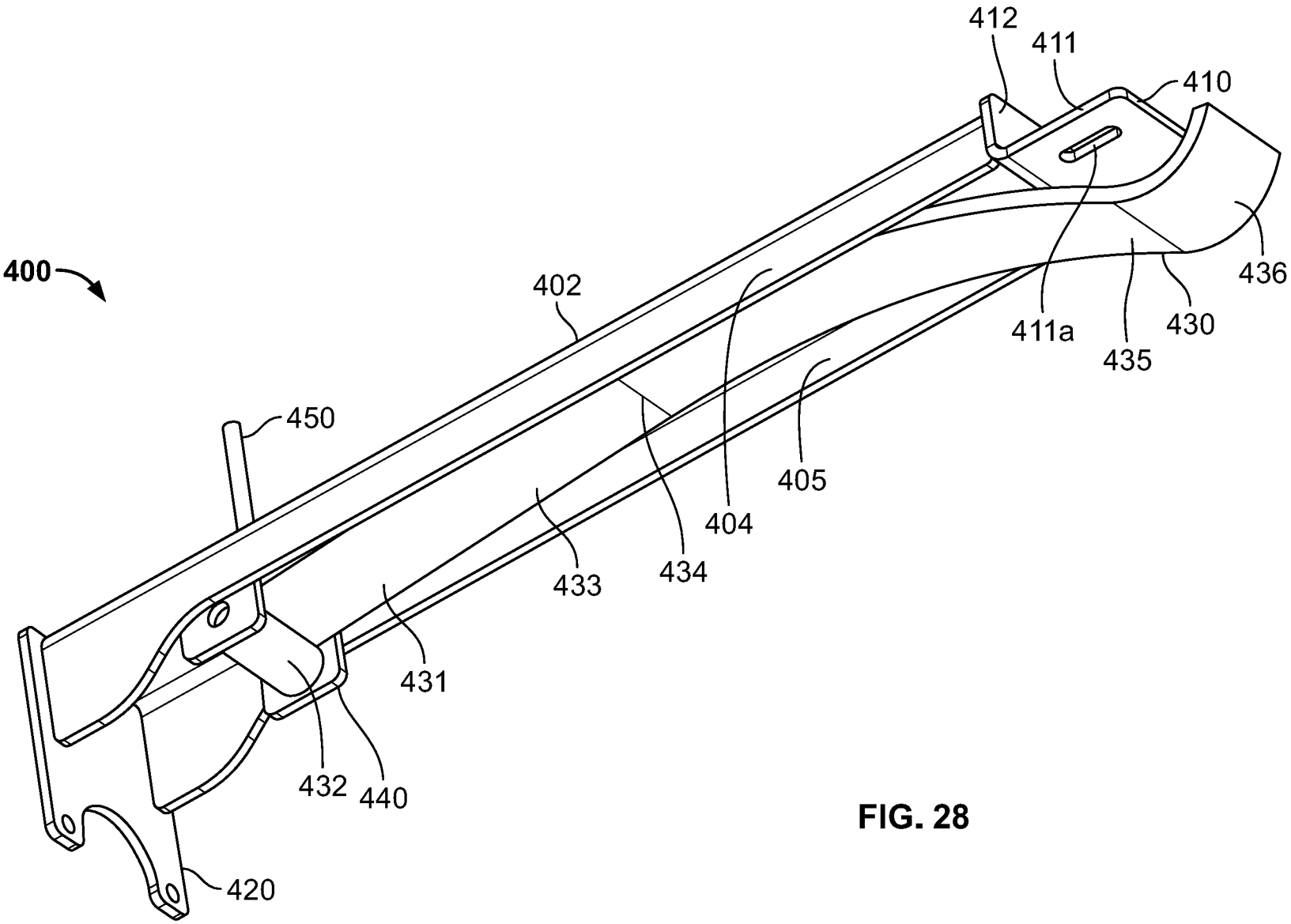
FIG. 28 is an enlarged bottom perspective view of the gate locking assembly of the material unloading assembly of the bulk material shipping container of FIG. 1.
Figure 29:
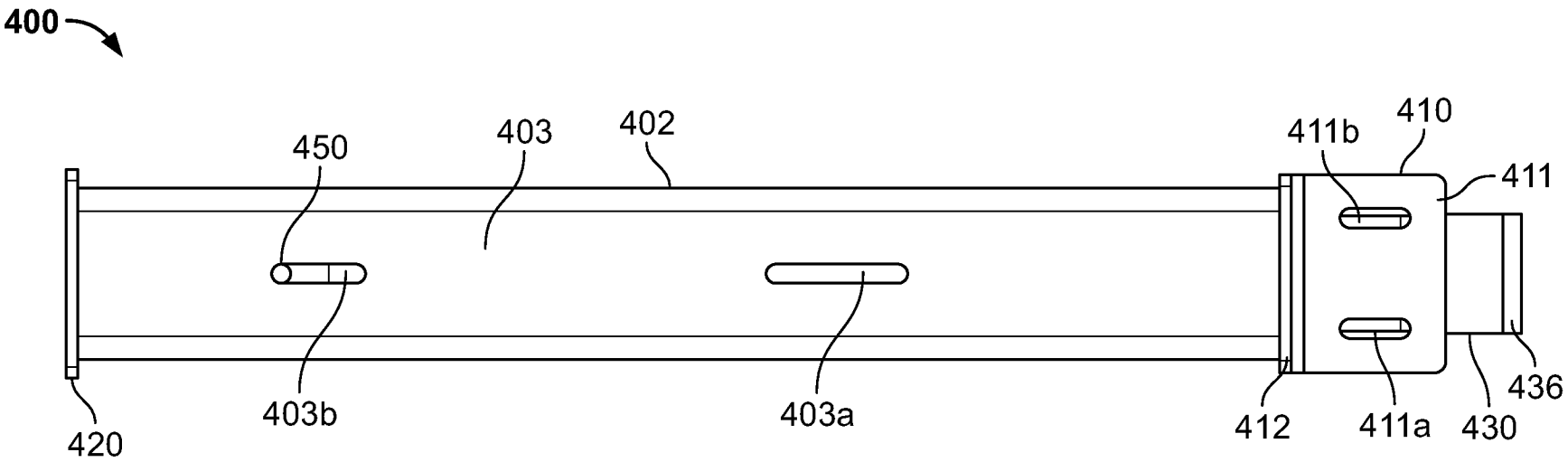
FIG. 29 is an enlarged top view of the gate locking assembly of the material unloading assembly of the bulk material shipping container of FIG. 1.
Figure 30:
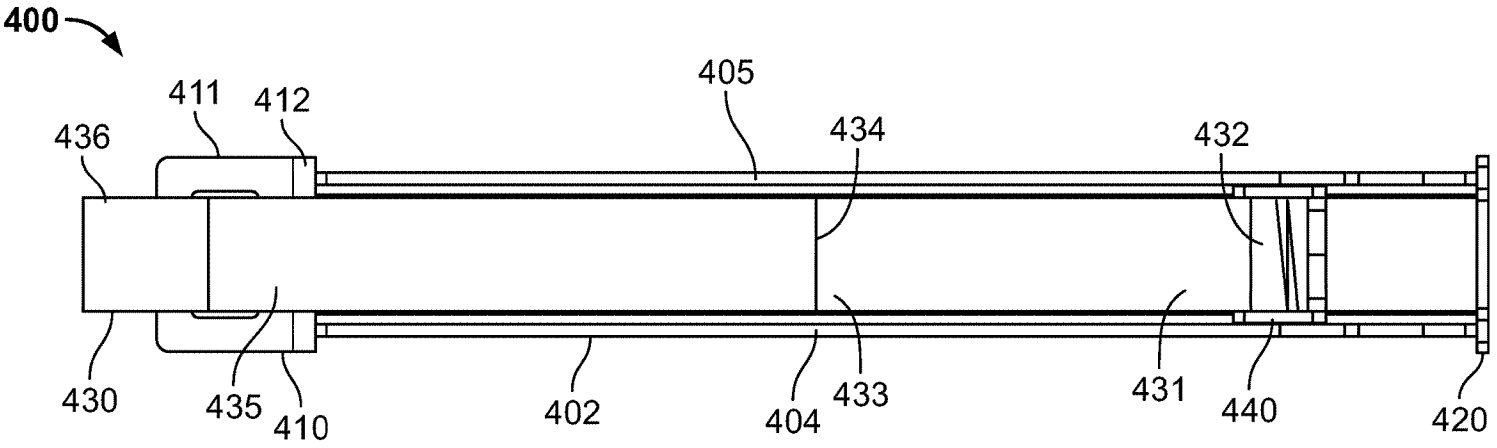
FIG. 30 is an enlarged bottom view of the gate locking assembly of the material unloading assembly of the bulk material shipping container of FIG. 1.
Figure 31:
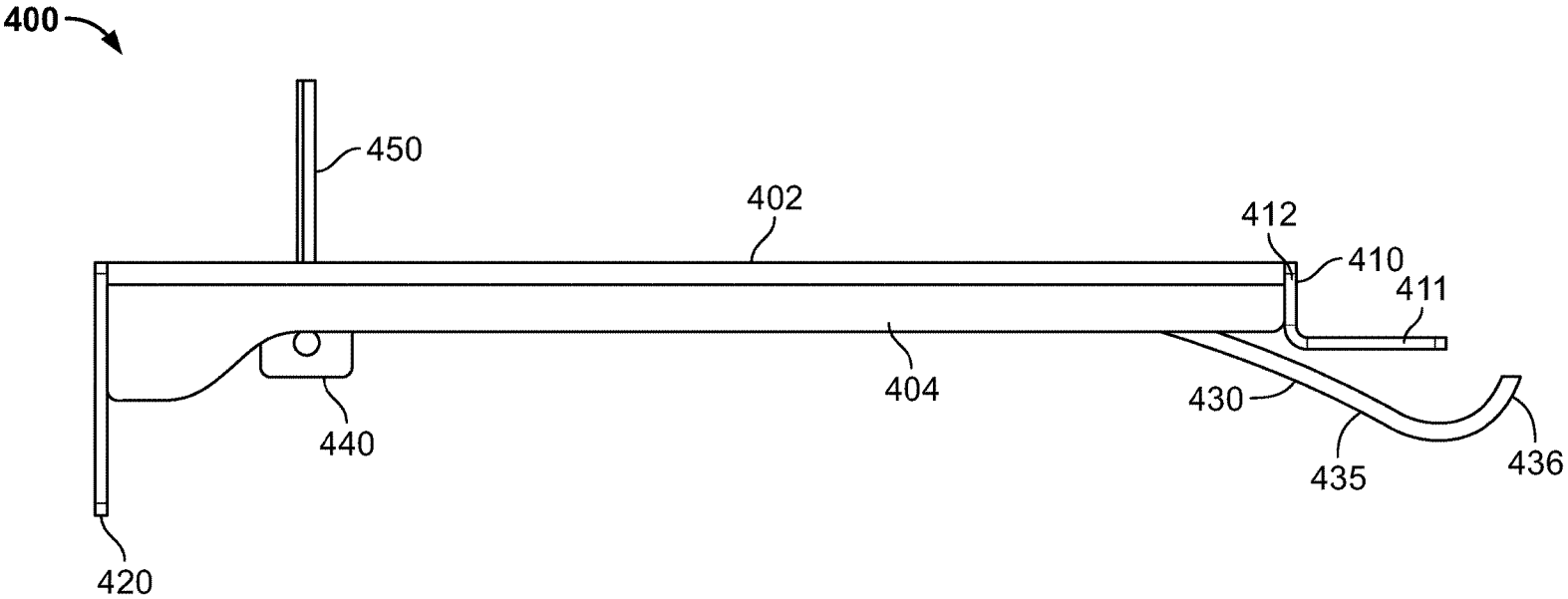
FIG. 31 is an enlarged first side view of the gate locking assembly of the material unloading assembly of the bulk material shipping container of FIG. 1.
Figure 32:
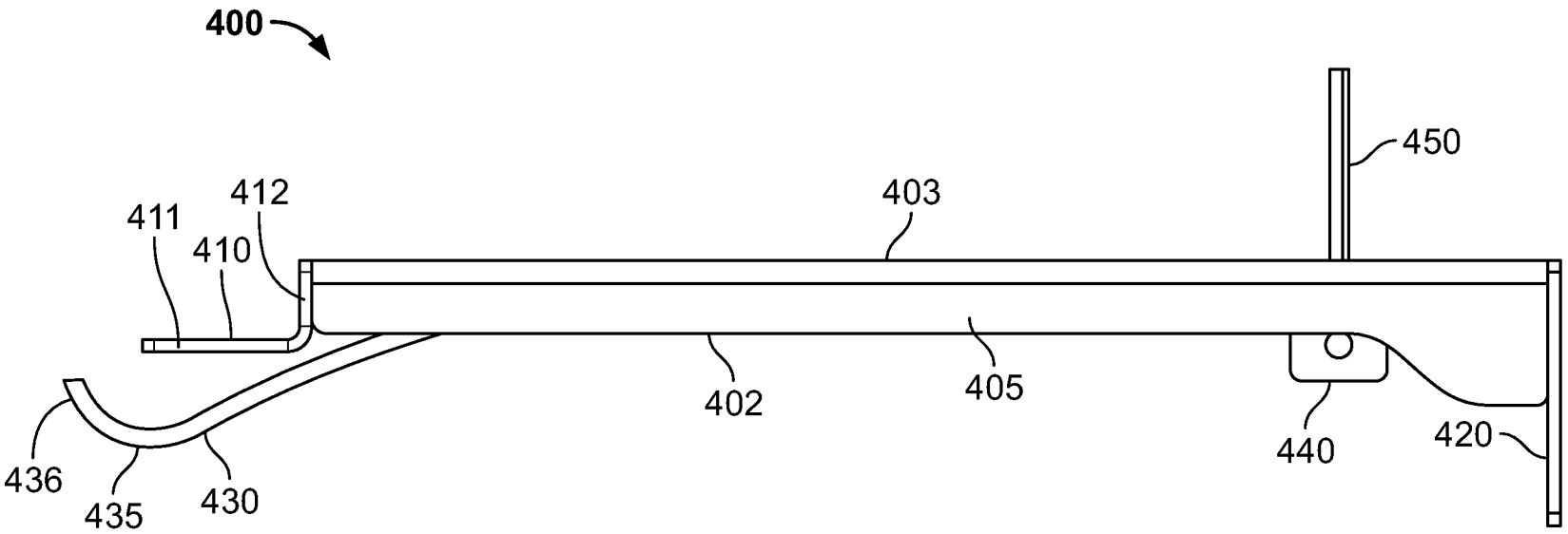
FIG. 32 is an enlarged second side view of the gate locking assembly of the material unloading assembly of the bulk material shipping container of FIG. 1.
Figure 33:
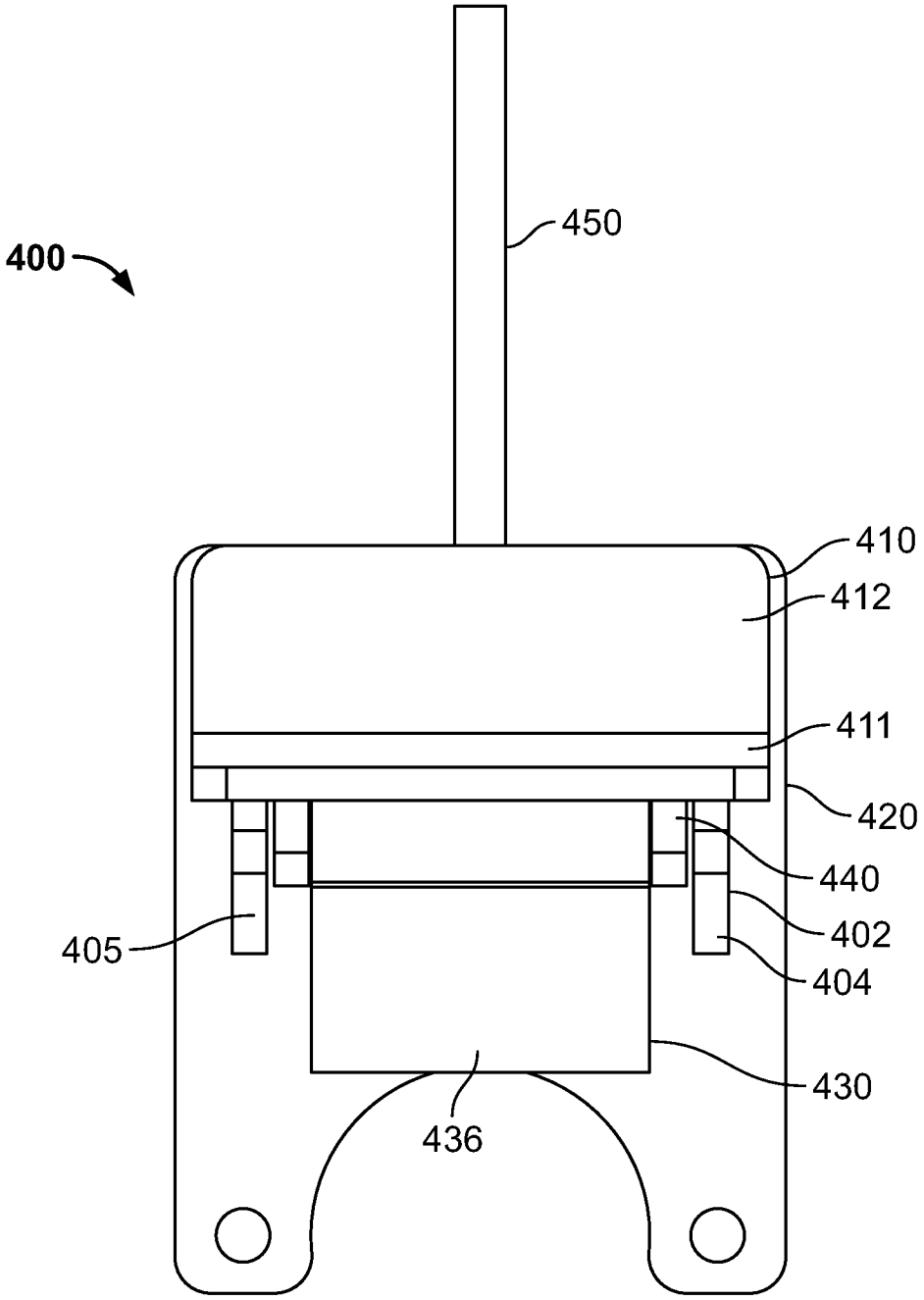
FIG. 33 is an enlarged interior view of the gate locking assembly of the material unloading assembly of the bulk material shipping container of FIG. 1.
Figure 34:
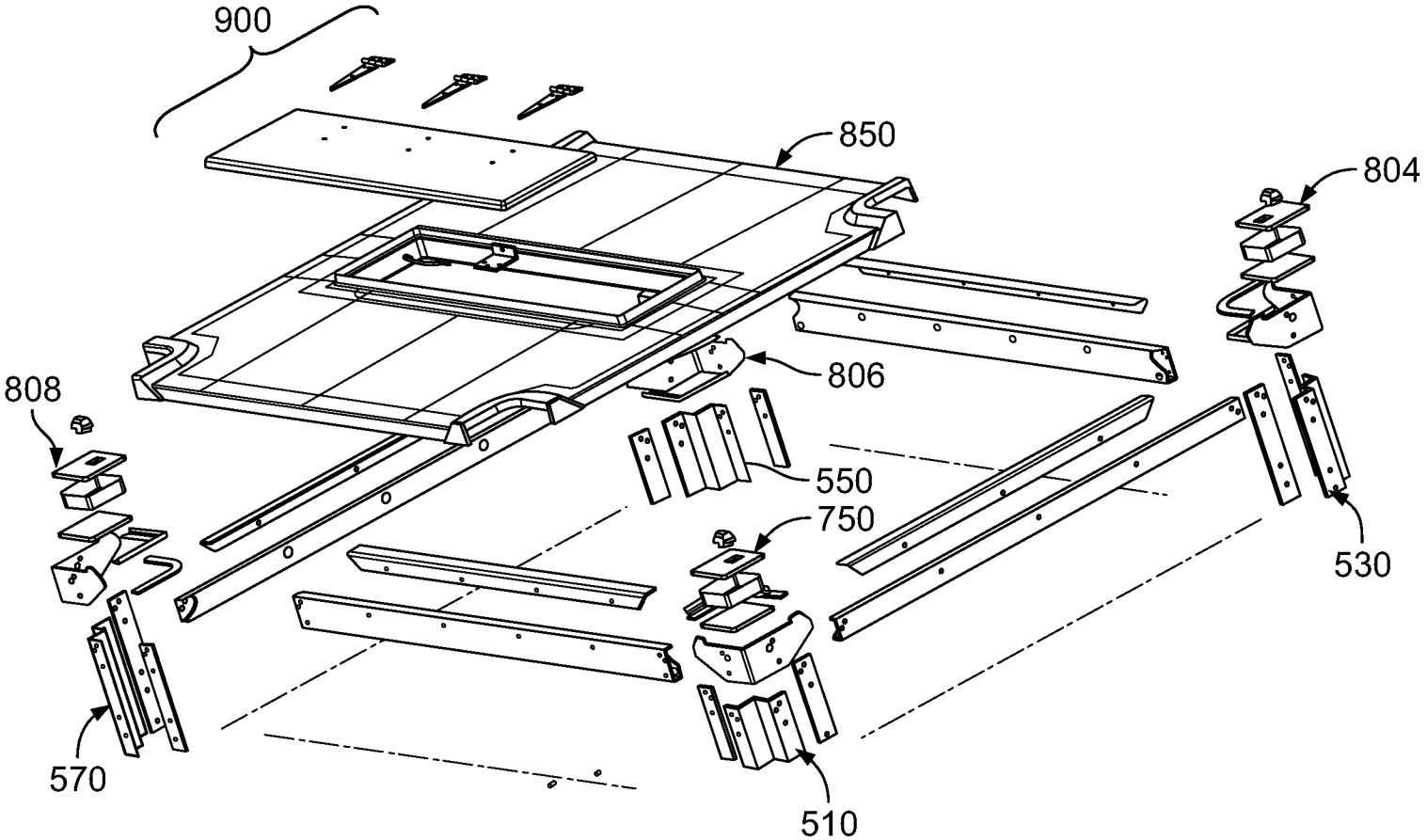
FIG. 34 is an exploded top perspective view of the top portion of the bulk material shipping container of FIG. 1, showing the material loading assembly, the top wall assembly, the top wall support assembly, the top corner assemblies, and portion of the upright corner assemblies.
Figure 34A:
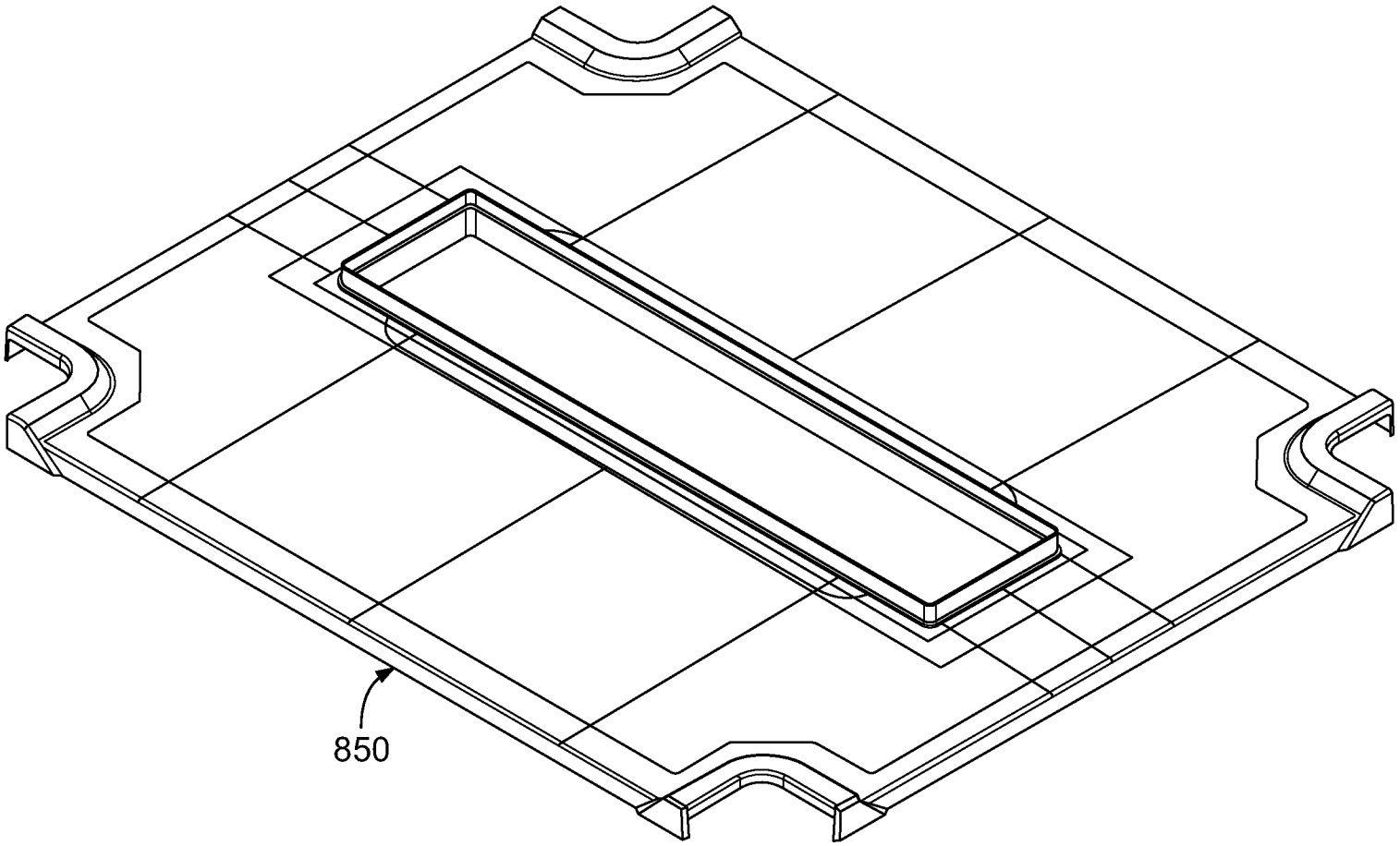
FIG. 34A is an enlarged top perspective view of the top wall assembly of the compartment of the bulk material shipping container of FIG. 1, shown removed from the rest of the container.
Figure 35:
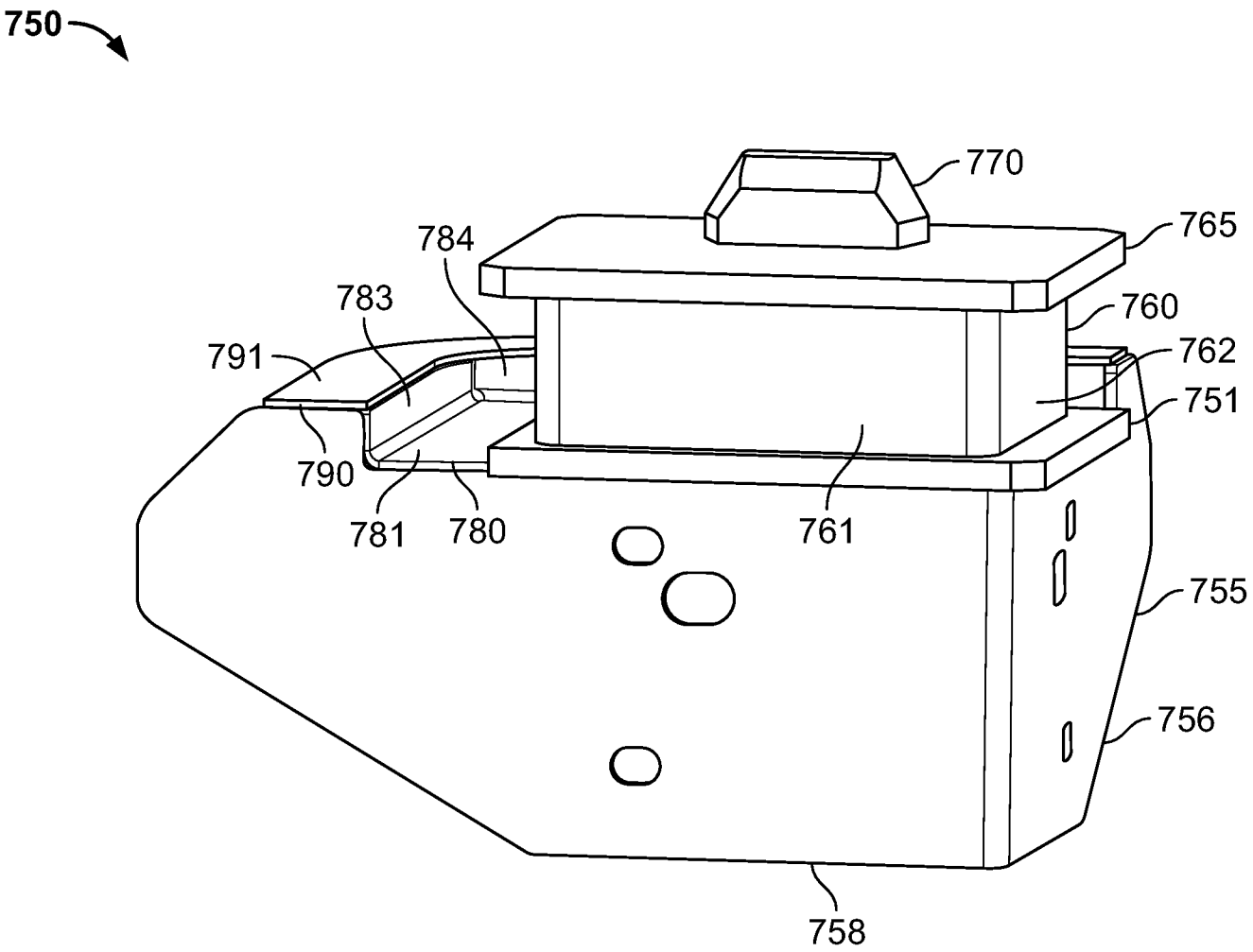
FIG. 35 is a perspective view of one of the upper corner assemblies of the compartment of the bulk material shipping container of FIG. 1, shown removed from the container.
Figure 36:
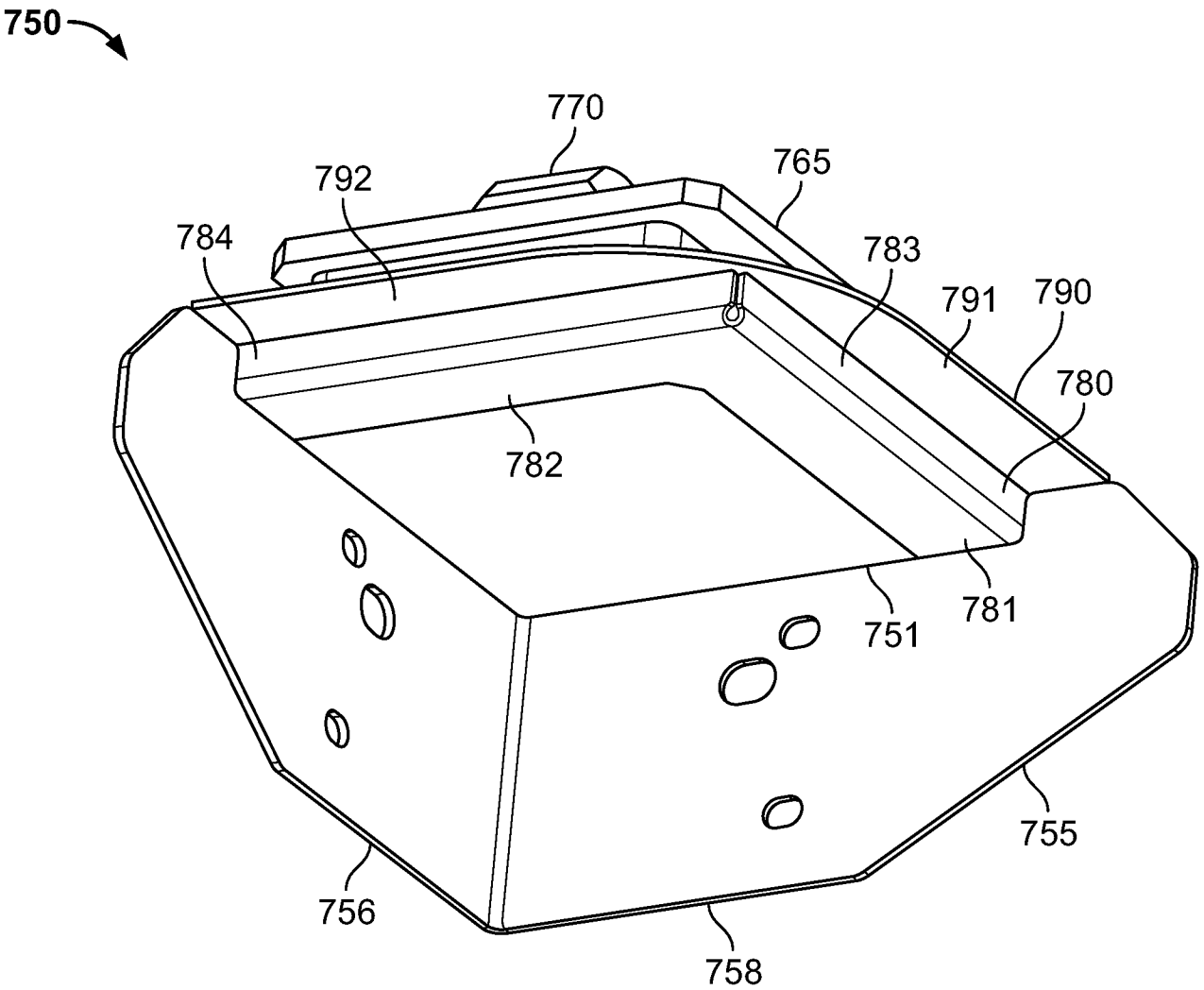
FIG. 36 is an bottom perspective view of the top corner assembly of FIG. 35.
Figure 37:
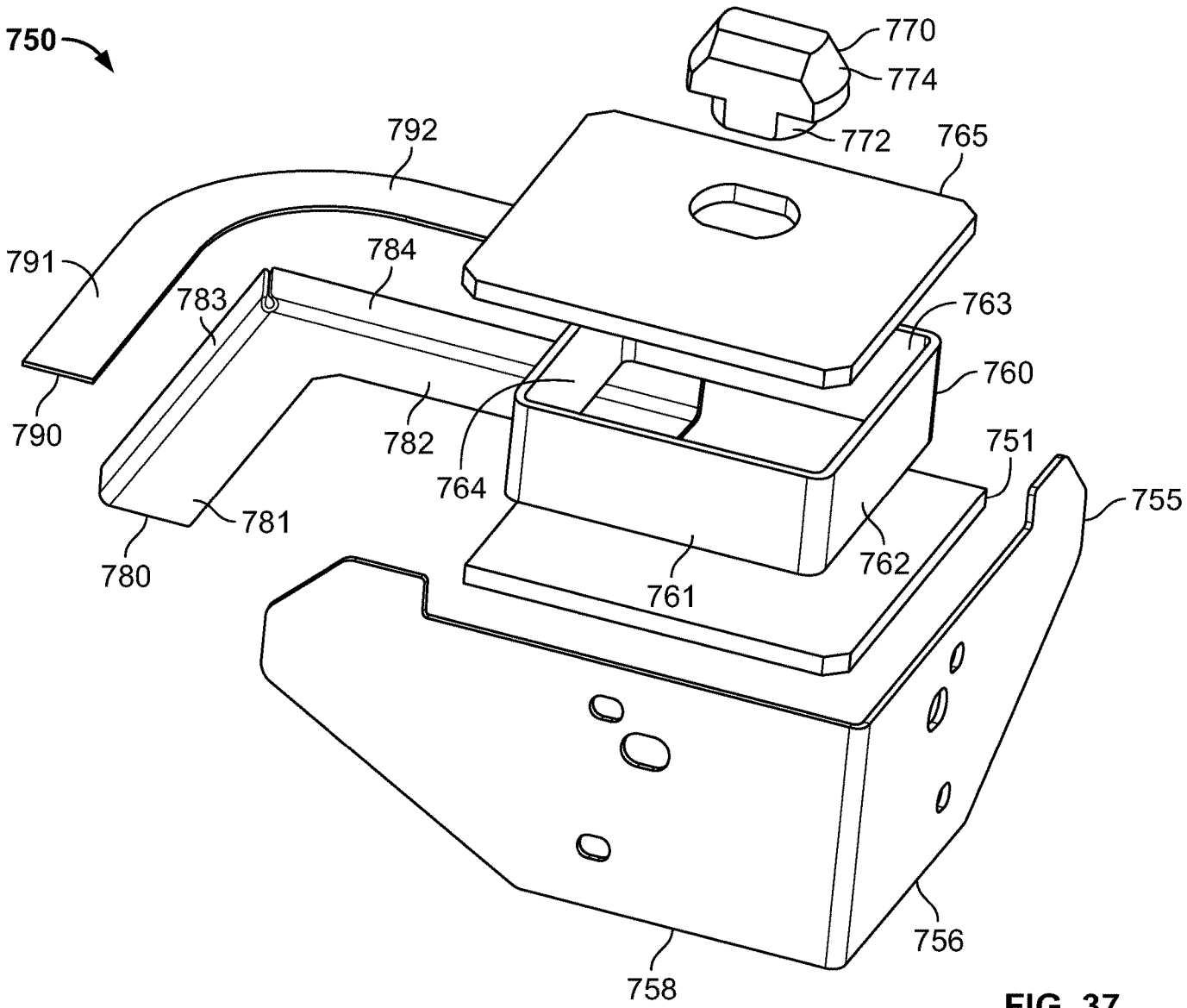
FIG. 37 is an exploded top perspective view of the top corner assembly of FIG. 35.
Figure 38:
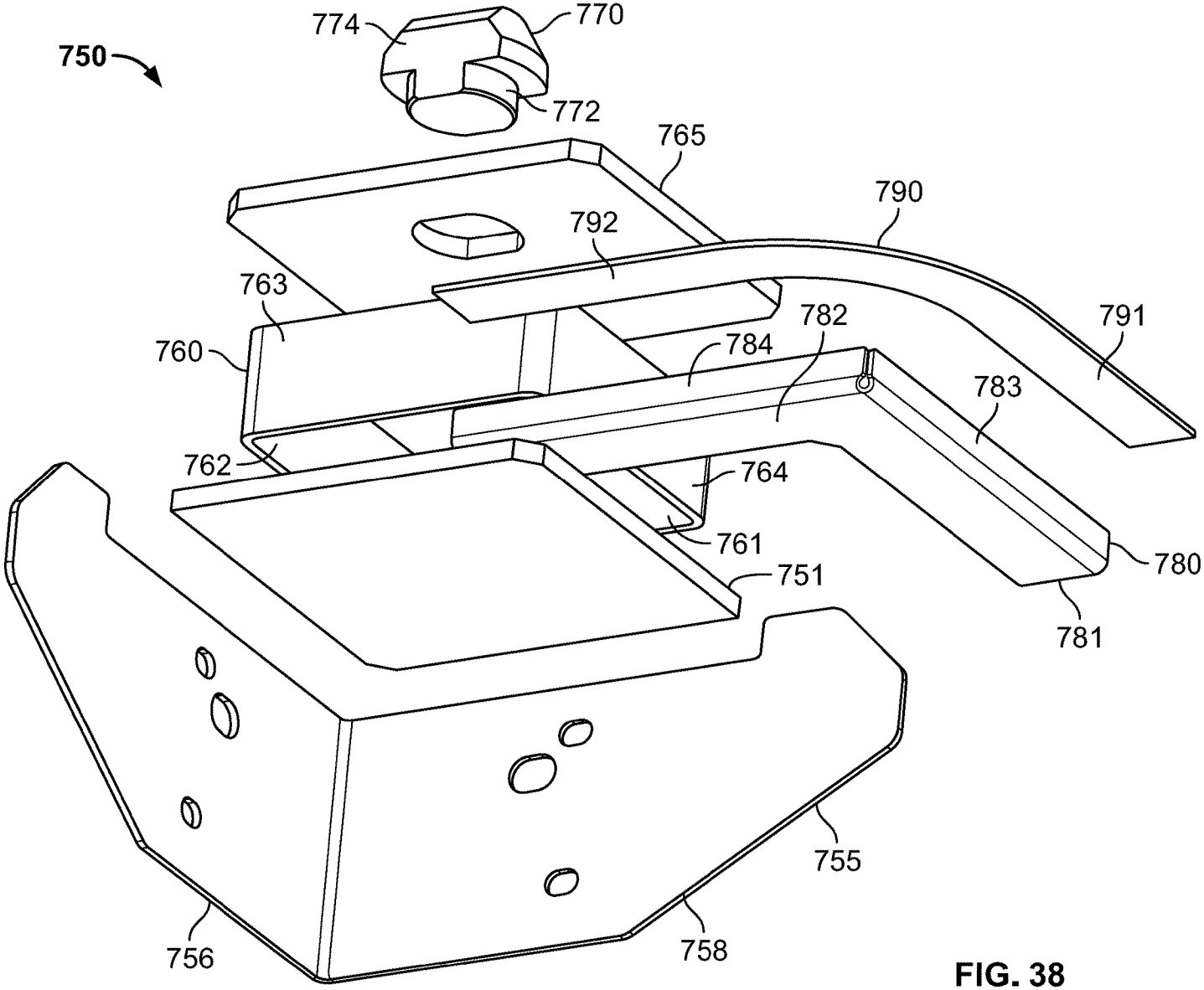
FIG. 38 is an exploded bottom perspective view of the top corner assembly of FIG. 35.
Figure 39:
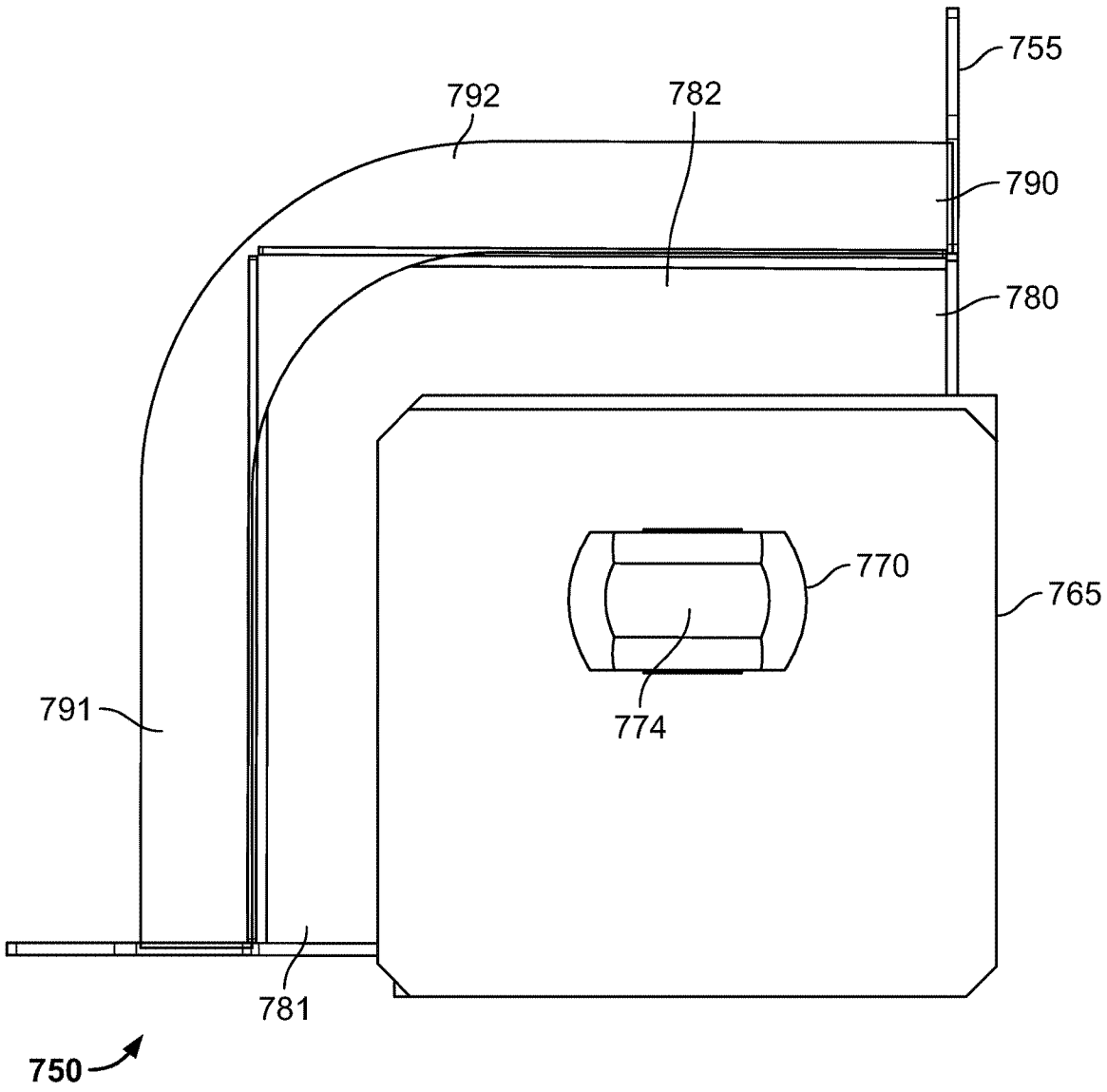
FIG. 39 is a top view of the top corner assembly of FIG. 35.
Figure 40:
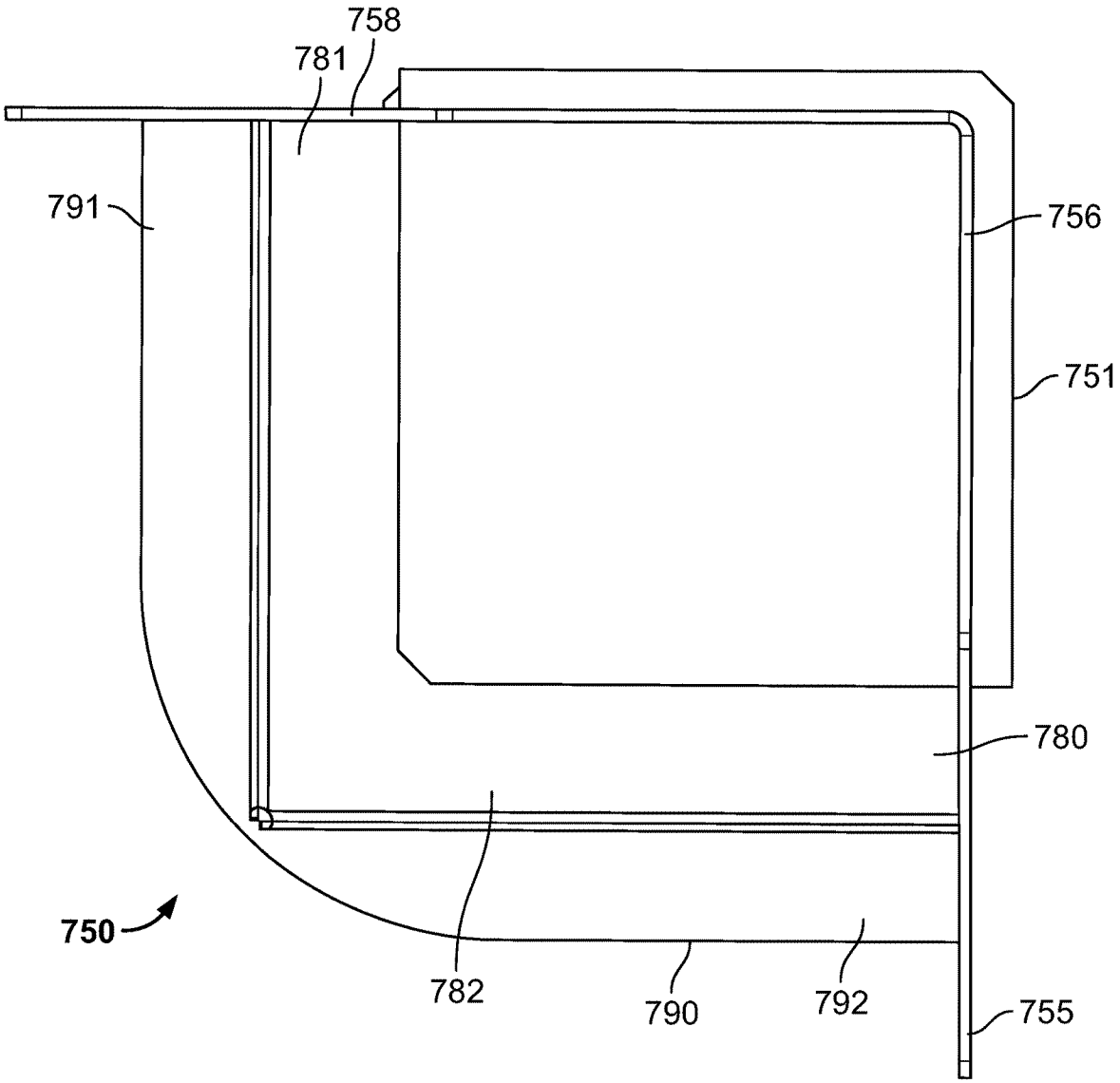
FIG. 40 is a bottom view of the top corner assembly of FIG. 35.
Figure 41:
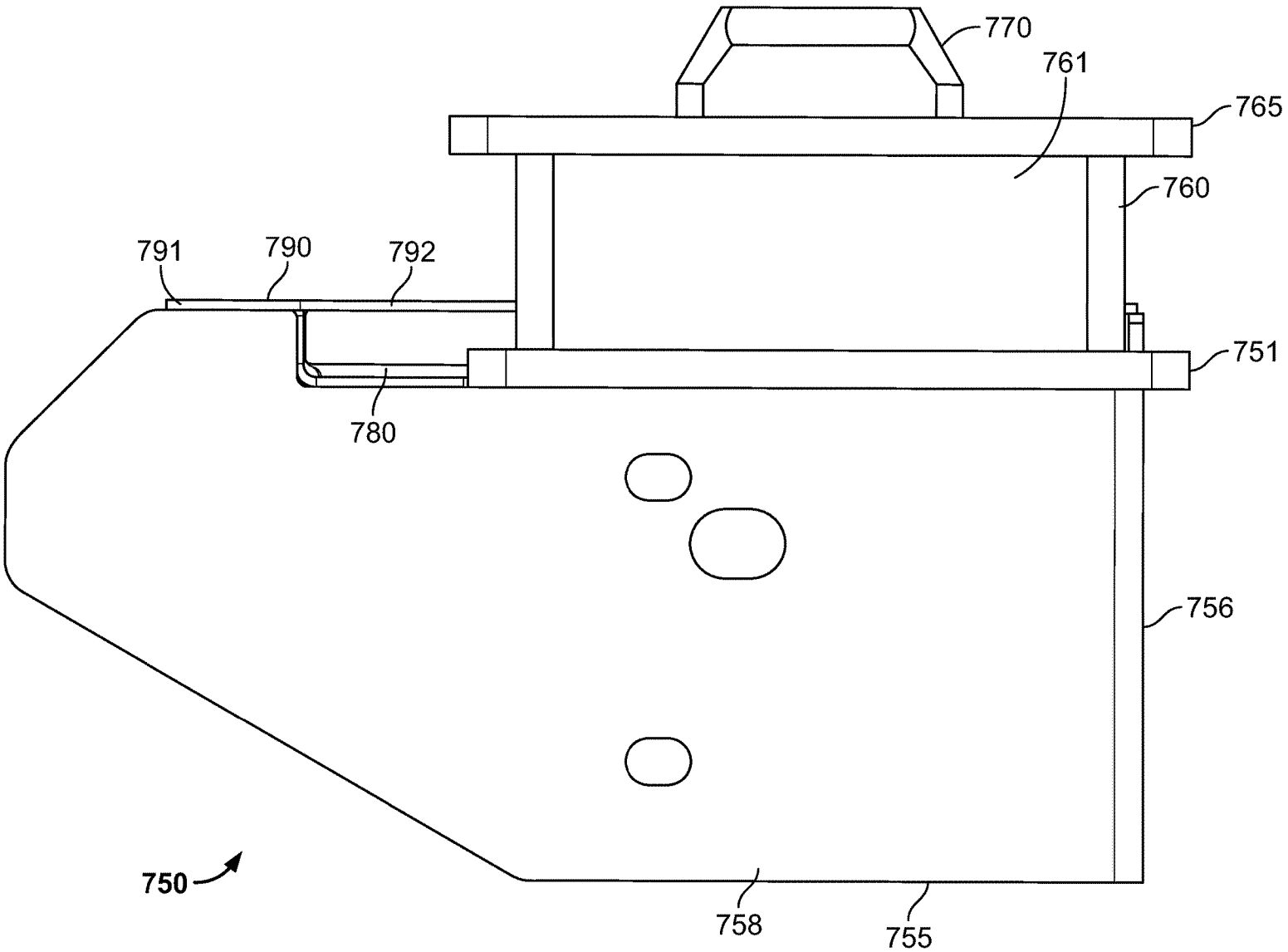
FIG. 41 is a first side view of the top corner assembly of FIG. 35.
Figure 42:
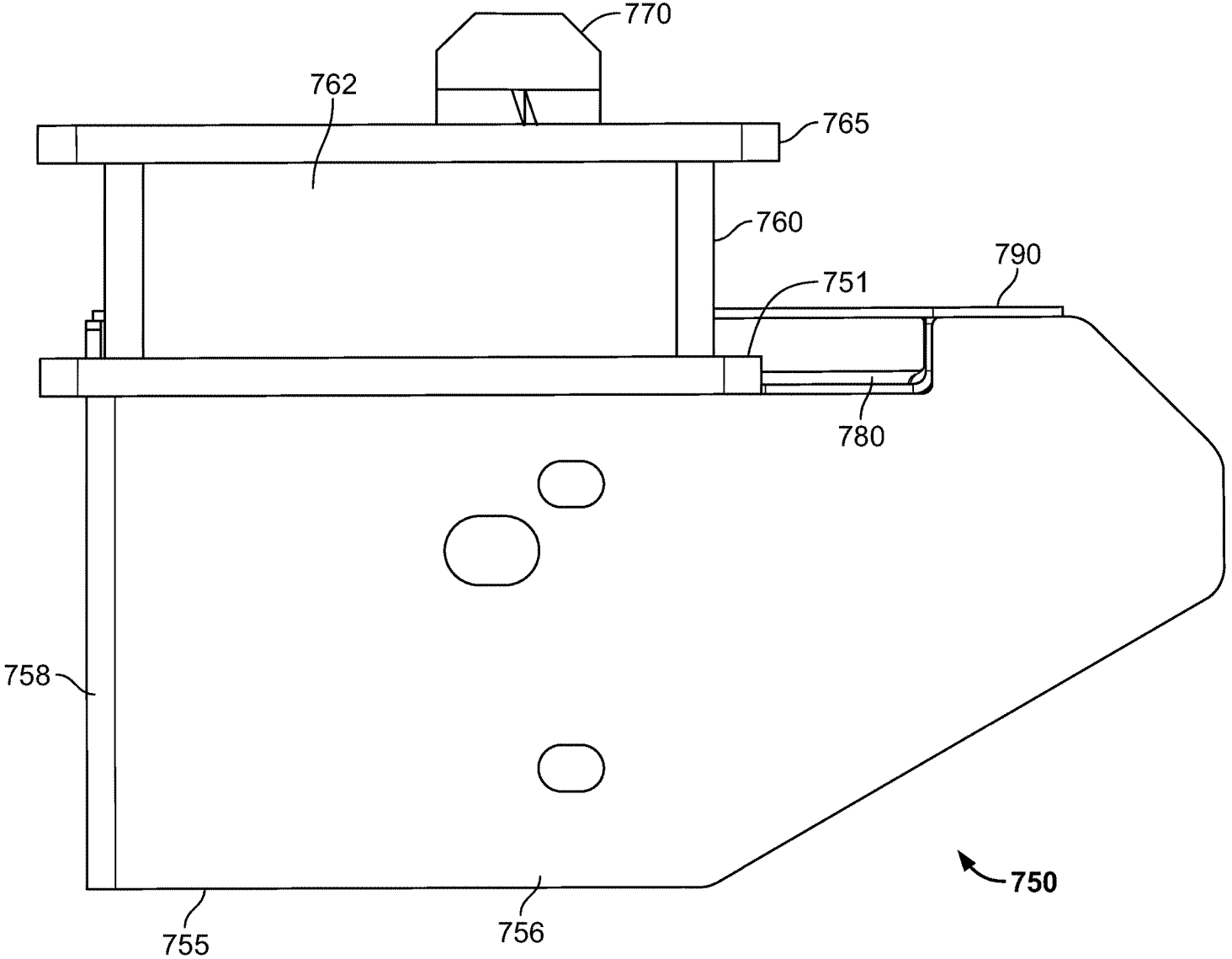
FIG. 42 is a second side view of the top corner assembly of FIG. 35.
Figure 43:
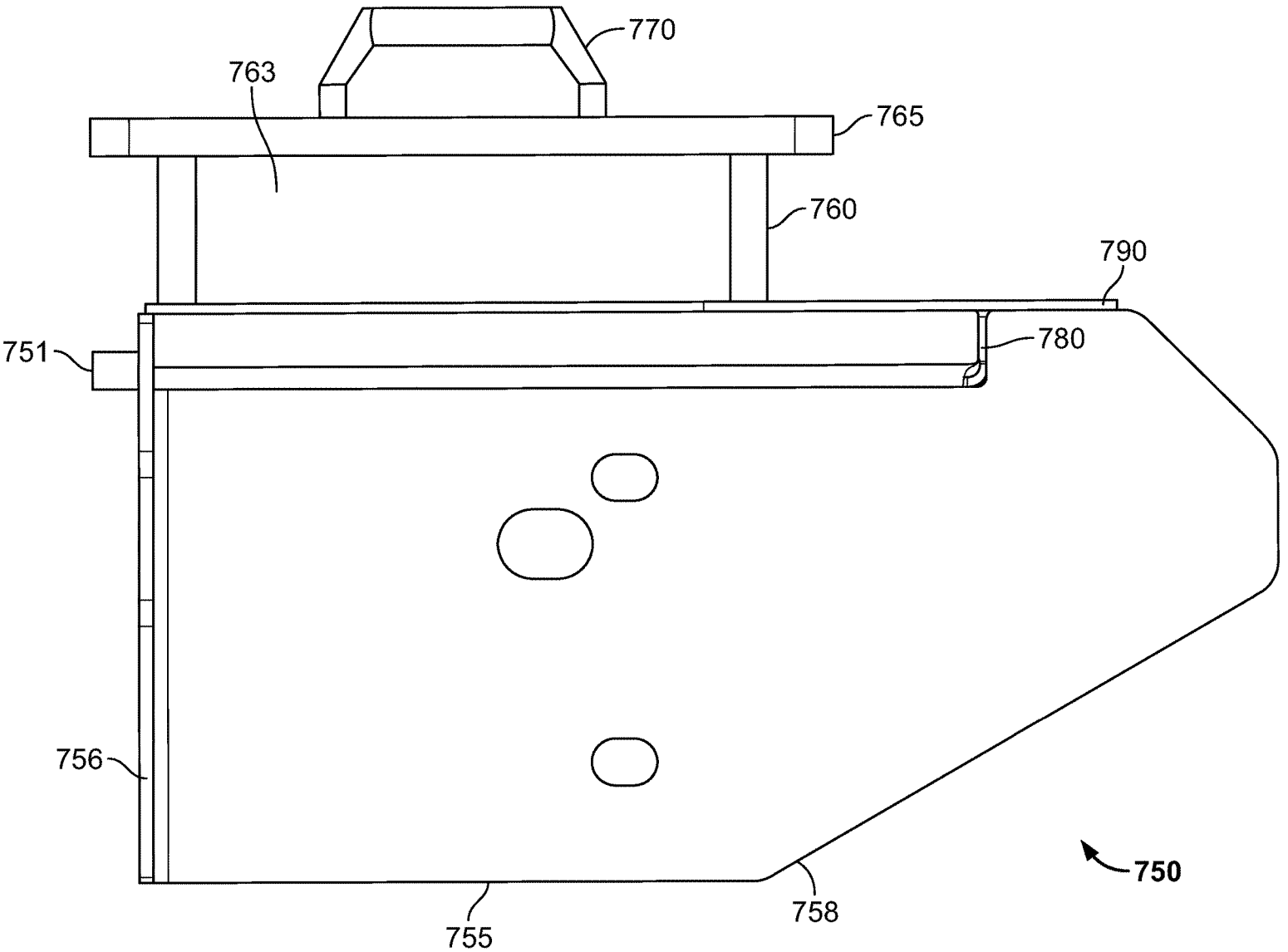
FIG. 43 is a first interior view of the top corner assembly of FIG. 35.
Figure 44:
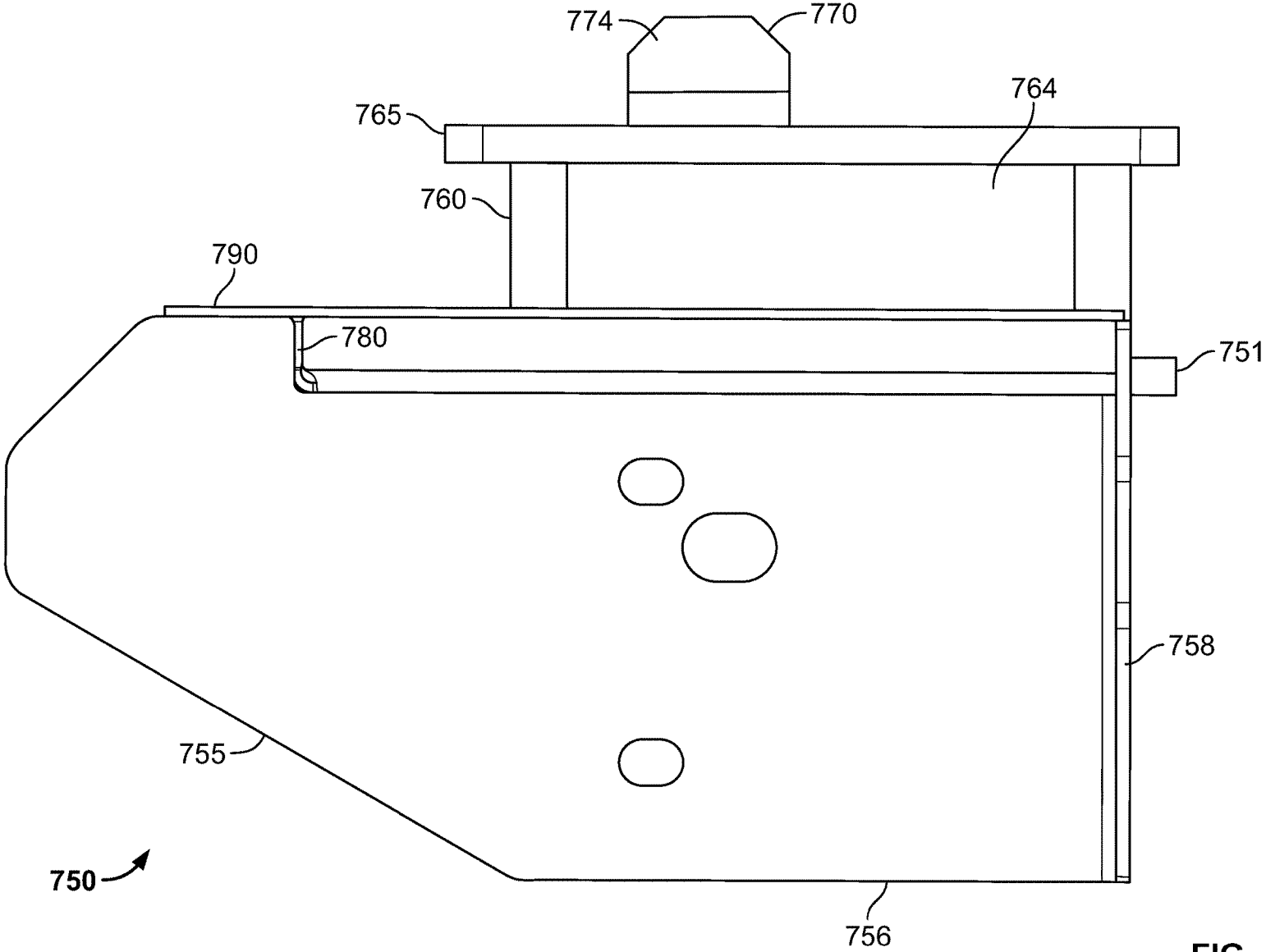
FIG. 44 is an second interior view of the top corner assembly of FIG. 35.
Figure 45:
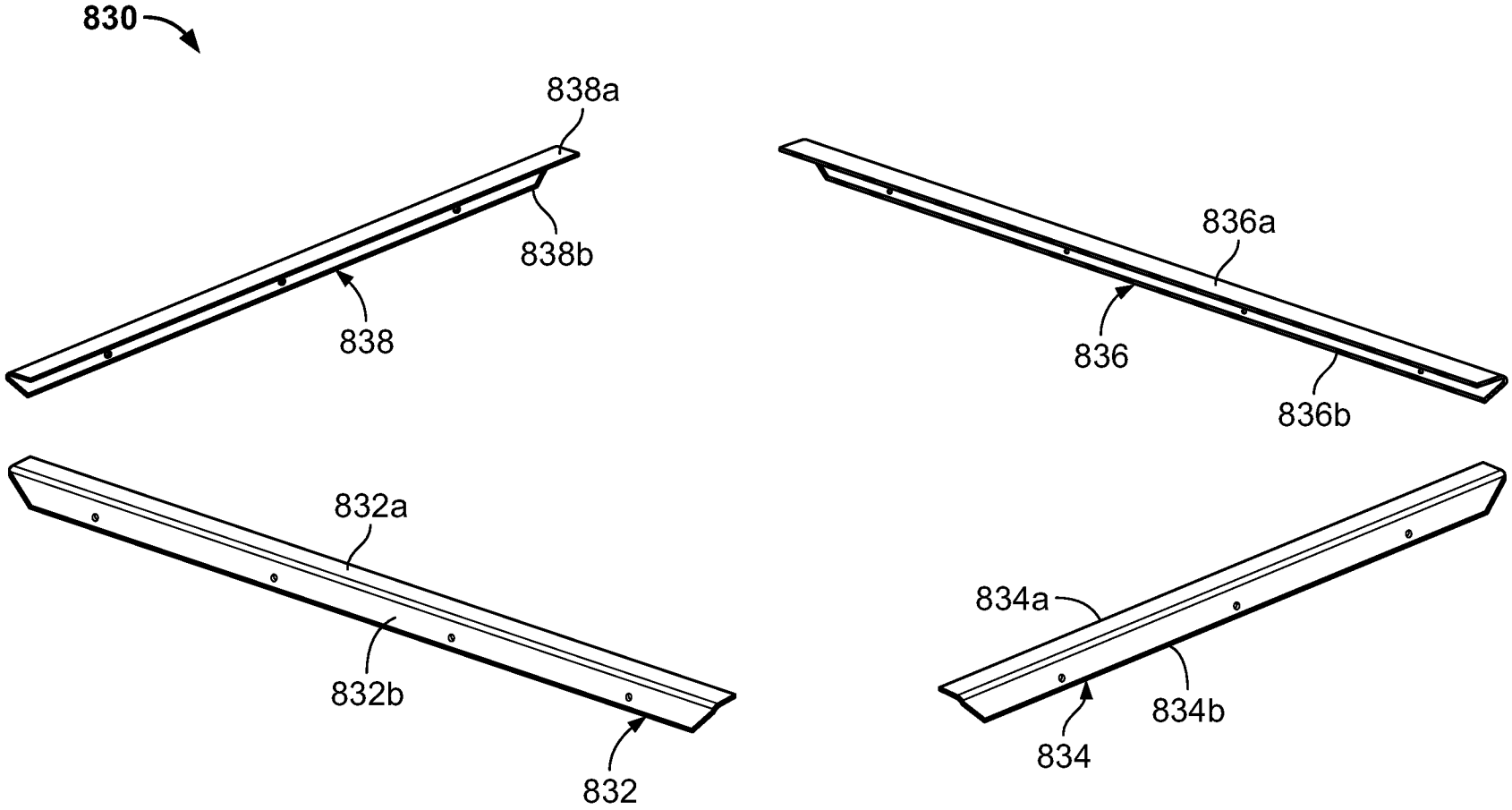
FIG. 45 is an exploded top perspective view of the top wall support assembly of the compartment of the bulk material shipping container of FIG. 1, shown removed from the container.
Figure 46:
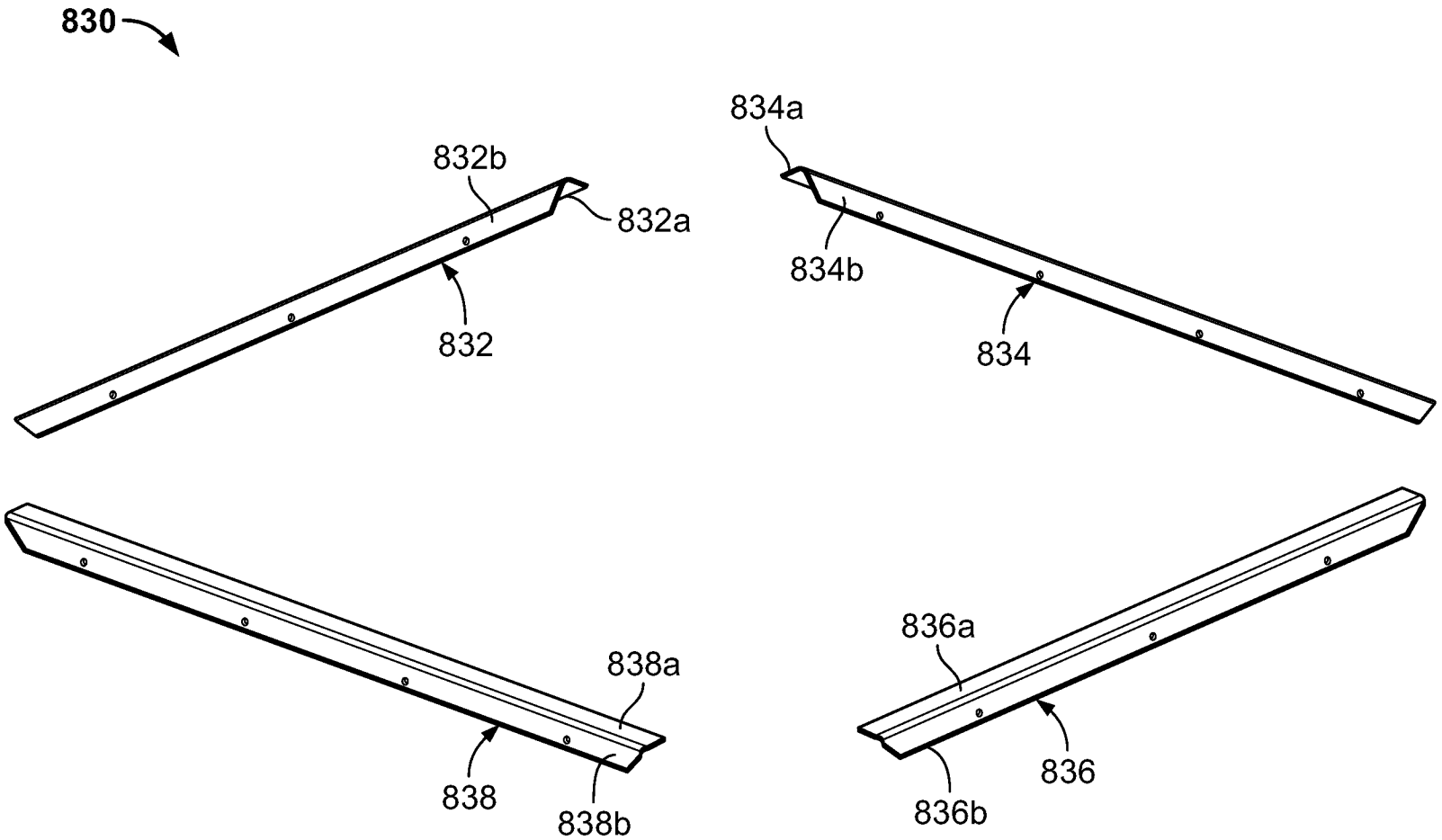
FIG. 46 is an exploded bottom perspective view of the top wall support assembly of FIG. 45.
Figure 47:
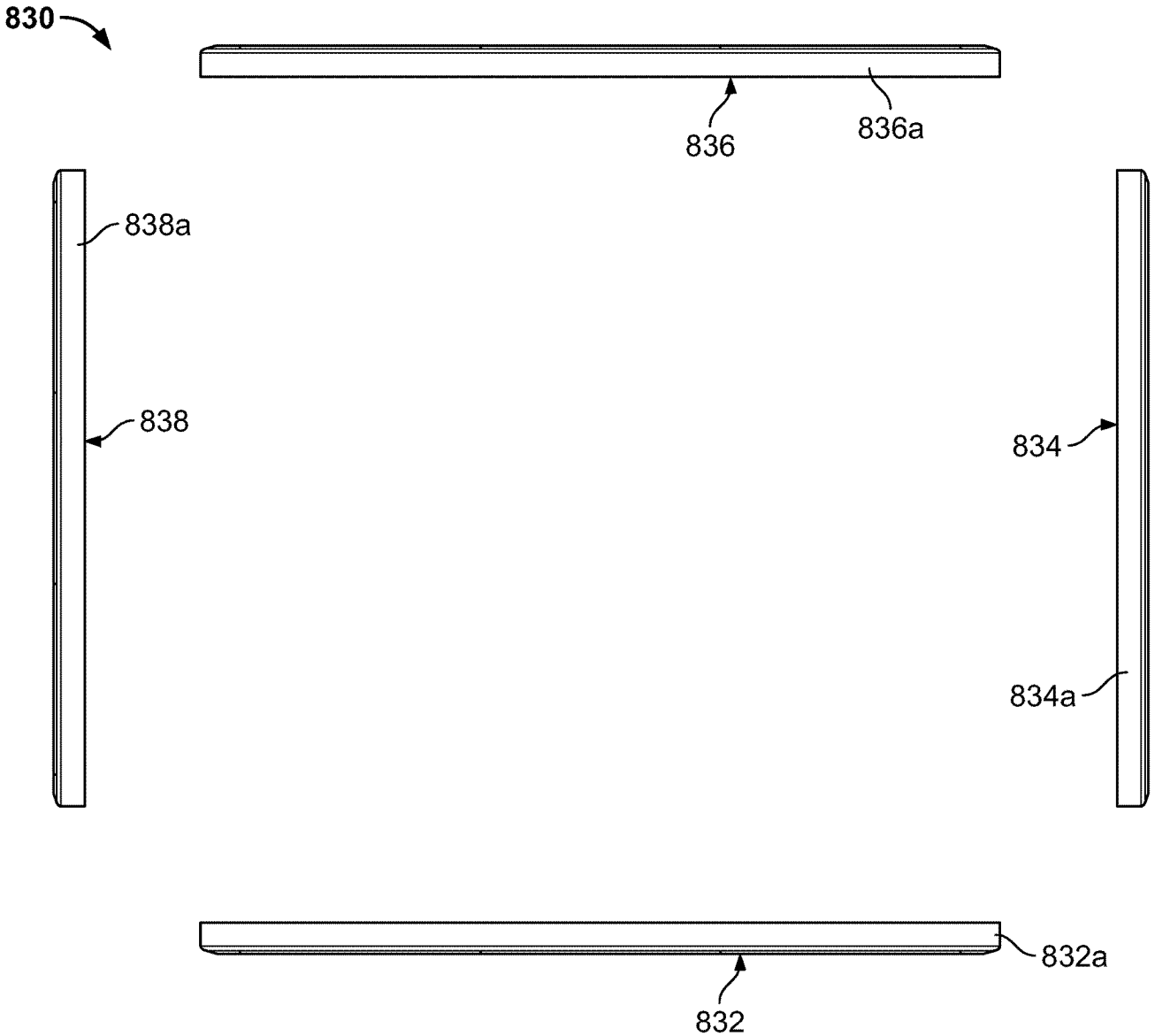
FIG. 47 is an exploded top view of the top wall support assembly of FIG. 45.

As best shown in FIG. 23, the illustrated example gate support assembly 310 is made of steel and includes: (1) first and second outer side support plates 311*a* and 311*b;* (2) first and second inner side support plates 312*a* and 312*b;* (3) first and second support side rails 313*a* and 313*b;* (4) first and second side gate limiters 314*a* and 314*b;* (5) first and second side gate engagers 315*a* and 315*b;* (6) a front and rear gate limiters 316*a* and 316*b;* and (7) front and rear gate engagers 317*a* and 317*b*. These components are suitably attached to the first and second material unloading supports 170 and 180 of the pallet 100 to suitably support the gate assembly 350.

It should be appreciated that FIG. 23 further illustrates the various material directors that are not labeled, but suitably configured to direct material through the opening when gate assembly 350 is in the open position, and to otherwise prevent material leakage.

As best shown in FIGS. 27 to 33, the illustrated example gate locking assembly 400 is made of steel and includes: (1) a locking bar support 402; (2) a rear support bracket 410; (3) a front support bracket 420; (4) a locking bar 430; (5) a locking bar connector bracket 440; and (6) an actuation assembly 450. The gate locking assembly 400 is generally configured to lock the gate assembly 350 in the closed positioned and to be activated to unlock the gate assembly 350 from the closed and locked position to allow the gate assembly 350 to be opened. The gate locking assembly 400 is also generally configured to automatically re-lock the gate assembly 350 when the gate assembly 350 returns to the closed and locked positioned. The gate locking assembly 400 is configured to lock the gate assembly 350 in the closed position by engaging the downwardly extending front end member 355 of the gate assembly 350 and to unlock the gate assembly 350 by disengaging from the downwardly extending front end member 355 of the gate assembly 350.

More specifically, the locking bar support 402 has a front end and a rear end and includes: (1) an elongated top wall 403; (2) an elongated first side wall 404 integrally connected to and extending downwardly from the elongated top wall 403; and (3) an elongated second side wall 405 integrally connected to and extending downwardly from the elongated top wall 403 and spaced apart from the first side wall 404. The top wall 403 defines two spaced apart generally oval slots 403*a* and 403*b*.

The rear support bracket 410 includes: (1) a mounting wall 411; and (2) a locking bar support attachment wall 412 integrally connected to and extending upwardly from the mounting wall 411. The mounting wall 411 defines two spaced apart generally oval slots 411*a* and 411*b* for facilitating attachment by suitable fasteners (not shown) to the first stabilizer or anti-racking brace 190 as generally shown in FIGS. 13, 14, 15, 17, 18, and 19. The locking bar support attachment wall 412 is integrally attached (such as by welding) to the rear end of the of the locking bar support 402 to support the locking bar support 402.

Figure 13:
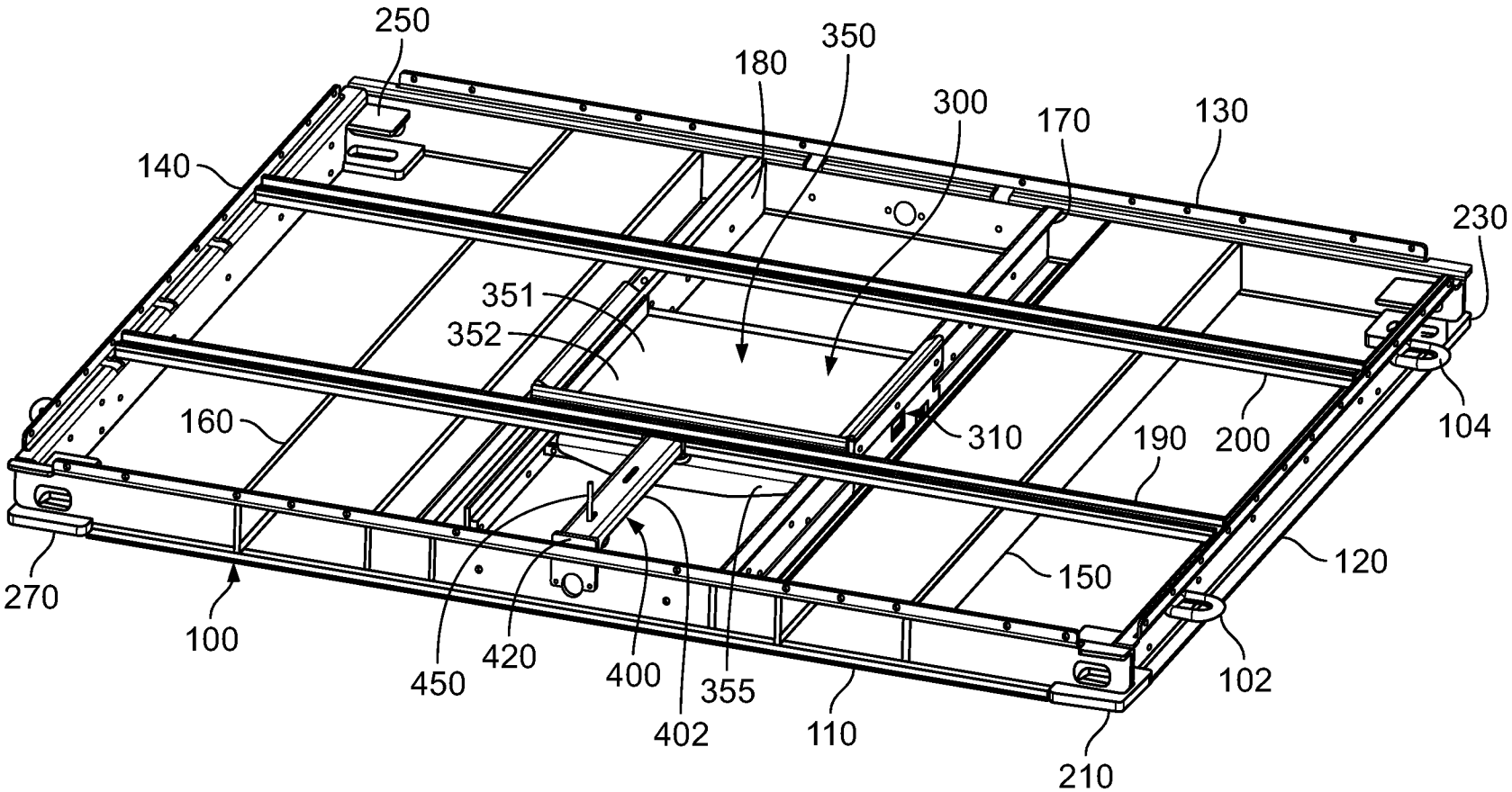
FIG. 13 is an enlarged top perspective view of the pallet of the bulk material shipping container of FIG. 1, shown removed from the container and shown with the material unloading assembly with the gate assembly in a closed and locked position.
Figure 14:
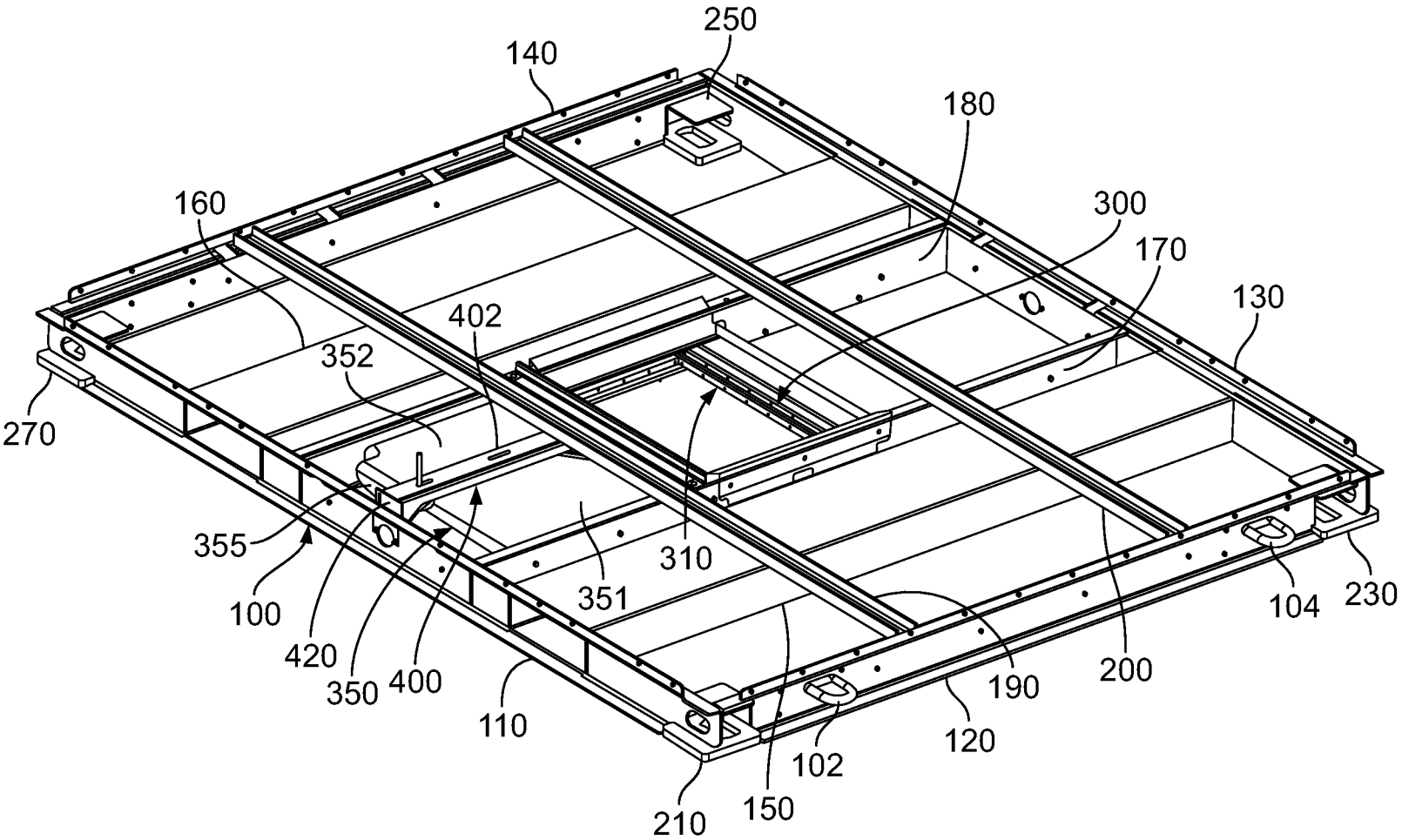
FIG. 14 is an enlarged top perspective view of the pallet of the bulk material shipping container of FIG. 1, shown removed from the container and shown with the material unloading assembly with the gate assembly in an open position.
Figure 15:
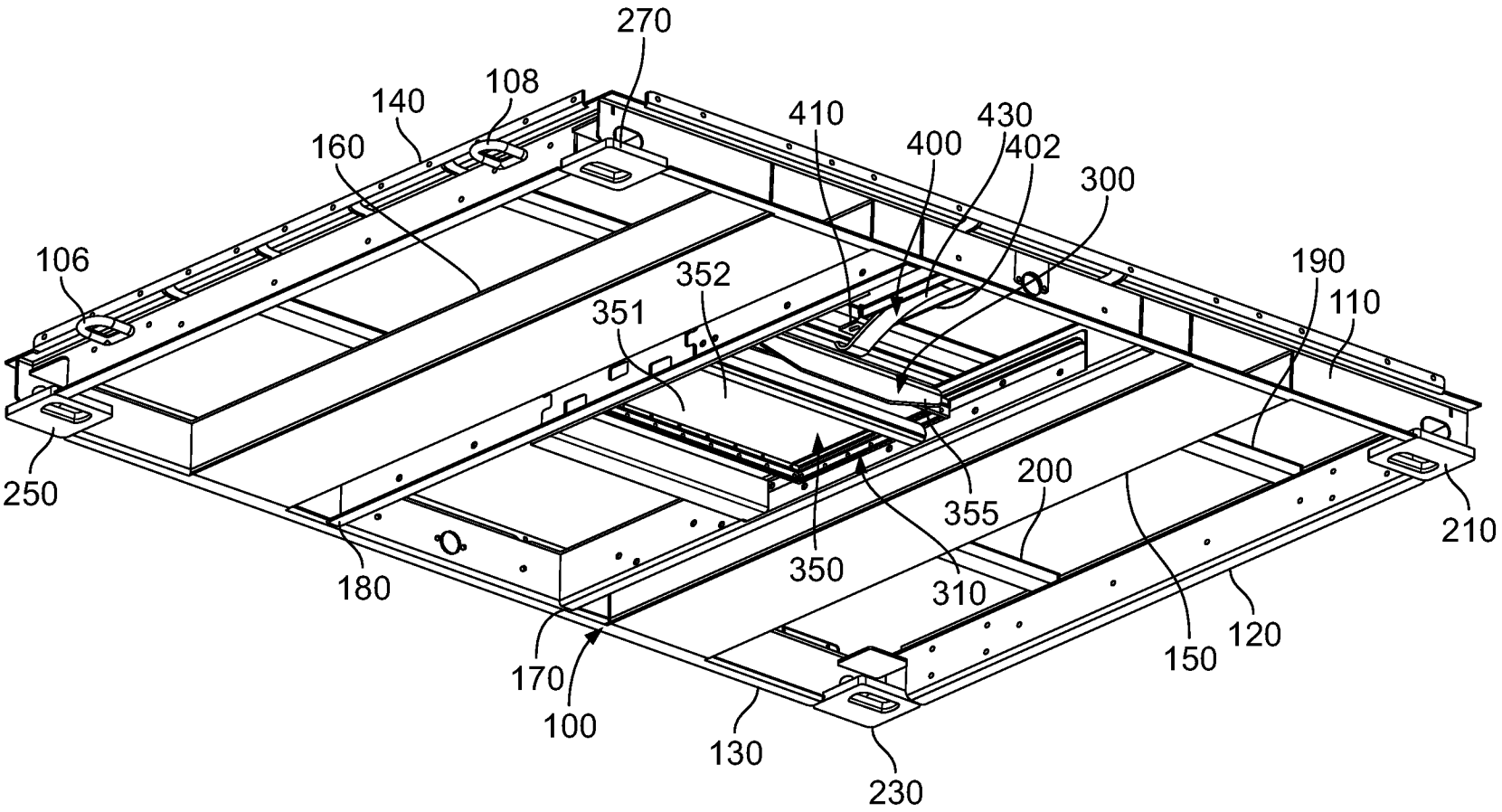
FIG. 15 is an enlarged bottom front perspective view of the pallet of the bulk material shipping container of FIG. 1, shown removed from the container and shown with the material unloading assembly with the gate assembly in a closed and locked position.
Figure 16:
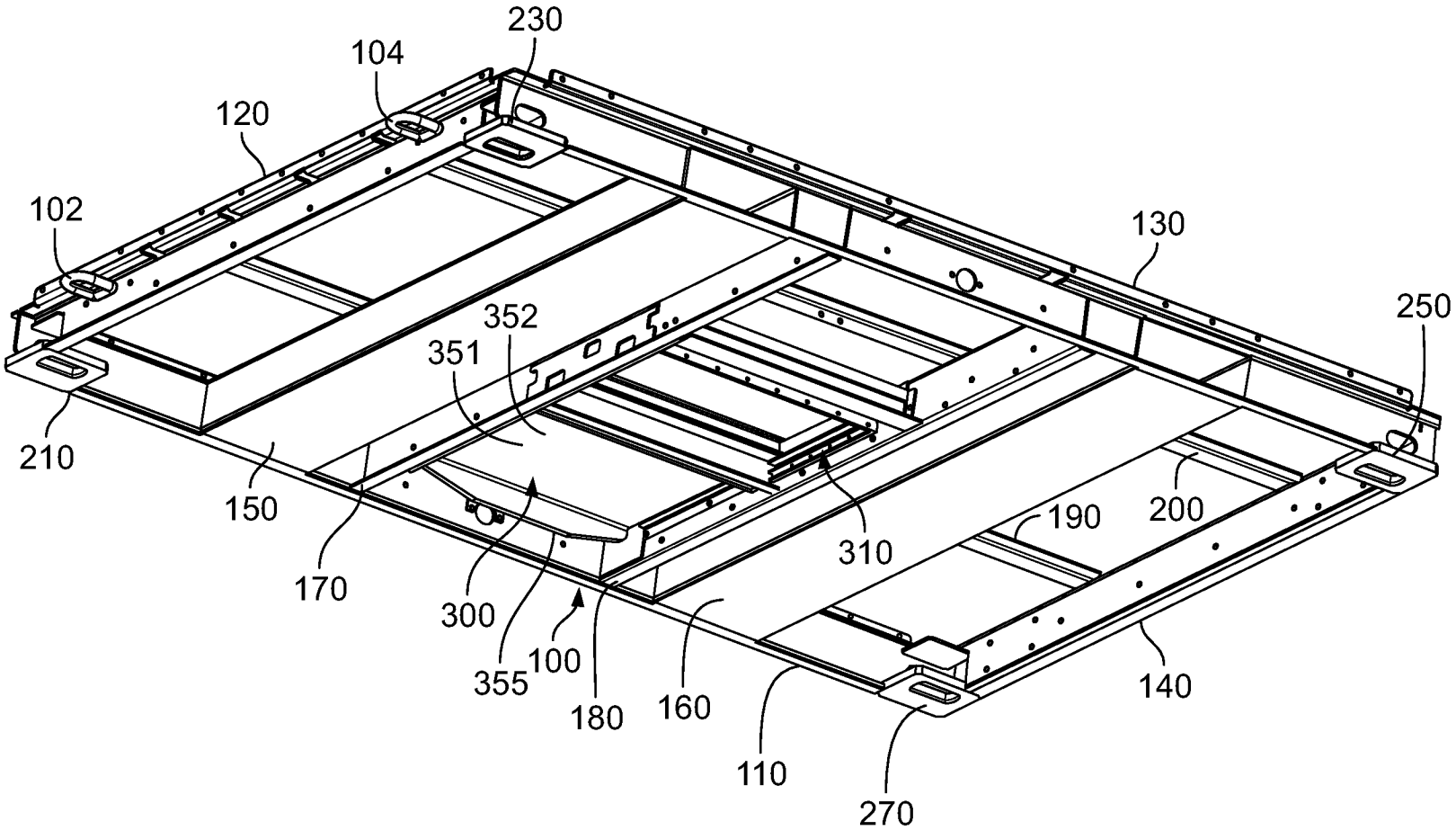
FIG. 16 is an enlarged bottom rear perspective view of the pallet of the bulk material shipping container of FIG. 1, shown removed from the container and shown with the material unloading assembly with the gate assembly in an open position.
Figure 17:
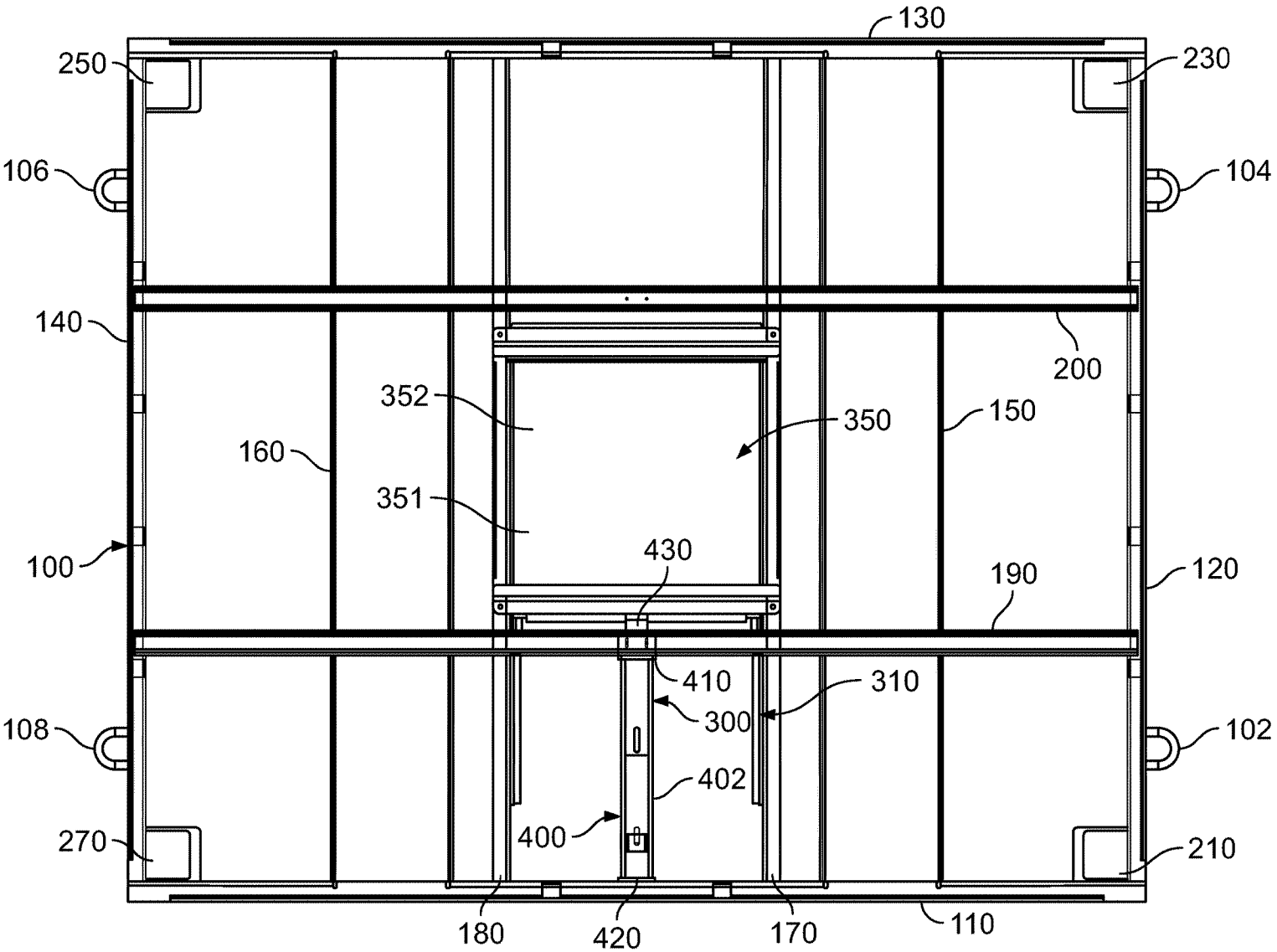
FIG. 17 is an enlarged top view of the pallet of the bulk material shipping container of FIG. 1, shown removed from the container and shown with the material unloading assembly with the gate assembly in a closed and locked position.
Figure 18:
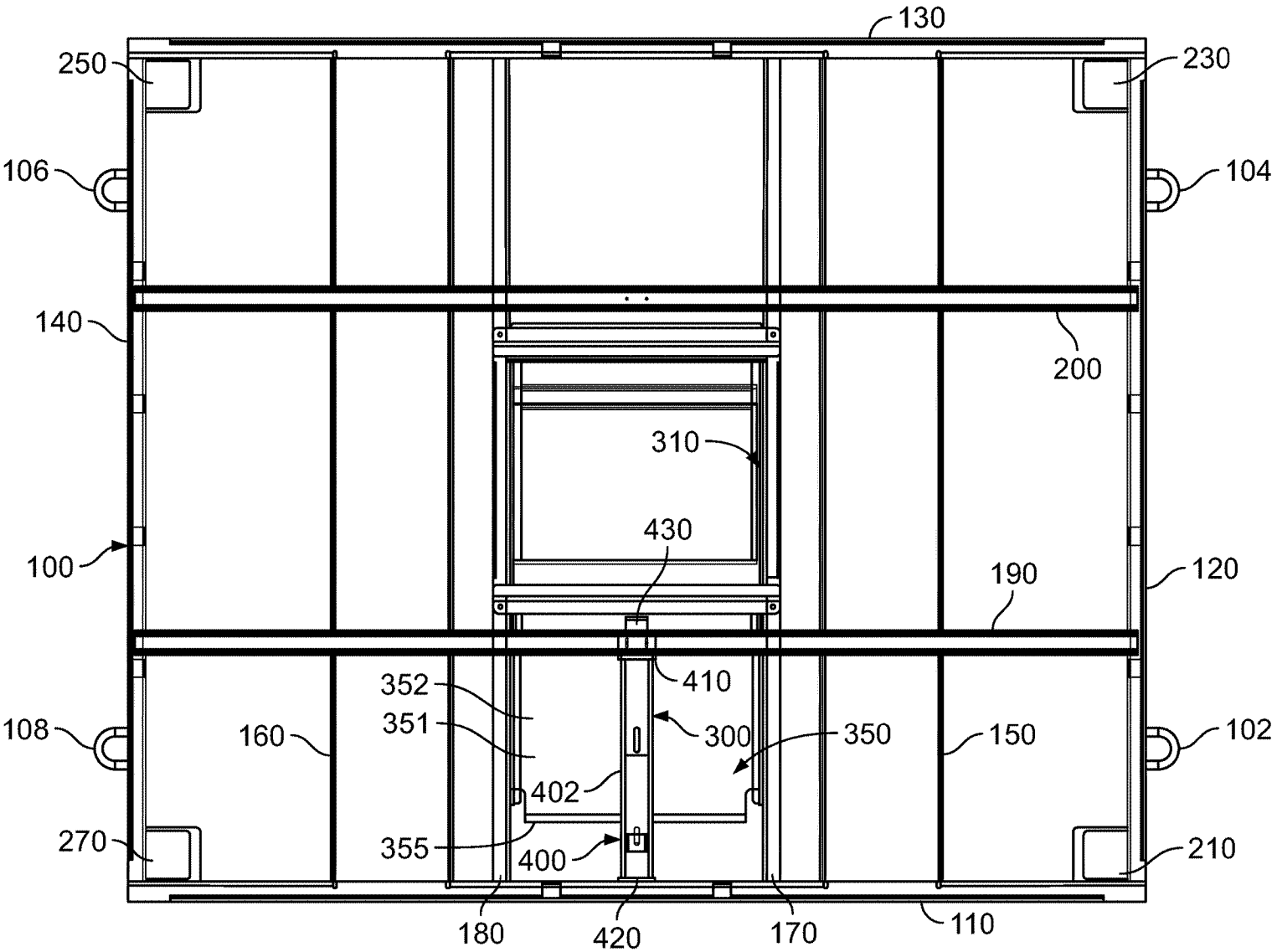
FIG. 18 is an enlarged top view of the pallet of the bulk material shipping container of FIG. 1, shown removed from the container and shown with the material unloading assembly with the gate assembly in an open position.
Figure 19:
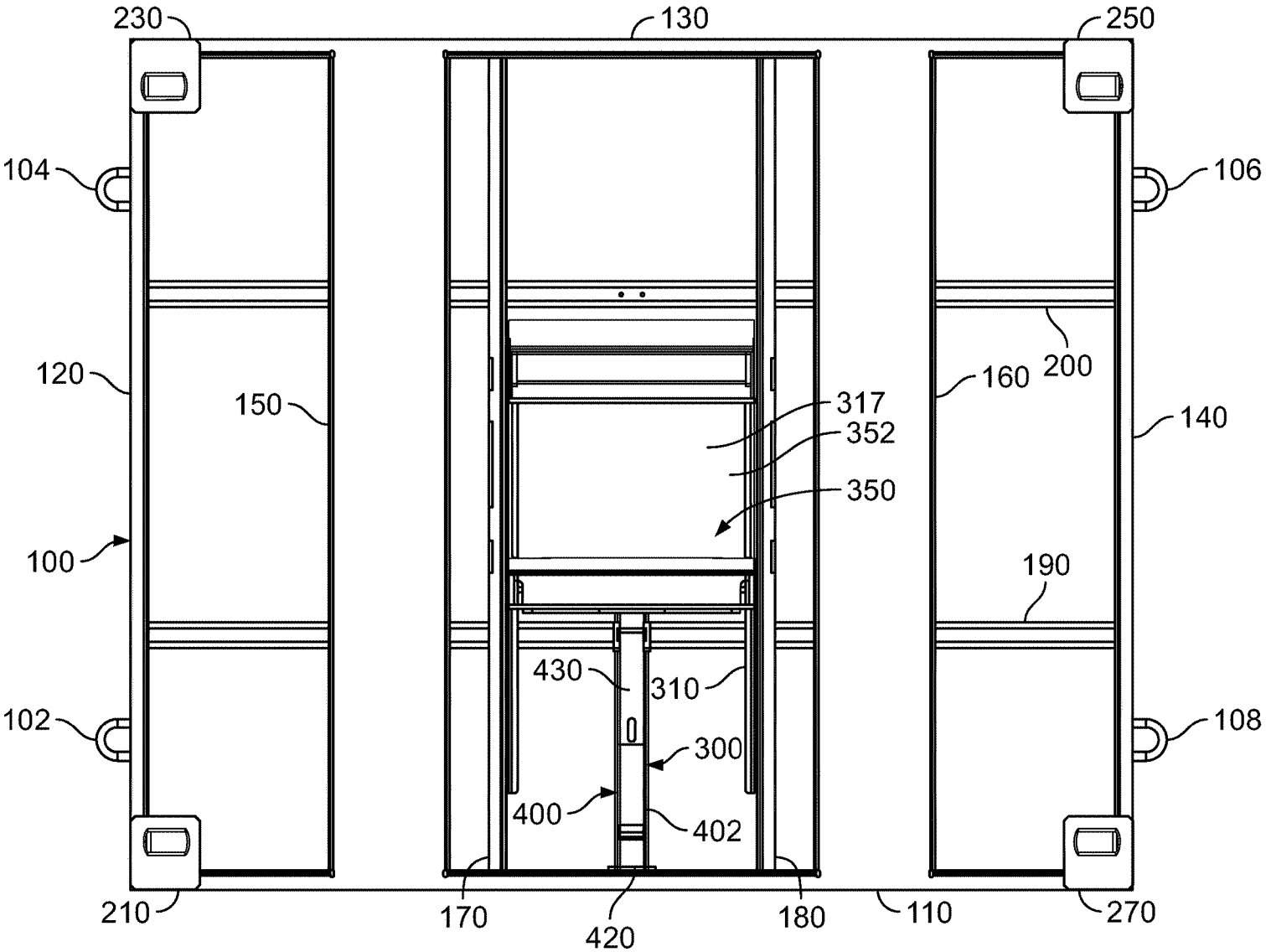
FIG. 19 is an enlarged bottom view of the pallet of the bulk material shipping container of FIG. 1, shown removed from the container and shown with the material unloading assembly with the gate assembly in a closed and locked position.
Figure 20:
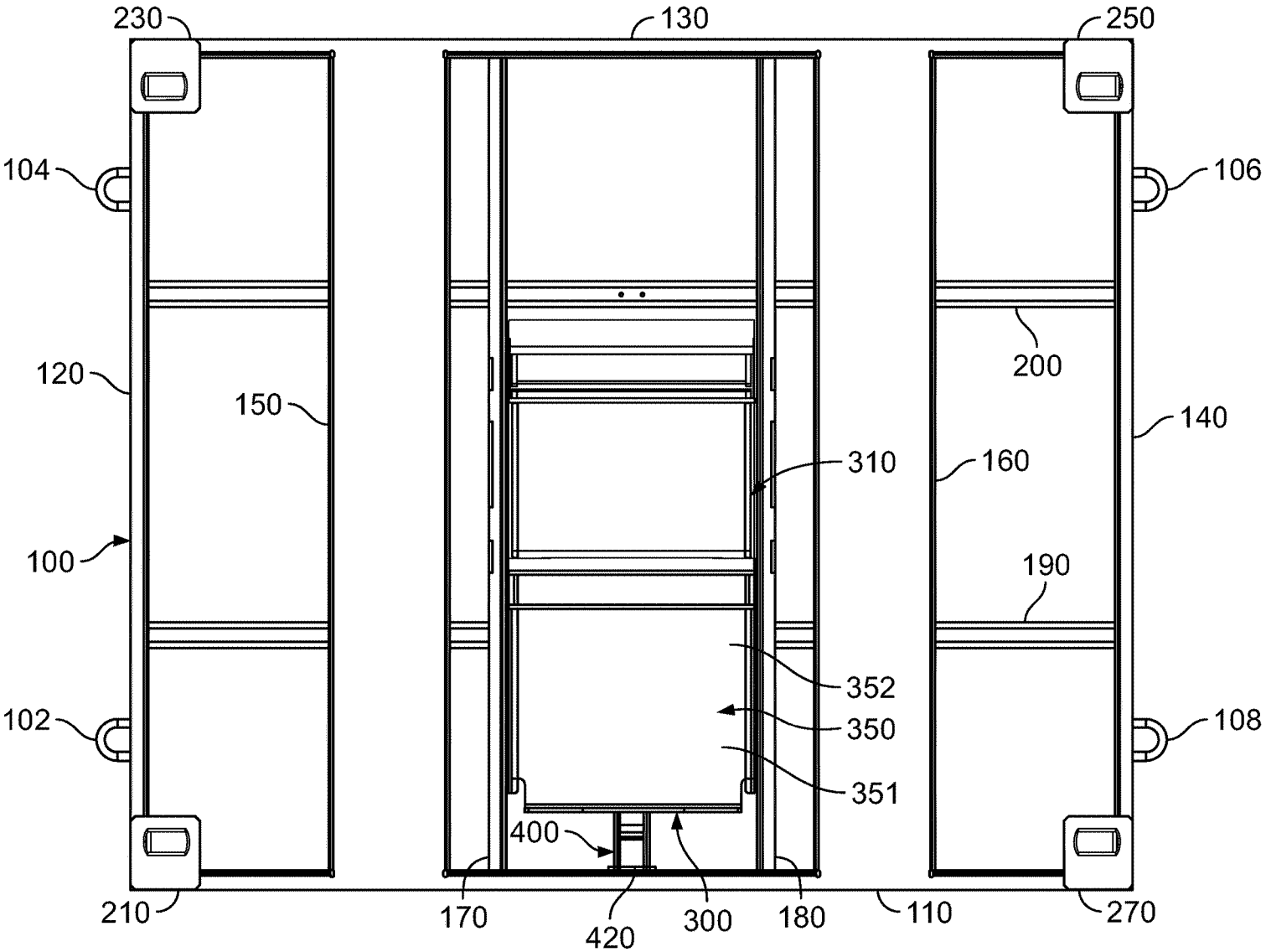
FIG. 20 is an enlarged bottom view of the pallet of the bulk material shipping container of FIG. 1, shown removed from the container and shown with the material unloading assembly with the gate assembly in an open position.
Figure 21:
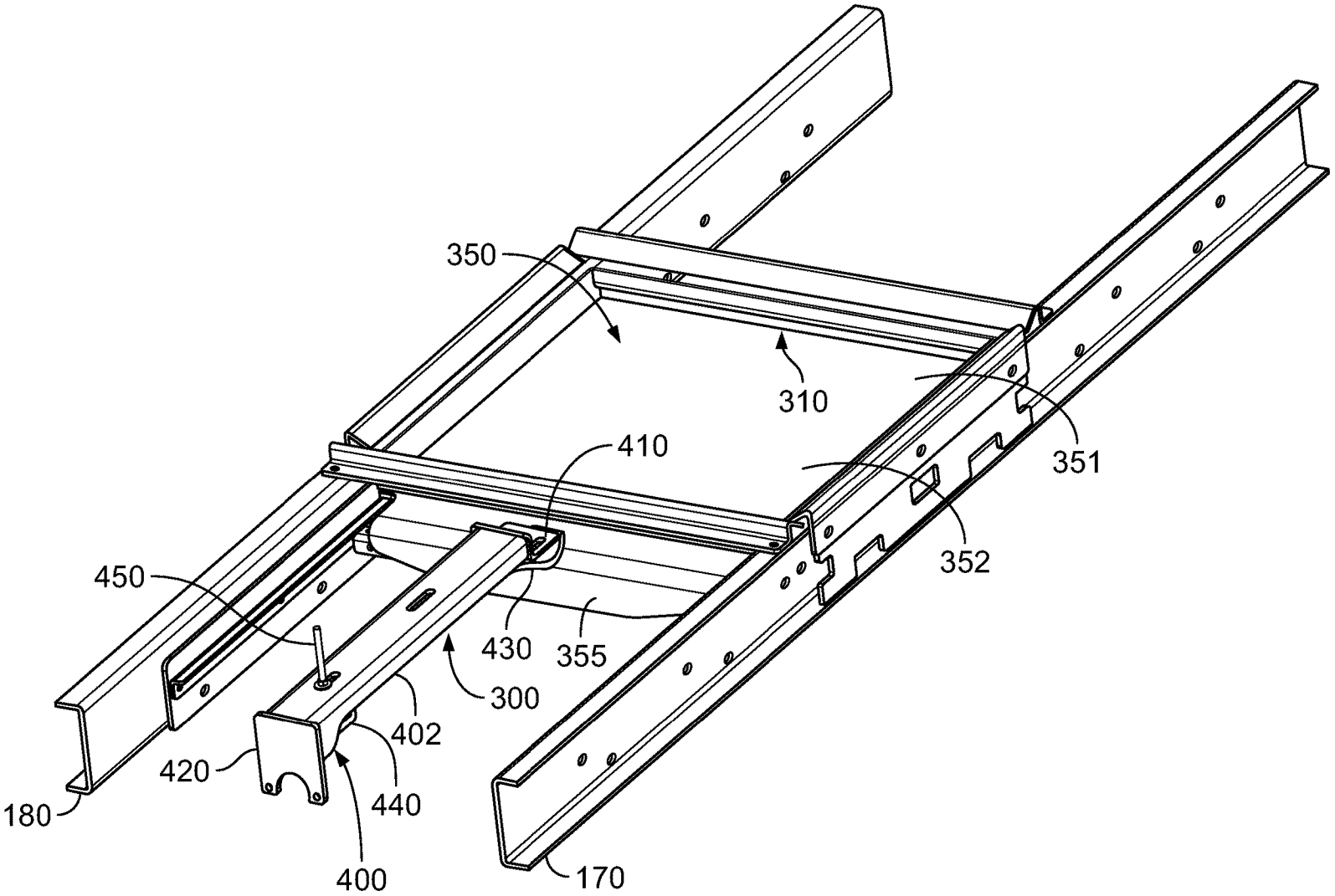
FIG. 21 is an enlarged top front perspective view of the material unloading assembly of the bulk material shipping container of FIG. 1 attached to part of the pallet of the bulk material shipping container of FIG. 1 and with the gate assembly in a closed and locked position.
Figure 22:
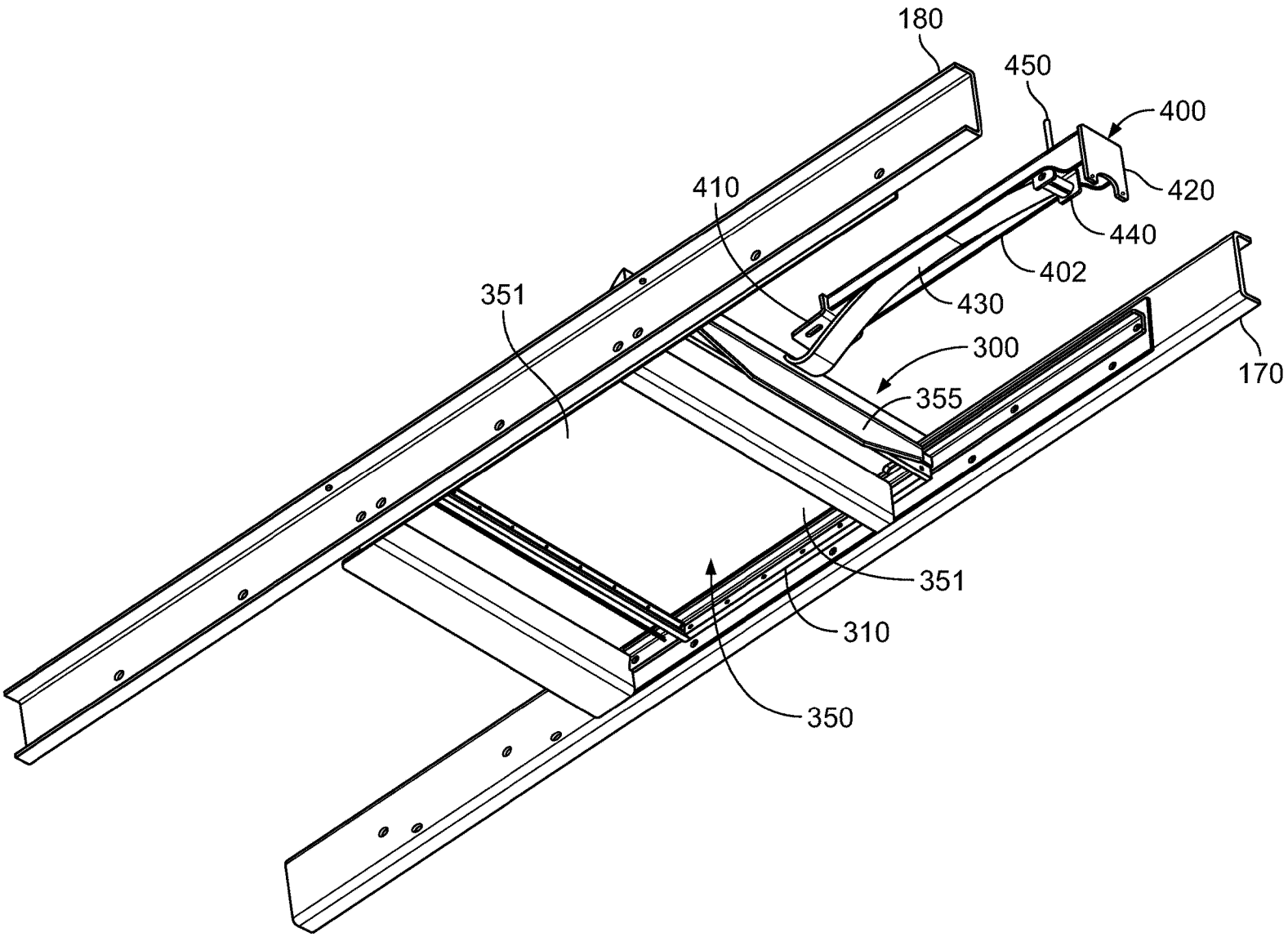
FIG. 22 is an enlarged bottom side perspective view of the material unloading assembly of the bulk material shipping container of FIG. 1 attached to part of the pallet of the bulk material shipping container of FIG. 1 and with the gate assembly in a closed and locked position.

The front support bracket 420 includes a somewhat n-shaped wall 421 that is configured to be attached (by welding and/or suitable fasteners) to the front support 110 of the pallet 100 as generally shown in FIGS. 13, 14, 15 (in phantom), 16, 17, 18, 19, and 20. Thus, the rear support bracket 410 and the front support bracket 420 suitably connect the gate locking assembly 400 to the pallet 100.

The locking bar connector bracket 440 includes: (1) an includes an upper mounting wall 441 that defines a central opening (not labeled but shown in FIG. 23); (2) a first leg 442 integrally connected and extending downwardly from the mounting wall 441; and (3) a second leg 443 integrally connected and extending downwardly from the mounting wall 441. The first and second legs 442 and 443 are suitably spaced apart and each define respective central openings (not labeled but shown in FIG. 23). A suitable fastener or pivot member (not shown or labeled) suitably secures a connection hand 432 (described below) of the locking bar 430 to the locking bar connector bracket 440.

The locking bar 430 is made of a suitable somewhat flexible steel in this illustrated example embodiment and is configured to be biased against or flex against it natural curvature (somewhat like a leaf spring). The locking bar 430 includes: (1) a front connection end portion 431 including a connection hand 432; (2) a central portion 433 including a locking bar support engagement area 434; and (3) a rear gate engagement end portion 435 including an upwardly extending gate engager 436. The front connection end portion 431 and specifically the connection hand 432 is suitably connected to the downwardly extending legs of locking bar connector bracket 440 by a suitable fastener or pivot member (not labeled). The rear gate engagement end portion 435 and specifically the upwardly extending gate engager 436 is configured to engage (as shown in FIGS. 13, 15, 17, 19, 21, 22, 24, and 25) the front side of the downwardly extending front end member 355 of the gate assembly 350 to lock the gate assembly 350 and to be disengaged (as shown in FIGS. 14, 16, 18, and 20) from and move above the downwardly extending front end member 355 and the top surface of the substantially flat generally rectangular closure member 352 of the gate 351 of the gate assembly 350 to unlock the gate assembly 350 and allow the gate assembly 350 to move forwardly. The central portion 433 and particularly the locking bar support engagement area 434 is configured to: (1) engage a bottom surface (not labeled) of the top wall 403 of the locking bar support 402; (2) be moved or actuated in a downward direction to cause the rear gate engagement end portion 435 and specifically the upwardly extending gate engager 436 to move upwardly out of engagement with the downwardly extending front end member 355 of the gate assembly 350; (3) remain in a flexed downward position when the closure member 352 of the gate assembly 350 is in an open position and the rear gate engagement end portion 435 engages the top surface of the close member 352; and (4) move back to its natural position when the closure member 352 of the gate assembly 350 is moved back to the closed and locked position such that the rear gate engagement end portion 435 is out of engagement with the top surface of the close member 352 and such that the upwardly extending gate engager 436 returns to the locking position in engagement with the downwardly extending front end member 355 of the gate assembly 350.

The actuation assembly 450 includes a threaded rod (not separately labeled) and a washer/nut combination (not shown or labeled) attached to the threaded rod. Movement of the threaded rod causes actuation of the locking bar 430 in a suitable manner.

The material unloading assembly 300 of the container 50 is supported by the pallet 100 such that the gate assembly 350 is configured to be positioned under and vertically adjacent to the central bottom opening or chute (generally shown but not labeled in FIGS. 10 and 11) in or defined by the compartment 500 as described below.

The Illustrated Example Compartment

The compartment 500 of this illustrated example embodiment of the shipping container 50 of the present disclosure is generally illustrated in FIGS. 1 to 11, and partly illustrated in FIGS. 34, 34A, and 35 to 48. The compartment 500 defines a chamber or material holding area 502 configured to receive, hold, and release loose materials.

The compartment 500 generally includes: (1) a first upright corner assembly 510; (2) a second upright corner assembly 530; (3) a third upright corner assembly 550; (4) a fourth upright corner assembly 570; (5) an interior bottom wall assembly 590; (6) an interior bottom wall support assembly 630; (7) an exterior front wall assembly 670; (8) an exterior first or left side wall assembly 690; (9) an exterior rear wall assembly 710; (10) an exterior second or right side wall assembly 730; (11) a first upper corner assembly 750; (12) a second upper corner assembly 804; (13) a third upper corner assembly 806; (14) a fourth upper corner assembly 808; (15) a top wall support assembly 830 (best shown in FIGS. 34, 45, 46, 47, and 48); and (16) a top wall assembly 850. The first upright corner assembly 510, the second upright corner assembly 530, the third upright corner assembly 550, the fourth upright corner assembly 570, the interior bottom wall assembly 590, the exterior front wall assembly 670, the exterior first side wall assembly 690, the exterior rear wall assembly 710, the exterior second side wall assembly 730, and the top wall assembly 850 define the compartment material holding area 502 that extends downwardly from the top wall assembly 850 toward the interior bottom wall assembly 590, and to a material release opening or chute 504 defined by the interior bottom wall assembly 590.

In this illustrated embodiment, except as set forth herein (such as for the composite panels of the exterior wall assemblies and the top wall assembly 850), the first upright corner assembly 510, the second upright corner assembly 530, the third upright corner assembly 550, the fourth upright corner assembly 570, the interior bottom wall assembly 590, the exterior front wall assembly 670, the exterior first side wall assembly 690, the exterior rear wall assembly 710, the exterior second side wall assembly 730, and the top wall support assembly 830 are all formed from steel and suitably connected by fasteners or welding to provide suitable structural strength and rigidity. However, it should be appreciated that in alternative embodiments of the present disclosure, the compartment 500 or one or more parts thereof can be made from other suitably strong materials (such as wood, plastic, or composite or fiber glass materials) and that two or more parts thereof can be suitably connected in other manners.

As mentioned above, the compartment 500 includes four upper corner assemblies 750, 804, 806, and 808. Each upper corner assembly 750, 804, 806, and 808 is connected to the top of a different respective W-shaped corner member of a respective upright corner assembly. Each corner assembly 750, 804, 806, and 808 have generally similar shapes in this illustrated example embodiment, although it should be appreciated that corner assemblies 804 and 808 are left hand corner assemblies and that corner assemblies 750 and 806 are right hand corner assemblies in this illustrated example embodiment. Thus, for brevity, only upper corner assembly 750 is described in further detail with respect to Figures.

The example upper corner assembly 750 includes: (1) a horizontally extending base 751; (2) a vertically downwardly extending corner connection bracket 755 integrally connected to the bottom surface of the base 751; (3) a vertically extending tubular body 760 integrally connected to and extending upwardly from the top surface of the base 750; (4) a generally rectangular horizontally extending cap 765 integrally connected to the top surface of the horizontally extending tubular body 760; (5) a vertically extending corner pin 770 integrally connected to the cap 765 and extending upwardly from the top surface of the cap 765; (6) a catch plate 780 integrally connected to the corner connection bracket 755 and the base 751; and (7) an extension or sealing plate 790 integrally connected to the corner connection bracket 755 and the catch plate 780. The corner assembly 750 is formed such that it: (1) can be suitably attached to the top end of the first upright corner assembly 510 by suitable fastener; (2) mates with and supports a corner of the top wall assembly 850; (3) co-acts with the top wall assembly 850 to divert or guide water (and other contaminants) off of the top wall assembly 850; and (4) co-acts with the other top corner assemblies 804, 806, and 808, and various other components of container 50 to facilitate stacking of another container on the container 50.

More specifically, in this illustrated example embodiment, the horizontally extending base 751 is made from steel and includes a generally rectangular body having a top surface, a bottom surface, a front edge, a rear edge, a first side edge, and a second side edge.

In this illustrated example embodiment, the corner connection bracket 755 is made from steel and includes a first wall 756 and a transversely extending integrally connected second wall 758 that are configured to be suitably connected to the top section of the upright corner assembly and particularly the walls of the W-shaped corner member of the upright corner assembly 510 of the compartment 500. In addition to the fastener openings (not labeled), the walls 756 and 758 can include fixture openings (not labeled) that surround the heads of bolts (not shown) that are employed to attach the top wall assembly 850 to the four upper corner assemblies 750, 804, 806, and 808—so that the bolt head do not protrude outwardly. Certain of the fixture openings (not labeled) can also be employed to surround the heads of bolts (not shown) that are employed to attach elongated top wall assembly supporting supports 832, 834, 836, and 838 members to the upright corner sections.

In this illustrated example embodiment, the tubular body 760 is made from steel and includes four integrally connected upwardly extending walls 761, 762, 763, and 764, each having an upper edge, a bottom edge, an inner surface, and an outer surface.

In this illustrated example embodiment, the cap 765 is made from steel and includes a generally rectangular body having a top surface, a bottom surface, a front edge, a rear edge, a first side edge, and a second side edge. The cap 765 is integrally connected to each of the upper edges of the upwardly extending walls 761, 762, 763, and 764 of the tubular body 760. The cap 765 defines an offset corner pin receiving opening (not labeled) for facilitating attachment of the corner pin 770 to the cap 765.

In this illustrated example embodiment, the corner pin 770 is made from a solid piece of steel configured to fit into the corner pin receiver or opening of a bottom corner assembly of a pallet of another container stacked on container 50. The corner pin 770 includes a neck 772 and a head 774 that define generally flat continuous opposing side walls (not labeled) and generally curved end walls (not labeled). The head 774 includes inwardly angled upwardly extending top walls (not labeled) and a horizontally extending top wall (not labeled). The inwardly angled upwardly extending top walls assist in the alignment and centering of another container being stacked on container 50. The opposing flat sides of the head 774 of the corner pin 770 also facilitate alignment and centering of another container being stacked on container 50. The upwardly extending corner pin 770, as well as the other corner pins of the other corner assemblies of the compartment 500 of the container 50, is also configured to be received by standard or other ISO corners.

In this illustrated example embodiment, the corner pin 770 is integrally connected at an offset position on the cap 756. More specifically, during assembly, the neck 772 of the corner pin 770 is inserted through the opening in the top of the cap 765 and welded to the bottom surface of the cap 765. This enables a bottom corner assembly of another container to directly and flatly rest on the upper surface of the cap 765 without interference from any welds on the top surface of the cap 765. This provides for more level and secure stacking of the containers of the present disclosure.

In this illustrated example embodiment, the corner pin 770 fits into an aperture of a standard ISO corner as well as into any of the bottom corner assemblies of the container of the present disclosure.

The catch plate 780 is made from steel and includes: (1) a first base wall 781; (2) a second base wall 782 integrally connected to and extending transversely from the first base wall 781; (3) a first side wall 783 integrally connected to and extending vertically upwardly from the first base wall 781; and (4) a second side wall 784 integrally connected to and extending vertically upwardly from the second base wall 782. The first base wall 781 and the second base wall 782 are each integrally connected to the corner connection bracket 755 and the base 751.

The extension or sealing plate 790 is made from steel and includes: (1) a first base wall 791; and (2) a second base wall 792 integrally connected to and extending transversely from the first base wall 791. The first base wall 791 and the second base wall 792 are integrally connected to the first side wall 783 and the second side wall 784 of the catch plate 780. The first base wall 791 and the second base wall 792 are also integrally connected to the corner connection bracket 755.

The catch plate 780 and the extension or sealing plate 790 co-act to function as a support ledge to support a corner of the top wall assembly 850. The catch plate 780 and the extension or sealing plate 790 also co-act to function as a diverter or guide for diverting or guiding water and other contaminants off of the corner assembly 750. It should be appreciated that the catch plate 780 can be suitably angled to facilitate such water diversion and guidance.

It should be appreciated that these respective steel components are suitably connected by welding in this illustrated example embodiment.

It should further be appreciated that one or more seals or gaskets can be employed at or between the corner assembly 750 (as well as the other corner assemblies 804, 806, and 808) and the top wall assembly 850 to create compression seals.

In this illustrated example embodiment, the second upper corner assembly 804 is a mirror image of the first upper corner assembly 750 in this illustrated example embodiment.

In this illustrated example embodiment, the third upper corner assembly 806 is identical to the first upper corner 750 in this illustrated example embodiment.

In this illustrated example embodiment, the fourth upper corner assembly 808 includes is a mirror image of the first upper corner assembly 750 in this illustrated example embodiment.

As shown in FIGS. 34, 45, 46, 47, and 48 the top wall support assembly 830 of the compartment 500 of the container 50 includes: (1) a front L-shaped angle top support 832; (2) a first or left side L-shaped angle top support 834; (3) a rear L-shaped angle top support 836; and (4) a second or right side L-shaped angle top support 838. The front L-shaped angle top support 832, the first or left side L-shaped angle top support 834, the rear L-shaped angle top support 836, and the second or right side L-shaped angle top support 838 are similar to each other in this illustrated example embodiment.

Figure 48:
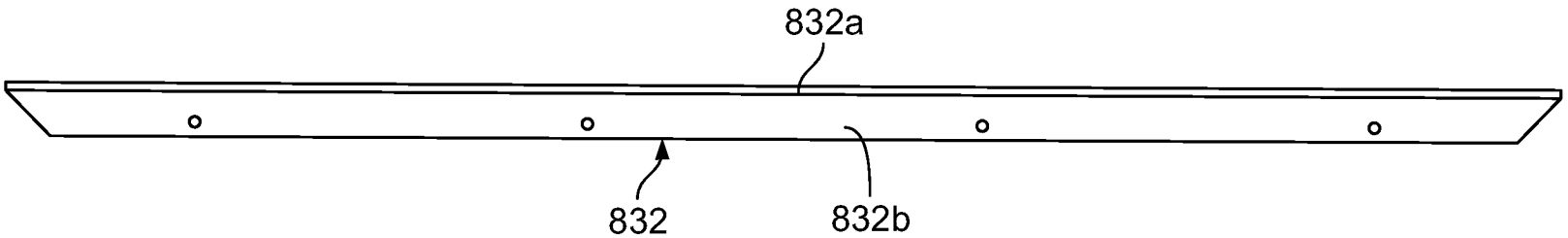
FIG. 48 is an enlarged side view of one of the top wall supports of the top wall support assembly of FIG. 45.

The front L-shaped angle top support 832 includes an elongated horizontally extending top wall **832*a* integrally connected to an elongated vertically extending side wall 832*b*. FIG. 48 shows an enlarge view of this example illustrated support. The first or left side L-shaped angle top support 834 includes an elongated horizontally extending top wall 834*a* integrally connected to an elongated vertically extending side wall 834*b*. The rear L-shaped angle top support 836 includes an elongated horizontally extending top wall 836*a* integrally connected to an elongated vertically extending side wall 836*b*. The second or right side L-shaped angle top support 838 includes an elongated horizontally extending top wall 838*a* integrally connected to an elongated vertically extending side wall 838*b***.

The supports 832, 834, 836, and 838 are configured to partially support the top wall assembly 850. The supports 832, 834, 836, and 838 define fastener receiving holes that enable fasteners (such a bolts and nuts to be used to attach the top wall assembly 850 to these supports 832, 834, 836, and 838.

In this illustrated example embodiment, the top wall assembly 850 of the compartment 500 of the container 50 includes: (1) a molded unitary or one-piece outer structure; and (2) a relatively lightweight relatively strong inner reinforcing structure (not shown) encapsulated in the molded unitary or one-piece outer structure. The outer structure defines an interior cavity (not labeled) in which the inner reinforcing structure (not shown) is positioned. The outer structure of the top wall assembly includes a horizontally or substantially horizontally extending base including: (1) an inner section; (2) a reinforced central section surrounding the inner section and defining the interior cavity; and (3) an outer section surrounding the central section. The outer structure of the top wall assembly includes: (1) four somewhat L-shaped partially raised corner sections extending from the four respective corners of the outer section; and (2) four outer lips extending downwardly from the four respective outer panels of the outer section.

More specifically, the inner section of the outer structure of the top wall assembly includes: (1) a front panel; (2) a rear panel spaced apart from the front panel; (3) a first side panel connecting the front panel and the rear panel; (4) a second side panel connecting the front panel and the rear panel and spaced apart from the first side panel; and (5) an inner lip that is connected to and that extends upwardly and downwardly from the front panel, the rear panel, the first side panel, and the second side panel. Each of the front panel, the rear panel, the first side panel, and the second side panel have respective top and bottom surfaces. The inner lip defines a central material loading opening for the compartment of the container, and includes: (1) a front wall; (2) a rear wall spaced apart from the front wall; (3) a first side wall connecting the front wall and the rear wall; and (4) a second side wall connecting the front wall and the rear wall and spaced apart from the first side wall. The upwardly and downwardly extending inner lip is configured to be engaged by and sealed by the hatch assembly of the material loading assembly. The top wall assembly 850 thus defines a rectangular material receipt or loading opening that enables loose materials to flow into the compartment when the hatch assembly of the material loading assembly is opened.

The central reinforced section of the outer structure of the top wall assembly 850 includes: (1) a front panel; (2) a rear panel spaced apart from the front panel; (3) a first side panel connecting the front panel and the rear panel; and (4) a second side panel connecting the front panel and the rear panel and spaced apart from the first side panel. The front panel extends from the front panel, the rear panel extends from the rear panel, the first side panel extends from the first side panel, and the second side panel extends from the second side panel such that the front panel, the rear panel, the first side panel, and the second side panel surrounds the inner section and specifically respectively surrounds the front panel, the rear panel, the first side panel, and the second side panel. Each of the front panel, the rear panel, the first side panel, and the second side panel have respective top and bottom surfaces.

In this illustrated example embodiment, the front panel, the rear panel, the first side panel, and the second side panel are reinforced by a plurality of suitable inner reinforcing members. In this illustrated example embodiment, the front panel includes spaced apart first (top) and second (bottom) walls that define a front interior cavity, the rear panel includes spaced apart first (top) and second (bottom) walls that define a rear interior cavity, the first side panel includes spaced apart first (top) and second (bottom) walls that define a first side interior cavity (not labeled), and the second side panel includes spaced apart first (top) and second (bottom) walls that define a second side interior cavity. In this illustrated example embodiment, the front interior cavity, the rear interior cavity, the first side interior cavity, and the second side interior cavity are all connected. In this illustrated example embodiment, the front interior cavity, the rear interior cavity, the first side interior cavity, and the second side interior cavity are each partially or fully filled with a relatively light weight relatively strong inner reinforcing material. In this illustrated example embodiment, the reinforcing material is a lightweight wood such as a balsa wood. It should be appreciated that other suitable reinforcing materials may be employed in accordance with the present disclosure. It should be appreciated that the reinforcing material can be arranged in any suitable manner in the connected interior cavities in accordance with the present disclosure. It should be appreciated that two or more of the interior cavities may be separate cavities in accordance with the present disclosure.

The outer section of the outer structure of the top wall assembly includes: (1) a front panel; (2) a rear panel spaced apart from the front panel; (3) a first side panel connecting the front panel and the rear panel; and (4) a second side panel connecting the front panel and the rear panel and spaced apart from the first side panel. The front panel extends from the front panel, the rear panel extends from the rear panel, the first side panel extends from the first side panel, and the second side panel extends from the second side panel such that the front panel, the rear panel, the first side panel, and the second side panel surrounds the inner section and more specifically respectively surround the front panel, the rear panel, the first side panel, and the second side panel. Each of the front panel, the rear panel, the first side panel, and the second side panel have respective top and bottom surfaces.

The four somewhat L-shaped partially raised corner sections of the outer structure of the top wall assembly are identical in this illustrated example embodiment. Each corner section includes: (1) first and second upwardly and outwardly extending inner walls connected by a curved inner wall; (2) first and second outwardly extending top walls connected by a curved top wall; (3) first and second downwardly extending outer walls connected by a downwardly extending curved outer wall; and (4) first and second downwardly extending end walls. Each of the upwardly and outwardly extending inner walls, the outwardly extending top walls, the downwardly extending outer walls have top and bottom surfaces (not labeled). The first and second downwardly extending end walls have inner and outer surfaces.

Each of the corner sections are configured to: (1) direct water (such as from precipitation) away from the corner and off of the container 100; (2) prevent water (and other contaminants) from entering the compartment; and (3) provide for easier, simpler, and quicker attachment of the top wall assembly to the rest of the container.

The four downwardly extending outer lips of the outer structure 310 of the top wall assembly are connected to the outer section of the outer structure. More specifically, (1) outer lip is connected to and extends downwardly from the front panel; (2) outer lip is connected to and extends downwardly from rear panel; (3) outer lip is connected to and extends downwardly from first side panel; and (4) outer lip is connected to and extends downwardly from second side panel. Each of the four downwardly extending outer lips are configured to: (1) prevent water from entering the compartment; and (2) provide for easier, simpler, and quicker attachment of the top wall assembly to the rest of the container. For attachment purposes, suitable holes are formed in each of the outer lips and suitable fasteners (such as nuts, washers, and bolts) are employed to attached each of the respective outer lips to respective top wall assembly supporters.

In this illustrated embodiment, the top wall of the top wall assembly (besides the inner reinforcing structure) is made of fiberglass to: (1) provide a relatively light-weight top wall; (2) facilitate ease of attachment or connection to the rest of the compartment of the container; (3) provide structural strength and rigidity; (4) facilitate ease of cleaning; (5) prevent rusting; (6) minimize overall weight of the container; and (7) prevent contamination. However, it should be appreciated that in alternative embodiments, one or more of these components can be made from other suitable materials and connected in any suitable manner.

The Illustrated Example Material Loading Assembly

The material loading assembly 900 of this illustrated example embodiment of the shipping container 50 of the present disclosure is generally illustrated in FIGS. 1 to 9. The material loading assembly 900 generally includes: (1) a hatch assembly 940 and a hatch movement and locking assembly 970. The hatch assembly 940 is configured to be in a closed position (as shown in FIGS. 1, 2, 4, 5, 6, 7, 8, 10, and 11) to prevent materials or contaminants from entering the compartment 500 through the opening 851 in the top wall assembly 850 of the compartment 500, and to move to a plurality of different partially open positions and to a fully opened position (not shown) to enable materials to be loaded into the compartment 500 through the opening 851 in the top wall assembly 850 of the compartment 500. In this illustrated embodiment, the configuration, arrangement, and attachment of the hatch assembly 940 and the hatch movement and locking assembly 970 provide material contamination prevention and secure access to the compartment 500.

In this illustrated embodiment, except as provided below, the hatch assembly 940 and the hatch movement and locking assembly 970 are formed from steel to provide suitable structural strength and rigidity. However, it should be appreciated that in alternative embodiments, the material loading assembly 900 or one or more parts thereof can be made from other suitably strong materials (such as wood, plastic, or composite or fiber glass materials).

This continuous lip prevents contaminants (including solid particles and/or water or other liquids) on top wall assembly 850 of the compartment 500 from flowing into the compartment 500 through the opening 851 in the top wall assembly 850 of the compartment 500.

Although not shown, in this illustrated embodiment, a suitable sealant is applied on the top wall assembly to further prevent or assist in preventing contaminants (such as solid particles and/or water or other liquids) from entering the compartment 500.

It should be appreciated that a suitable locking mechanism (not shown) may be employed in accordance with the present disclosure to lock the material loading assembly.

Additional Features and Components

It should be appreciated that suitable instructional marking or labels may be placed on or connected to the container of the present disclosure to instruct the users, operators, loaders, or unloaders on how to use, load, unload, and/or move the container in accordance with the present disclosure.

It should also be appreciated that suitable reflective tape strips can be connected to the container in accordance with the present disclosure.

It should further be appreciated that the container of the present disclosure can be suitably coated (such as by painting with a clear or colored protective coating). It should be appreciated that such coating may include a UV protective agent.

It should also be appreciated that one or more sections of the container may be reinforced with a suitable plating to provide additional protection and strength in accordance with the present disclosure.

It should also be appreciated that one or more vents can be formed in or attached to the container in accordance with the present disclosure.

It should further be appreciated that the attachment of the various components of the container can be performed in any suitable way such as by welding (including but not limited to laser welding) and by suitable fasteners (such as but not limited to rivets and bolts and nuts).

It should be appreciated that the present disclosure contemplates the elimination or reduction of sharp edges in the compartment and that any sharp edges can be curved or formed with a suitable radius.

It should be understood that modifications and variations may be effected without departing from the scope of the novel concepts of the present disclosure, and it should be understood that this application is to be limited only by the scope of the appended claims.

The invention is claimed as follows:

1. A material shipping container comprising:
- a pallet;
- a compartment supported by the pallet;
- a material unloading assembly supported by the pallet, the material unloading assembly including:
  - a gate support assembly,
  - a gate assembly including a closure member and a downwardly extending member connected to the closure member, said gate assembly movable from a closed position to an opened position, and
  - a gate locking assembly including a locking bar configured to:
    - (1) lock the gate assembly in the closed position,
    - (2) be activated to unlock the gate assembly to allow the gate assembly to move to the opened position, and
    - (3) automatically re-lock the gate assembly when the gate assembly returns to the closed position; and
- a material loading assembly connected to the compartment.

2. The material shipping container of claim 1, wherein the locking bar includes a gate engager configured to engage the downwardly extending member of the gate assembly to lock the gate assembly and configured disengage from the downwardly extending member of the gate assembly to unlock the gate assembly.

3. The material shipping container of claim 1, wherein the locking bar includes:
- (1) a front connection end portion including a connection hand; (2) a central portion including a locking bar support engagement area; and (3) a rear gate engagement end portion including an upwardly extending gate engager.

4. The material shipping container of claim 1, wherein the gate locking assembly includes: a locking bar support, a rear support bracket, a front support bracket, a locking bar connector bracket, and an actuation assembly.

5. A material shipping container comprising:
- a pallet;
- a compartment supported by the pallet;
- a material unloading assembly supported by the pallet, the material unloading assembly including:
  - a gate support assembly,
  - a gate assembly including a closure member and a downwardly extending member connected to the closure member and movable from a closed position to an opened position, and a gate locking assembly including a locking bar including a gate engager configured to engage the downwardly extending member of the gate assembly to lock the gate assembly and configured disengage from the downwardly extending member of the gate assembly to unlock the gate assembly; and a material loading assembly connected to the compartment.

6. The material shipping container of claim 5, wherein the locking bar includes: (1) a front connection end portion including a connection hand; (2) a central portion including a locking bar support engagement area; and (3) a rear gate engagement end portion including an upwardly extending gate engager.

7. The material shipping container of claim 5, wherein the gate locking assembly includes: a locking bar support, a rear support bracket, a front support bracket, a locking bar connector bracket, and an actuation assembly.

8. A material shipping container comprising:

a pallet;

a compartment supported by the pallet;

a material unloading assembly supported by the pallet, the material unloading assembly including:

a gate support assembly, a gate assembly including a closure member and a downwardly extending member connected to the closure member and movable from a closed position to a fully open position, and a gate locking assembly including a locking bar including a front connection end portion including a connection hand, a central portion including a locking bar support engagement area, and a rear gate engagement end portion including an upwardly extending gate engager;

a locking bar support;

a rear support bracket;

a front support bracket;

a locking bar connector bracket; and an actuation assembly; and a material loading assembly connected to the compartment.

9. The material shipping container of claim 8, wherein the locking bar is configured to:

(1) lock the gate assembly in the closed position, (2) be activated to unlock the gate assembly to allow the gate assembly to move to the opened position, and (3) automatically re-lock the gate assembly when the gate assembly returns to the closed position.

10. A material shipping container comprising:

a pallet;

a compartment supported by the pallet, the compartment including:

a top wall assembly, a first upper corner assembly including a first support having a first cap located above the top wall assembly and a first catch plate forming a first water diverter that extends at least partially around the first support for diverting water off of the first upper corner assembly, a second upper corner assembly including a second support having a second cap located above the top wall assembly and a second catch plate forming a second water diverter that extends at least partially around the second support for diverting water off of the second upper corner assembly, a third upper corner assembly including a third support having a third cap located above the top wall assembly and a third catch plate forming a third water diverter that extends at least partially around the third support for diverting water off of the third upper corner assembly, and a fourth upper corner assembly including a fourth support having a fourth cap located above the top wall assembly and a fourth catch plate forming a fourth water diverter that extends at least partially around the fourth support for diverting water off of the fourth upper corner assembly;

a material unloading assembly connected to the pallet; and a material loading assembly connected to the top wall assembly.

11. A material shipping container comprising:

a pallet;

a compartment supported by the pallet, the compartment including:

a top wall assembly, a first upper corner assembly including a first extension plate supporting a first corner of the top wall assembly and a first catch plate forming a first water diverter for diverting water off of the first upper corner assembly, a second upper corner assembly including a second extension plate supporting a second corner of the top wall assembly and a second catch plate forming a second water diverter for diverting water off of the second upper corner assembly, a third upper corner assembly including a third extension plate supporting a third corner of the top wall assembly and a third catch plate forming a third water diverter for diverting water off of the third upper corner assembly, and a fourth upper corner assembly including a fourth extension plate supporting a fourth corner of the top wall assembly and a fourth catch plate forming a fourth water diverter for diverting water off of the fourth upper corner assembly;

a material unloading assembly connected to the pallet; and a material loading assembly connected to the top wall assembly.

* * * * *